US011548748B2

(12) United States Patent
Aoyama

(10) Patent No.: US 11,548,748 B2
(45) Date of Patent: Jan. 10, 2023

(54) IMAGE FORMING APPARATUS

(71) Applicant: Jumpei Aoyama, Kanagawa (JP)

(72) Inventor: Jumpei Aoyama, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 83 days.

(21) Appl. No.: 17/197,083

(22) Filed: Mar. 10, 2021

(65) Prior Publication Data

US 2021/0283928 A1 Sep. 16, 2021

(30) Foreign Application Priority Data

Mar. 11, 2020 (JP) ..... JP2020-041911

(51) Int. Cl.

| | |
|---|---|
| ***B65H 29/12*** | (2006.01) |
| ***B41J 11/00*** | (2006.01) |
| ***B65H 29/58*** | (2006.01) |
| *B41J 13/00* | (2006.01) |

(52) U.S. Cl.

CPC ..... *B65H 29/12* (2013.01); *B41J 11/0022* (2021.01); *B65H 29/58* (2013.01); *B41J 13/0036* (2013.01); *B65H 2301/517* (2013.01); *B65H 2403/942* (2013.01); *B65H 2601/251* (2013.01)

(58) Field of Classification Search

CPC ..... B65H 5/06; B65H 5/062; B65H 29/12; B65H 29/58; B65H 2301/3331; B65H 2301/33312; B65H 2301/5144; B65H 2301/517; B65H 2403/942; B65H 2404/1115; B65H 2515/40; B65H 2601/251; B65H 2701/528; B65H 2801/24; B65H 2801/27; B41J 11/002; B41J 11/0022; B41J 13/0036

See application file for complete search history.

(56) References Cited

U.S. PATENT DOCUMENTS

| | | | | |
|---|---|---|---|---|
| 2011/0158725 | A1* | 6/2011 | Asada | B65H 1/266 399/397 |
| 2011/0163495 | A1 | 7/2011 | Aoyama et al. | |
| 2011/0163496 | A1 | 7/2011 | Aoyama et al. | |
| 2011/0175282 | A1 | 7/2011 | Sagawa et al. | |
| 2011/0228289 | A1* | 9/2011 | Yamamoto | G03G 21/206 358/1.8 |
| 2013/0250328 | A1 | 9/2013 | Ohtsuka et al. | |
| 2013/0270765 | A1 | 10/2013 | Araaki et al. | |
| 2014/0159303 | A1* | 6/2014 | Suzuki | G03G 15/234 271/226 |
| 2014/0183813 | A1 | 7/2014 | Aoyama | |
| 2014/0210157 | A1 | 7/2014 | Aoyama | |

(Continued)

FOREIGN PATENT DOCUMENTS

| | | |
|---|---|---|
| JP | 2008-080808 | 4/2008 |

*Primary Examiner* — Prasad V Gokhale

(74) *Attorney, Agent, or Firm* — Xsensus LLP

(57) ABSTRACT

An image forming apparatus includes a housing, a sheet conveyor, a sheet stacker, and circuitry. The sheet conveyor is configured to convey a sheet on which liquid is applied. The sheet stacker is configured to stack the sheet conveyed by the sheet conveyor. The circuitry is configured to control conveyance of the sheet. The circuitry is configured to cause the sheet conveyor to expose the sheet on which the liquid is applied, to an outside of the housing, and convey the sheet to the sheet stacker.

25 Claims, 40 Drawing Sheets

(56) References Cited

U.S. PATENT DOCUMENTS

| | | | | |
|---|---|---|---|---|
| 2015/0132039 | A1 | 5/2015 | Tobinaga et al. | |
| 2015/0251864 | A1 | 9/2015 | Aoyama et al. | |
| 2015/0321863 | A1 | 11/2015 | Aoyama | |
| 2016/0282803 | A1* | 9/2016 | Osaki | B65H 31/02 |
| 2016/0334748 | A1 | 11/2016 | Aoyama et al. | |
| 2017/0115618 | A1 | 4/2017 | Tobinaga et al. | |
| 2017/0227911 | A1 | 8/2017 | Kuno et al. | |
| 2017/0308021 | A1* | 10/2017 | Kato | B65H 7/02 |
| 2018/0127223 | A1 | 5/2018 | Horita et al. | |
| 2019/0039842 | A1 | 2/2019 | Aoyama et al. | |
| 2019/0225438 | A1 | 7/2019 | Aoyama et al. | |
| 2019/0243296 | A1 | 8/2019 | Shiga et al. | |
| 2020/0102168 | A1 | 4/2020 | Horita et al. | |
| 2020/0290829 | A1 | 9/2020 | Aoyama et al. | |

* cited by examiner

IMAGE FORMING APPARATUS

CROSS-REFERENCE TO RELATED APPLICATION

This patent application is based on and claims priority pursuant to 35 U.S.C. § 119(a) to Japanese Patent Application No. 2020-041911, filed on Mar. 11, 2020, in the Japan Patent Office, the entire disclosure of which is hereby incorporated by reference herein.

BACKGROUND

Technical Field

Embodiments of the present disclosure relate to an image forming apparatus.

Background Art

Various types of image forming apparatuses such as copiers and printers are known to include an inkjet image forming apparatus that discharges ink onto a sheet to form an image on the sheet.

Such an inkjet image forming apparatus takes a certain period of time to dry ink applied to a sheet. Therefore, when an image is formed on a sheet, if the ink applied face of the sheet contacts, e.g., a guide immediately after the printing, the ink on the ink applied face is distorted, resulting in deterioration in image quality.

SUMMARY

At least one aspect of this disclosure, a novel image forming apparatus includes a housing, a sheet conveyor, a sheet stacker, and circuitry. The sheet conveyor is configured to convey a sheet on which liquid is applied. The sheet stacker is configured to stack the sheet conveyed by the sheet conveyor. The circuitry is configured to control conveyance of the sheet. The circuitry is configured to cause the sheet conveyor to expose the sheet on which the liquid is applied, to an outside of the housing, and convey the sheet to the sheet stacker.

Further, at least one aspect of this disclosure, another novel image forming apparatus includes a housing, a sheet conveyor, a post-processing apparatus, and circuitry. The sheet conveyor is configured to convey a sheet on which liquid is applied. The post-processing apparatus is configured to perform a post-processing operation to the sheet conveyed by the sheet conveyor. The circuitry is configured to control conveyance of the sheet. The circuitry is configured to cause the sheet conveyor to expose the sheet on which the liquid is applied, to an outside of the housing, and convey the sheet to the post-processing apparatus.

Further, at least one aspect of this disclosure, yet another novel image forming apparatus includes a housing, a sheet conveyor, a sheet conveying device, and circuitry. The sheet conveyor is configured to convey a sheet on which liquid is applied. The sheet conveying device is configured to convey the sheet to a post-processing apparatus configured to perform a post-processing operation to the sheet conveyed by the sheet conveyor. The circuitry is configured to control conveyance of the sheet. The circuitry is configured to cause the sheet conveyor to expose the sheet on which the liquid is applied, to an outside of the housing, and convey the sheet to the sheet conveying device.

BRIEF DESCRIPTION OF THE SEVERAL VIEWS OF THE DRAWINGS

Exemplary embodiments of this disclosure will be described in detail based on the following figures, wherein.

Figure 1:
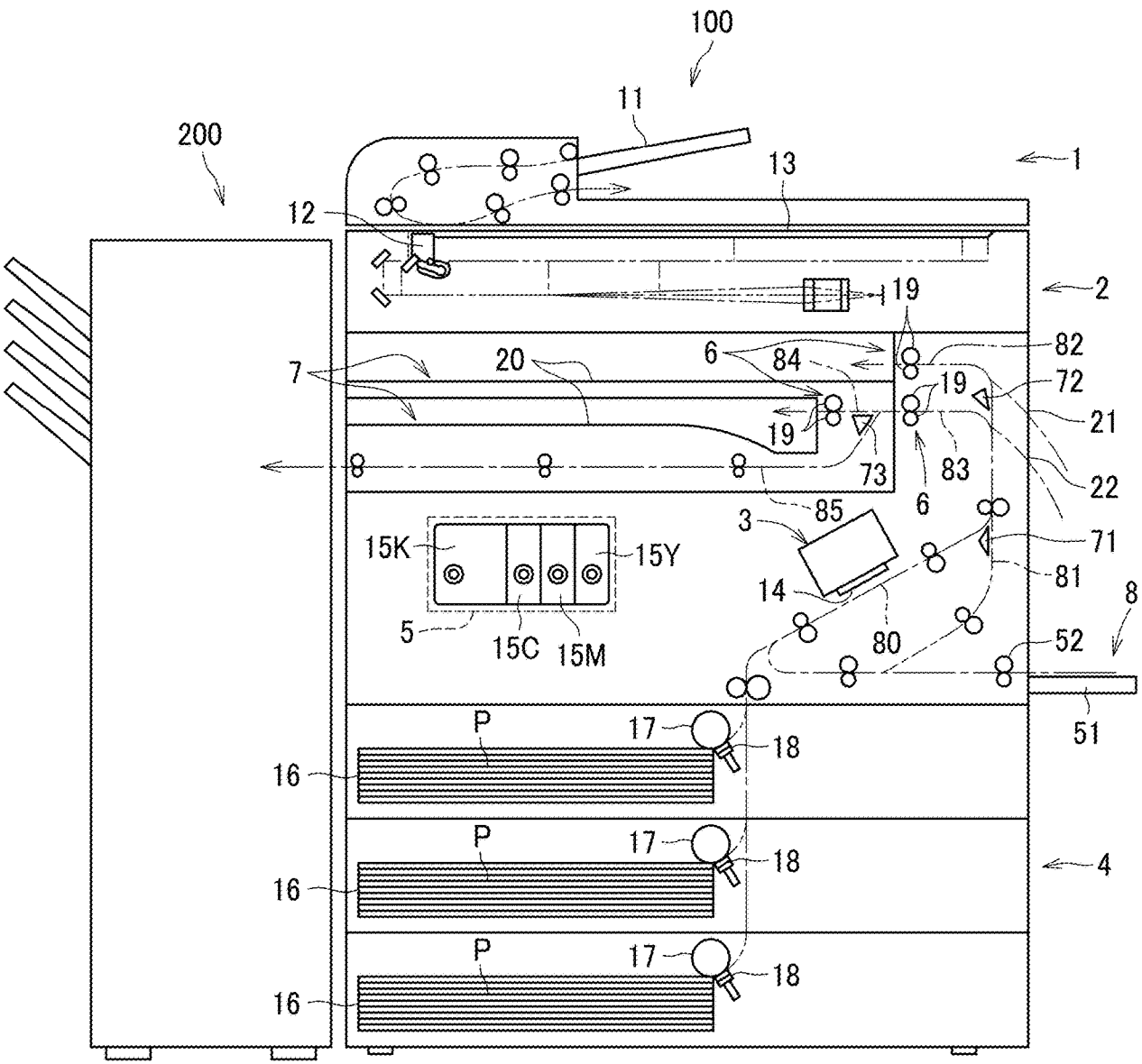
FIG. 1 is a diagram illustrating a schematic configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

Descriptions are given of an example applicable to an image forming apparatus. It is to be noted that elements (for example, mechanical parts and components) having the same functions and shapes are denoted by the same reference numerals throughout the specification and redundant descriptions are omitted.

FIG. 1 is a diagram illustrating a schematic configuration of an image forming apparatus according to an embodiment of the present disclosure.

As illustrated in FIG. 1, an image forming apparatus 100 according to the present embodiment includes an original document conveying device 1, an image reading device 2, an image forming device 3, a sheet feeding device 4, a cartridge container 5, a sheet ejecting device 6, a sheet stacker 7, and a bypass sheet feeding device 8. Further, a sheet alignment apparatus 200 is disposed adjacent to the image forming apparatus 100. The sheet alignment apparatus 200 may be included in the image forming apparatus 100.

The original document conveying device 1 separates an original document from the other original documents one by one from a set of original documents on an original document tray 11 and conveys the separated original document toward an exposure glass 13 of the image reading device 2. The original document conveying device 1 includes a plurality of conveyance rollers each functioning as an original document conveyor to convey the original document.

The image reading device 2 is an image scanner, that is, a device to scan the image on an original document placed on the exposure glass 13 or the image on an original document as the original document passes over the exposure glass 13. The image reading device 2 includes an optical scanning unit 12 as an image reading unit. The optical scanning unit 12 includes a light source that irradiates an original document placed on the exposure glass 13 with light, and a charge-coupled device (CCD) as an image reader that reads an image from the reflected light of the original document. Further, a close contact-type image sensor (CIS) may be employed as an image reader.

The image forming device 3 includes a liquid discharge head 14 that functions as a liquid applier to apply liquid to a sheet. The liquid discharge head 14 discharges ink that is liquid used for image formation and applies the ink to the sheet. The liquid discharge head 14 may be a serial-type liquid discharge head that discharges ink while moving in the main scanning direction of a sheet (i.e., the sheet width direction) or a line-type liquid discharge head that discharges ink without moving a plurality of liquid discharge heads aligned in the main scanning direction.

Ink cartridges 15Y, 15M, 15C, and 15K are detachably attached to the cartridge container 5. The ink cartridges 15Y, 15M, 15C, and 15K are filled with inks of different colors such as yellow, magenta, cyan, and black, respectively. The ink in each ink cartridge (i.e., the ink cartridges 15Y, 15M, 15C, 15K) is supplied to the liquid discharge head 14 by an ink supply pump.

The sheet feeding device 4 includes a plurality of sheet feed trays 16 each functioning as a sheet container. Each sheet feed tray 16 loads a bundle of sheets including a sheet P. Each sheet P on which an image is formed is a cut sheet cut in a predetermined size, e.g., A4 size and B4 size, and is previously contained in the sheet feed tray 16 in a corresponding sheet conveyance direction. Further, each sheet feed tray 16 includes a sheet feed roller 17 that functions as a sheet feeder and a sheet separation pad 18 that functions as a sheet separator.

The bypass sheet feeding device 8 includes a bypass tray 51 and a bypass sheet feed roller 52. The bypass tray 51 functions as a sheet loader to load the sheet P that is fed from the outside of the housing of the image forming apparatus 100. The bypass sheet feed roller 52 functions as a sheet feed body to feed the sheet P from the bypass tray 51. The bypass tray 51 is attached to open and close with respect to the housing of the image forming apparatus 100. In other words, the bypass tray 51 is rotatably attached to the housing of the image forming apparatus 100. When the bypass tray 51 is open (state in FIG. 1), the sheet P or the bundle of sheets including the sheet P is loaded on the bypass tray 51 to feed the sheet P to the housing of the image forming apparatus 100.

The sheet ejecting device 6 includes a pair of sheet ejection rollers 19 that functions as a sheet conveyor that conveys a sheet. The pair of sheet ejection rollers 19 rotates so as to convey the sheet while holding the sheet. The pair of sheet ejection rollers 19 is rotatable in one direction and another direction opposite the one direction.

The sheet stacker 7 includes a sheet ejection tray 20 that stacks the sheet ejected to the outside of the housing of the image forming apparatus 100. In the present embodiment, the sheet ejection tray 20 is disposed between the image reading device 2 and the image forming device 3 and employs an in-body sheet ejection configuration. Further, the sheet ejection tray 20 may be provided in space of the outside of the housing of the image forming apparatus 100, e.g., on the upper face of the housing of the image forming apparatus 100. Further, the sheet ejection tray 20 may have the configuration of two-step vertical trays as illustrated in FIG. 1 or may have a configuration of a single-step tray.

The sheet alignment apparatus 200 functions as a post-processing apparatus (post-processing device) to align and register the sheets P conveyed from the image forming apparatus 100. Further, in addition to the sheet alignment apparatus 200, another post-processing apparatus such as a stapling device that staples (binds) the sheets and a punching device that punches holes in the sheet may be installed.

To provide a fuller understanding of the embodiments of the present disclosure, a description is now given of the image forming operation of the image forming apparatus 100 according to the present embodiment of this disclosure, with continued reference to FIG. 1.

As an instruction is given to start the printing operation, a sheet P is fed from one sheet feed tray 16 of the plurality of sheet feed trays 16. To be more specific, as the sheet feed roller 17 rotates, an uppermost sheet P placed on top of the bundle of sheets P contained in the sheet feed tray 16 is fed by the sheet feed roller 17 and the sheet separation pad 18 while the uppermost sheet P is separated from the other sheets of the bundle of sheets. When the sheet is fed from the outside of the housing of the image forming apparatus 100 (manually), a sheet is fed from the bypass sheet feeding device 8.

When the sheet P is conveyed to a sheet conveyance passage 80 that faces the image forming device 3, the image forming device 3 forms an image on the sheet P. To be more specific, the liquid discharge head 14 is controlled to discharge liquid (ink) according to image data of the original document read by the image reading device 2 or print data instructed to print by an external device, so that ink is discharged on the image forming surface (upper face) of the sheet P to form an image. Note that the image to be formed on the sheet P may be a meaningful image such as text or a figure, or a pattern having no meaning per se.

When duplex printing is performed, the sheet P is conveyed in the opposite direction opposite the sheet conveyance direction at a position downstream from the image forming device 3 in the sheet conveyance direction, so that the sheet P is guided to a sheet reverse passage 81. To be more specific, after the trailing end of the sheet P has passed a first passage changer 71 that is disposed downstream from the image forming device 3 in the sheet conveyance direction and before the sheet P is conveyed in the opposite direction, the first passage changer 71 changes the sheet conveyance passage to the sheet reverse passage 81. Since the sheet P is conveyed in the opposite direction in this state, the sheet P is guided to the sheet reverse passage 81. Then, the sheet P is conveyed to the image forming device 3 while the sheet P is reversed upside down and conveyed to the image forming device 3 again. Then, the image forming device 3 repeats the same operation performed to the front face of the sheet P, so as to form an image on the back face of the sheet P.

After the image is formed on the sheet P, a second passage changer 72 guides the sheet P selectively to a sheet conveyance passage 82 that runs toward the upper sheet ejecting device 6 or to a sheet conveyance passage 83 that runs to the lower sheet ejecting device 6. The second passage changer 72 is disposed downstream from the first passage changer 71 in the sheet conveyance direction. In a case in which the sheet P is guided to the sheet conveyance passage 82 toward the sheet ejecting device 6, the sheet P is ejected to the upper sheet ejection tray 20. On the other hand, when the sheet P is guided to the sheet conveyance passage 83 toward the lower sheet ejecting device 6, a third passage changer 73 guides the sheet P selectively to a sheet conveyance passage 84 toward the lower sheet ejecting device 6 or to a sheet conveyance passage 85 toward the sheet alignment apparatus 200.

In a case in which the sheet P is guided to the sheet conveyance passage 84 toward the sheet ejecting device 6, the sheet P is ejected to the lower sheet ejection tray 20 with the image forming surface down. Here, the image forming surface indicates a liquid applied face of the sheet P on which ink is applied. On the other hand, when the sheet P is guided to the sheet conveyance passage 85 toward the sheet alignment apparatus 200, the sheet P is conveyed to the sheet alignment apparatus 200, so that the bundle of sheets P is aligned and stacked. Accordingly, a series of printing operations is completed.

Figure 2:
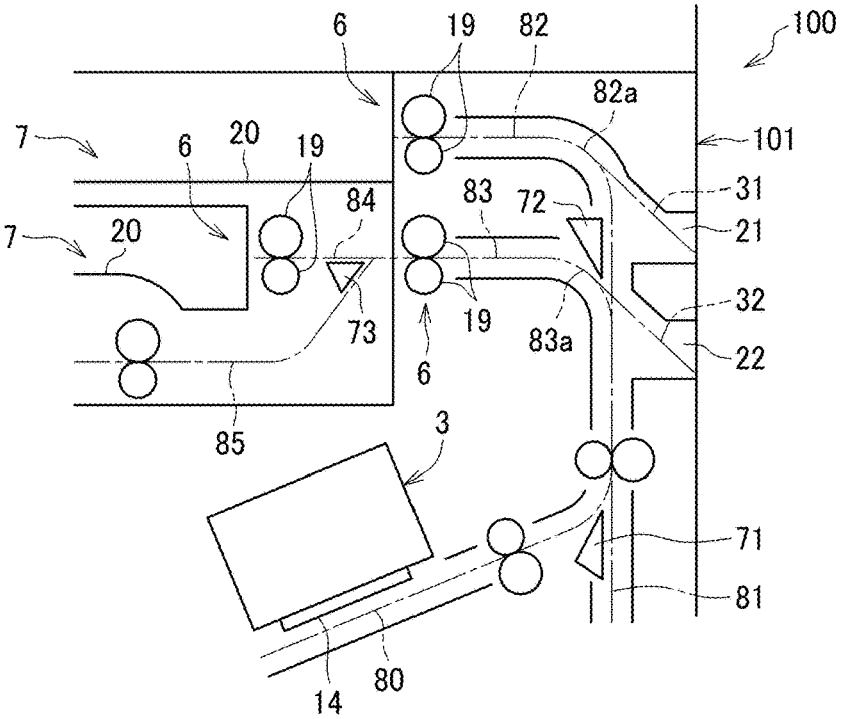
FIG. 2 is an enlarged view illustrating a part of the image forming apparatus of FIG. 1.

FIG. 2 is an enlarged view illustrating a part of the image forming apparatus according to the present embodiment.

As illustrated in FIG. 2, the image forming apparatus 100 according to the present embodiment includes a housing 101. The housing 101 of the image forming apparatus 100 is provided with two openings 21 and 22 each of which functioning as an opening to expose a sheet to the outside of the housing 101 of the image forming apparatus 100. Each of the openings 21 and 22 is a through hole formed in the extreme outside part (side face) of the housing 101. Further, the opening 21 is disposed near the sheet conveyance passage 82 to convey the sheet from the image forming device 3 to a corresponding sheet ejecting device 6. Similarly, the opening 22 is disposed near the sheet conveyance passage 83 to convey the sheet from the image forming device 3 to a corresponding sheet ejecting device 6. The housing 101 further includes a sheet exposure conveyance passage 31 to guide the sheet to the opening 21 and a sheet exposure conveyance passage 32 to guide the sheet to the opening 22. The sheet exposure conveyance passage 31 is a branch of the sheet conveyance passage 82, branching from the curved portion 82*a* of the sheet conveyance passage 82 or from a close position of the curved portion 82*a* of the sheet conveyance passage 82, toward the opening 21 (to the right direction in FIG. 2). Similarly, the sheet exposure conveyance passage 32 is a branch of the sheet conveyance passage 83, branching from the curved portion 83*a* of the sheet conveyance passage 83 or from a close position of the curved portion 83*a* of the sheet conveyance passage 83, toward the opening 22 (to the right direction in FIG. 2).

Next, a description is given of the sheet conveying operation of the sheet P.

FIGS. 3 to 9 are diagrams illustrating a sheet conveying operation performed in the image forming apparatus 100 of FIG. 2.

Figure 10:
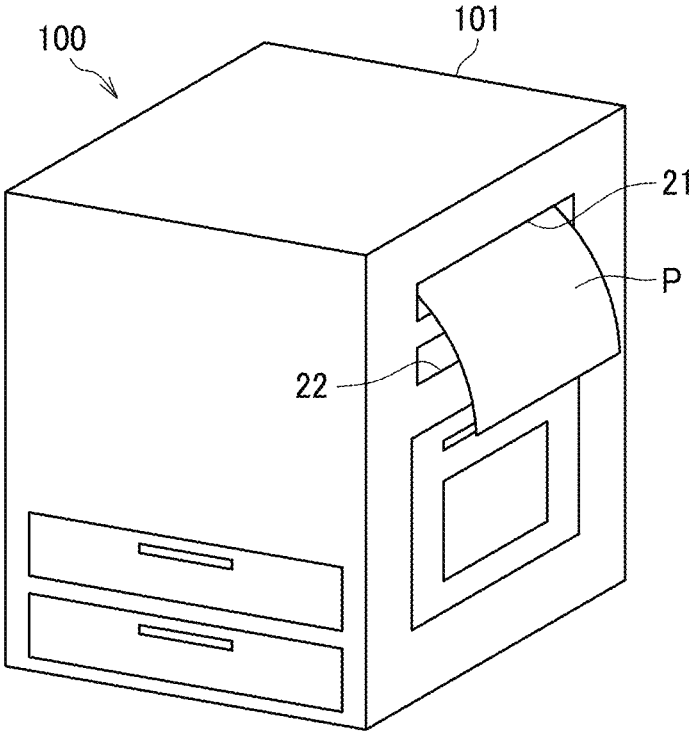
FIG. 10 is an external view illustrating the state in which a sheet is exposed out from the housing of the image forming apparatus.

FIG. 10 is an external view illustrating the state in which the sheet P is exposed out from the housing 101 of the image forming apparatus 100.

Figure 3:
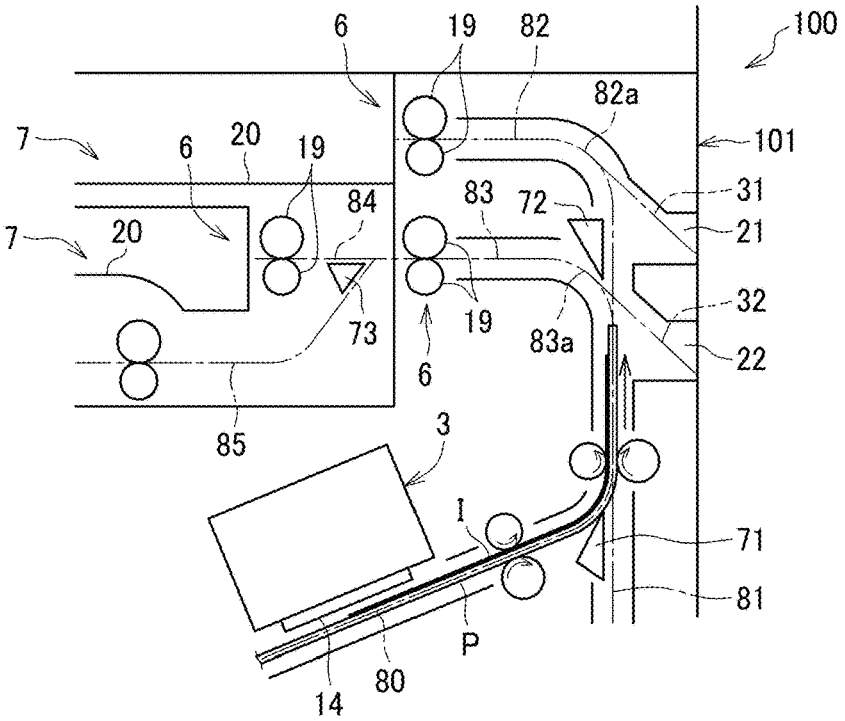
FIG. 3 is a diagram illustrating a sheet conveying operation performed in the image forming apparatus of FIG. 2.
Figure 4:
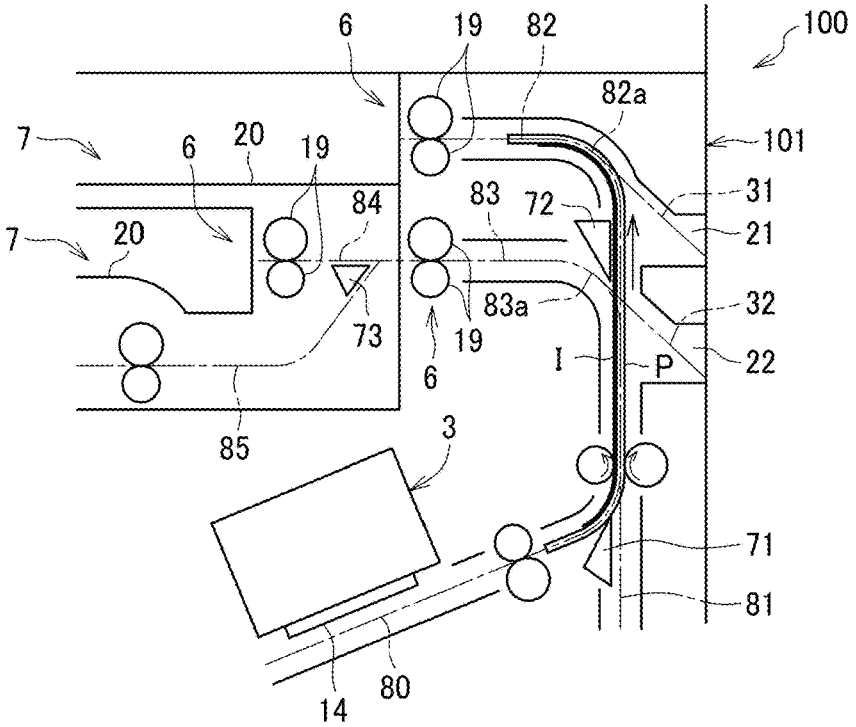
FIG. 4 is a diagram illustrating the sheet conveying operation subsequent from FIG. 3.
Figure 5:
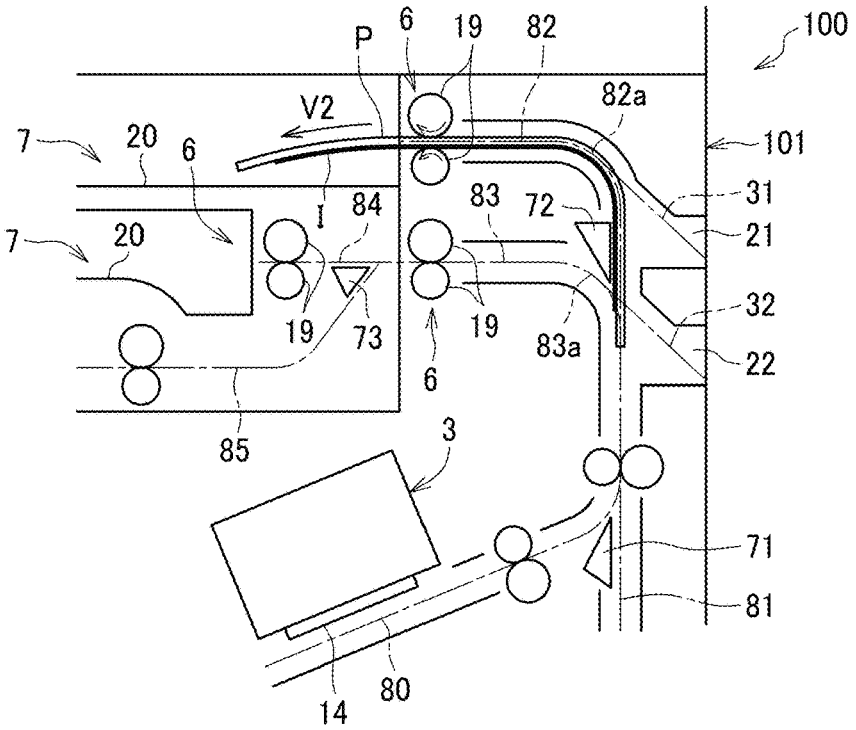
FIG. 5 is a diagram illustrating the sheet conveying operation subsequent from FIG. 4.

After the sheet P having an image formed on one side (in other words, having ink I is applied on one side) is conveyed from the image forming device 3 toward the sheet ejecting device 6, as illustrated in FIG. 3, the sheet P is selectively guided to one of the sheet ejecting devices 6 by the second passage changer 72 disposed between the image forming device 3 and each of the sheet ejecting devices 6, as illustrated in FIG. 4. In FIG. 4, the sheet P is guided to the upper sheet ejecting device 6. However, the sheet P may be guided to the lower sheet ejecting device 6. Then, as illustrated in FIG. 5, the sheet P that has been guided to the sheet ejecting device 6 is conveyed to the sheet ejection tray 20 by the pair of sheet ejection rollers 19 that rotates (in the normal direction).

Figure 6:
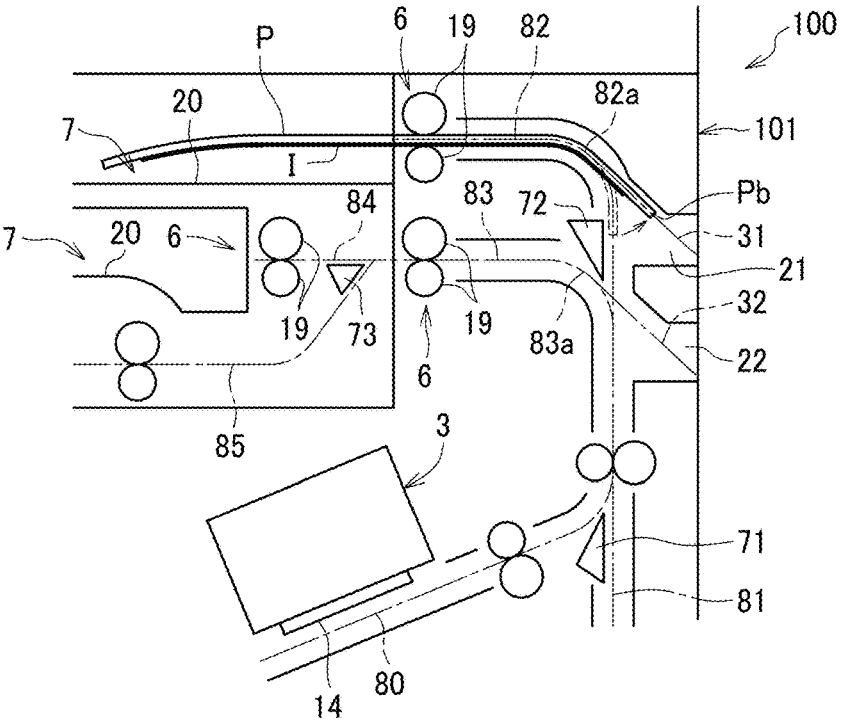
FIG. 6 is a diagram illustrating the sheet conveying operation subsequent from FIG. 5.

Then, as illustrated in FIG. 6, the pair of sheet ejection rollers 19 stops conveyance of the sheet P temporarily at the timing at which the trailing end Pb of the sheet P conveyed by the pair of sheet ejection rollers 19 reaches the branching point of the upper sheet exposure conveyance passage 31 or near the branching point of the upper sheet exposure conveyance passage 31. Further, at this time, the trailing end Pb of the sheet P faces the sheet exposure conveyance passage 31 due to the resilience that the warped sheet P is to return to a flat sheet P.

Figure 7:
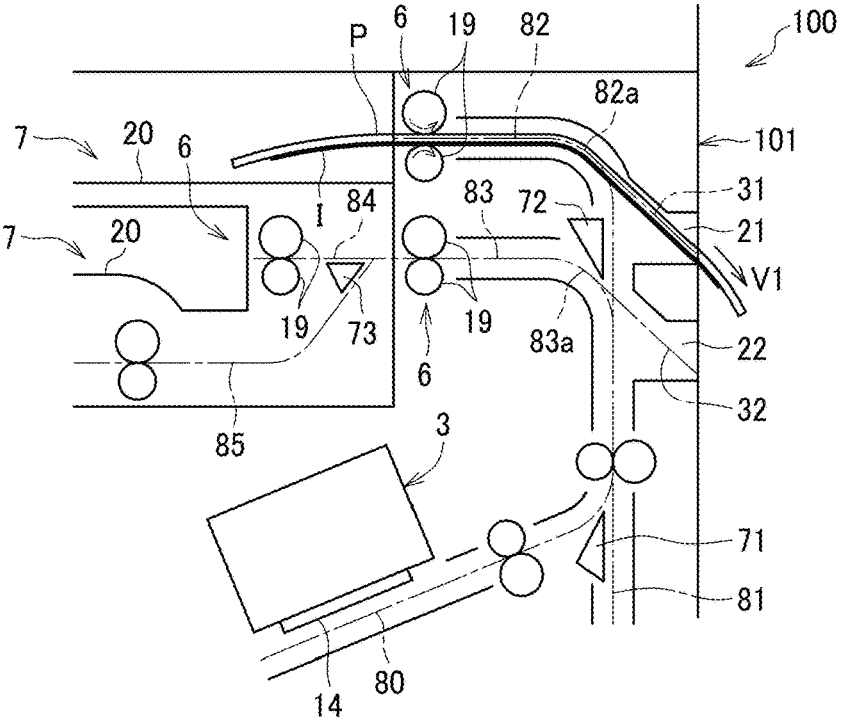
FIG. 7 is a diagram illustrating the sheet conveying operation subsequent from FIG. 6.
Figure 8:
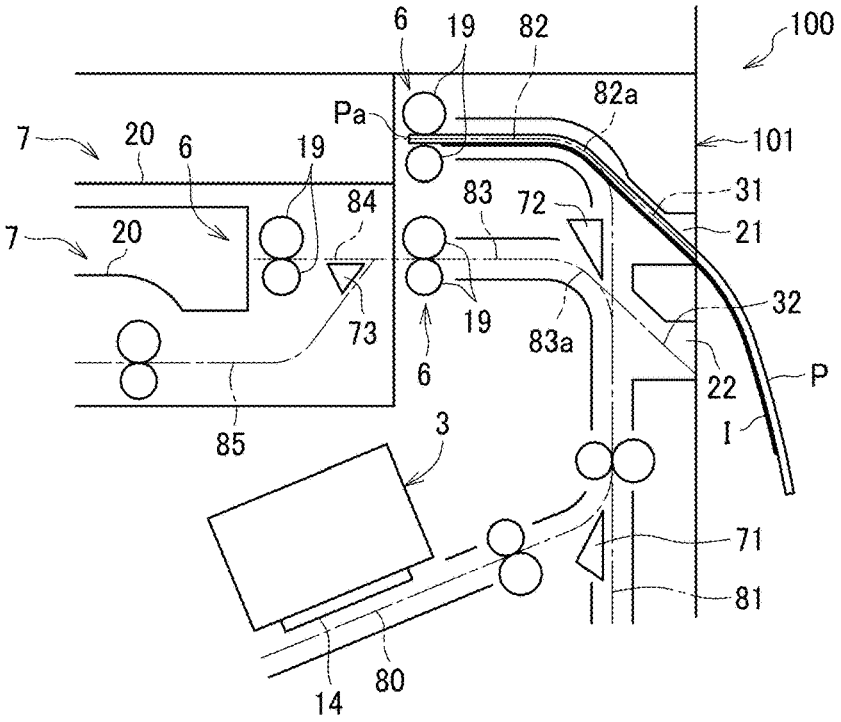
FIG. 8 is a diagram illustrating the sheet conveying operation subsequent from FIG. 7.

Then, while the trailing end Pb of the sheet P faces the sheet exposure conveyance passage 31, the pair of sheet ejection rollers 19 rotates in the opposite direction (reverse direction), as illustrated in FIG. 7. By so doing, the sheet P is conveyed in the opposite direction. Accordingly, the sheet P is guided to the upper sheet exposure conveyance passage 31, so that the sheet P is exposed via the upper opening 21 to the outside of the housing 101 of the image forming apparatus 100. Further, as illustrated in FIG. 8, the pair of sheet ejection rollers 19 stops conveyance of the sheet P temporarily before or immediately before the timing at which the leading end Pa of the sheet P (that is, the trailing end of the sheet P when the sheet P is conveyed in the opposite direction) passes through the nip region of the pair of sheet ejection rollers 19. Accordingly, while being exposed via the upper opening 21, the sheet P is held by the pair of sheet ejection rollers 19. The external view in this state is illustrated in FIG. 10.

Thus, the sheet P is exposed to the outside of the image forming apparatus 100 in the outside air, and therefore water (moisture) evaporated from the ink I is scattered around easily. On the other hand, in a case in which the sheet P is ejected to the sheet ejection tray 20 without exposing the sheet P via the opening 21 to the outside of the image forming apparatus 100, it is likely that the other sheets P in the sheet ejection tray 20 become moist due to water (moisture) evaporated from ink or the ink is not dried easily. In particular, in the in-body sheet ejection configuration as the present embodiment, when the sheet P that is moist with ink is ejected to the sheet ejection tray 20, water is hindered from scattering by the image reading device 2 that surrounds the upper space of the sheet ejection tray 20 and the pillars of the housing that support the image reading device 2 and the water (moisture) evaporated from the sheet P floats above the sheet ejection tray 20. This hinderance makes it more difficult to dry the ink from the sheet P. Therefore, as in the image forming apparatus 100 according to the present embodiment, before the sheet P is ejected to the sheet ejection tray 20, the sheet p is conveyed in the opposite direction temporarily and then exposed form the image forming apparatus 100 to the outside of the image forming apparatus 100. By so doing, water (moisture) evaporated from the ink becomes difficult to stay or float around the sheet P. Accordingly, the ink I on the sheet P is dried effectively. In addition, the other sheets P on the sheet ejection tray 20 do not become moist due to water (moisture) evaporated from the ink.

Figure 9:
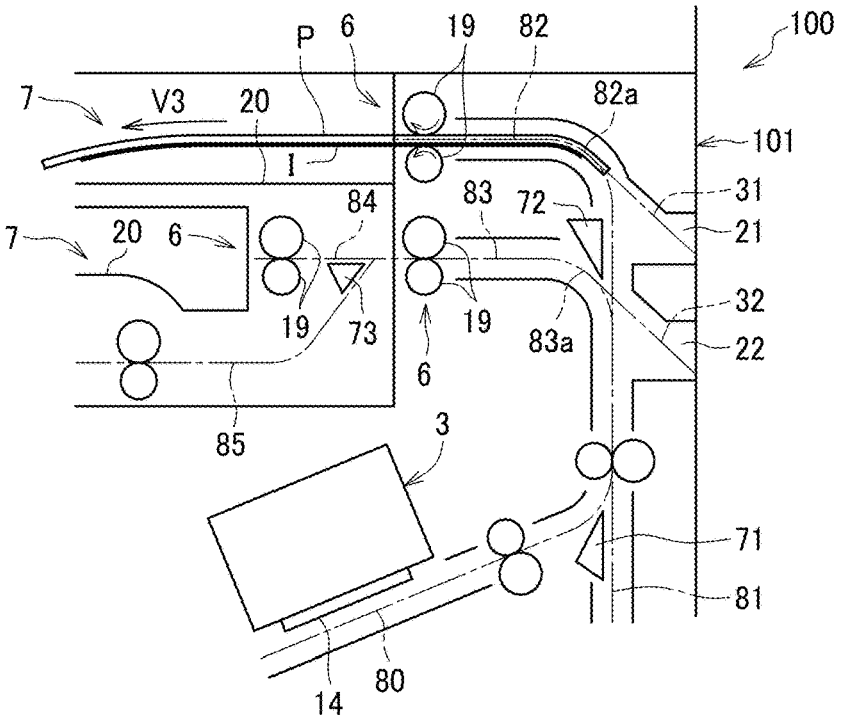
FIG. 9 is a diagram illustrating the sheet conveying operation subsequent from FIG. 8.

After the sheet P is exposed via the opening 21 to the outside of the image forming apparatus 100 as described above, the pair of sheet ejection rollers 19 is further rotated in the opposite direction (normal direction), as illustrated in FIG. 9. Then, the sheet P is ejected to the sheet ejection tray 20. Note that the time from when the sheet P is exposed to the outside of the image forming apparatus 100 to when conveyance of the sheet P to the sheet ejection tray 20 is started (i.e., the time while the sheet P is exposed to the outside) may be set accordingly, after consideration of the drying time of the ink.

Further, it is preferable that, when the sheet P is first conveyed toward the sheet ejection tray 20, the position at which conveyance of the sheet P is stopped temporarily (i.e., the sheet stop position in FIG. 6) is, for example, within the range from the branching point of the sheet exposure conveyance passage 31, to the position at which the trailing end Pb of the sheet P has passed the branching point by 10 mm downstream in the sheet conveyance direction. By contrast, in a case in which conveyance of the sheet P is stopped at a position at which the trailing end Pb of the sheet P has passed farther downstream from the branching point of the sheet exposure conveyance passage 31, the distance of conveyance of the sheet P becomes longer from when the sheet P is conveyed in the opposite direction to when the sheet P is exposed via the opening 21 to the outside of the image forming apparatus 100, and therefore the time to convey and eject the sheet P to the sheet ejection tray 20 eventually increases. Accordingly, as described above, the stop timing of conveyance of the sheet P is set to the timing at which the trailing end Pb of the sheet P reaches the branching point of the sheet exposure conveyance passage 31 or a position near the branching point. By so doing, the distance of conveyance of the sheet P thereafter is decreased (shortened) and the productivity of the image forming apparatus 100 is enhanced.

Further, the conveying speed of the sheet P may not be constant. For example, a conveying speed V1 (see FIG. 7) at which the sheet P is stopped conveyed to the opening 21 after conveyance of the sheet P to the sheet ejection tray 20 is stopped may be slower (e.g., by 50%) than conveying speeds V2 and V3 (see FIGS. 5 and 9) at each of which the sheet P is firstly or lastly conveyed to the sheet ejection tray 20. In this case, the drying time of the ink on the sheet P when the sheet P is exposed via the opening 21 is provided and the sheet P is guided to the opening 21 reliably. On the other hand, the conveying speeds V2 and V3 at each of which the sheet P is conveyed toward the sheet ejection tray 20 are faster than the conveying speed V1 at which the sheet P is conveyed to the opening 21, thereby decreasing the time until the sheet P is ejected to the sheet ejection tray 20 and enhancing the productivity of the image forming apparatus 100.

In the above-described example, the sheet P is guided to the upper sheet ejecting device 6. However, in a case in which the sheet P is guided to the lower sheet ejecting device 6, the sheet P may be exposed to the outside of the housing of the image forming apparatus 100 in the same manner. That is, after the pair of sheet ejection rollers 19 is rotated in the opposite direction to guide the sheet P to the sheet exposure conveyance passage 32 and the sheet P is exposed via the lower opening 22 to the outside of the image forming apparatus 100, the pair of sheet ejection rollers 19 is further rotated in the opposite direction to eject the sheet P to the lower sheet ejection tray 20. Further, when performing the duplex printing, the sheet P having an image formed on one face (front face) is conveyed to pass the sheet reverse passage 81 and then conveyed to the image forming device 3 again. Then, in the same manner as the sheet P having an image formed on the one face (front face), the sheet P may be exposed to the outside of the housing of the image forming apparatus 100 and then be conveyed to the sheet ejection tray 20.

Further, in the above-described example, after the sheet P is ejected to the sheet ejection tray 20, the sheet P is switched back to be guided toward the upper sheet exposure conveyance passage 31 or the lower sheet exposure conveyance passage 32. However, after the sheet P is ejected to the sheet conveyance passage 85, the sheet P may be switched back to be guided toward the upper sheet exposure conveyance passage 31 or the lower sheet exposure conveyance passage 32.

Further, in the above-described example, after the sheet P is ejected to the outside of the housing of the image forming apparatus 100, the sheet P is ejected to the sheet ejection tray 20. However, after the sheet P is exposed to the outside of the housing of the image forming apparatus 100, the sheet P may be conveyed to the sheet conveyance passage 85 and be guided to the sheet alignment apparatus 200.

The size of each of the openings 21 and 22 may be large enough to pass at least one sheet P so as to expose the sheet P to the outside of the housing of the image forming apparatus 100. Further, each of the openings 21 and 22 may function as a discharge port through which water (moisture) evaporated from the sheet P in the housing 101 is discharged to the outside of the image forming apparatus 100. In this case, it is preferable that the width of opening in the sheet thickness direction of each of the openings 21 and 22 is sufficiently larger than the thickness of one sheet. In addition, there are two openings (i.e., the openings 21 and 22) are provided in the present embodiment to expose the sheet P to the outside of the image forming apparatus 100. However, another configuration in which a single opening, that is, one of the openings 21 and 22 is provided may be applied to the present disclosure.

Further, the operation to expose the sheet P to the outside of the housing of the image forming apparatus 100 may be selectively determined based on the amount of ink applied to the sheet P.

Figure 11:
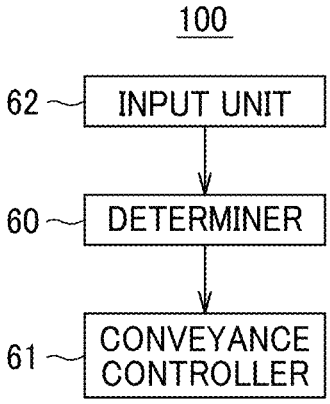
FIG. 11 is a block diagram illustrating a control system that controls the sheet conveying operation based on the amount of ink.

FIG. 11 is a block diagram illustrating a control system that controls the sheet conveying operation based on the amount of ink.

As illustrated in FIG. 11, the image forming apparatus 100 further includes a determiner 60 and a sheet conveying operation controller 61. The determiner 60 functions as a controller (circuitry) to control the sheet conveying operation and determines whether or not to perform an operation to expose a sheet to the outside of the image forming apparatus 100. The sheet conveying operation controller 61 functions as a controller (circuitry) to control the operations of various pairs of sheet conveying rollers including the pair of sheet ejection rollers 19. The determiner 60 determines whether or not to perform an operation to expose a sheet to the outside of the image forming apparatus 100, based on image information that is input via the image reading device 2 or an input unit 62 or another terminal device different from the image forming apparatus 100. To be more specific, the determiner 60 calculates the image area rate of an image formed on the sheet based on the image information and determines whether or not to perform an operation to expose a sheet to the outside of the image forming apparatus 100 based on the calculate image area rate. That is, since the amount of ink applied to the sheet changes according to the image area rate of the image, the amount of ink applied to the sheet here is substituted by the image area rate. Further, the information input via the input unit 62 may include not only image information but also mode information selected from image formation modes having different resolutions from each other. Further, in addition to the image information, the amount of ink applied to a sheet may be specified based on the total amount of ink discharged from the liquid discharge head 14 of the image forming device 3. The sheet conveying operation controller 61 controls the rotation start timing and the rotation stop timing, rotational direction, and rotational speed of each of various pairs of sheet conveying rollers, based on the determination result of the determiner 60.

Figure 12:
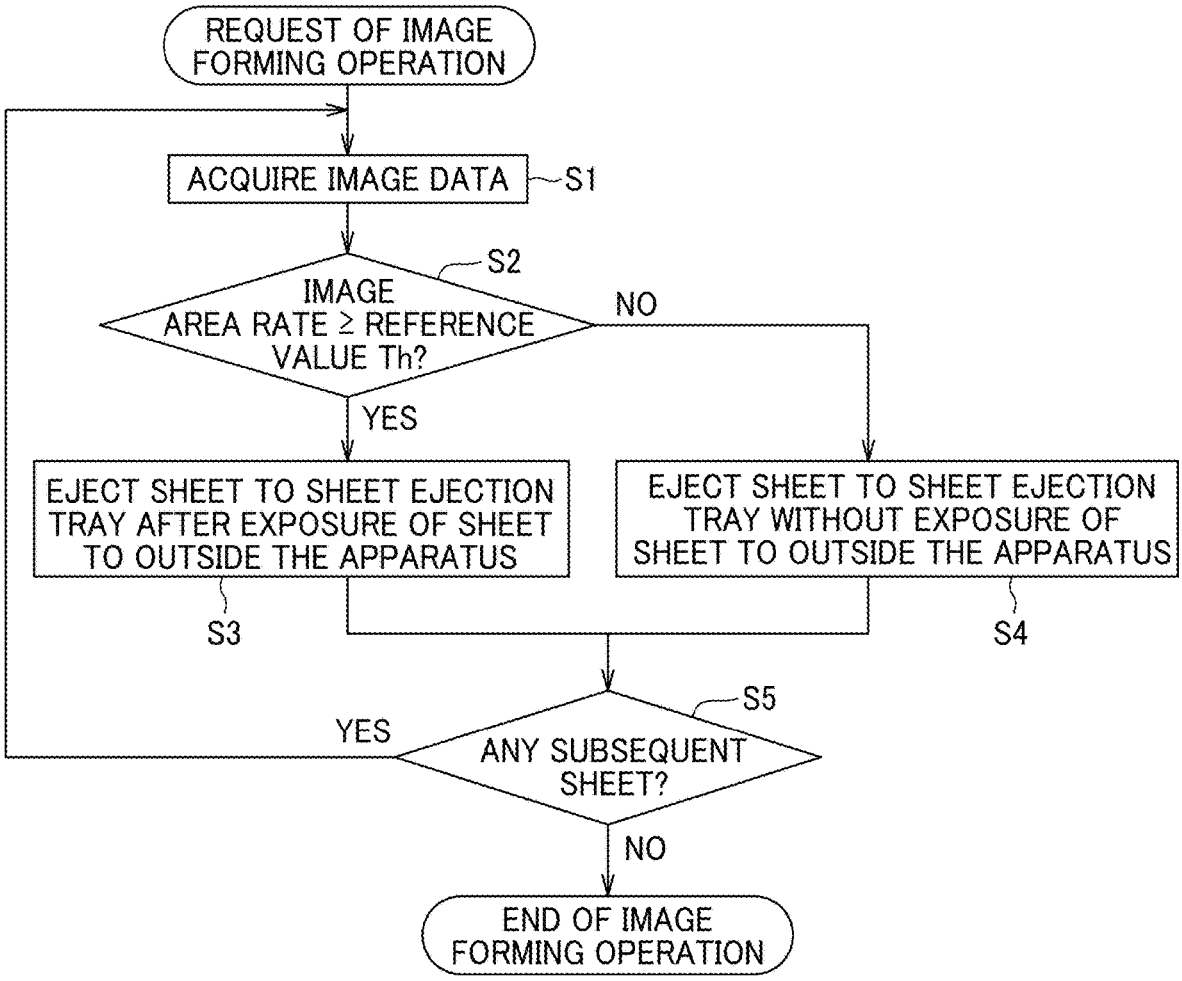
FIG. 12 is a flowchart illustrating a control flow of the sheet conveying operation.

Next, a description is given of the control flow of the of the sheet conveying operation, with reference to FIG. 12.

FIG. 12 is a flowchart illustrating the control flow of the sheet conveying operation.

As illustrated in FIG. 12, as an image formation command is issued to start the image forming operation, the determiner 60 acquires image information from the input unit 62 (step S1 in the flowchart of FIG. 12). Then, the determiner 60 calculates the image area rate based on the acquired image information, and determines whether or not the image area rate of the image acquired from the image information is equal to or greater than a reference value Th (step S2 in the flowchart of FIG. 12).

As a result, when the image area rate is equal to or greater than the reference value Th (YES in Step 2 in the flowchart of FIG. 12), it is determined that the amount of ink applied to the sheet is relatively large and the sheet may need to be exposed to the outside of the housing of the image forming apparatus 100 to dry the ink applied to the sheet. Therefore, the sheet is exposed to the outside of the housing of the image forming apparatus 100, and then is ejected to the sheet ejection tray 20 (step S3 in the flowchart of FIG. 12). At this time, after the sheet is temporarily exposed to the outside of the housing of the image forming apparatus 100, the sheet conveying operation controller 61 controls the operation performed by various pairs of sheet conveying rollers to expose the sheet to the sheet ejection tray 20. Note that, since the specific sheet conveying operations and the specific sheet conveyance passages are described above, with reference to FIGS. 3 to 9, the detailed description is omitted here.

By contrast, when the image area rate is smaller than the reference value Th (NO in Step 2 in the flowchart of FIG. 12), it is determined that the amount of ink applied to the sheet is large and the sheet does not need to be exposed to the outside of the housing of the image forming apparatus 100 to dry the ink applied to the sheet. Therefore, the sheet is ejected to the sheet ejection tray 20 without exposing the sheet P to the outside of the housing of the image forming apparatus 100 (step S4 in the flowchart of FIG. 12).

Then, it is determined whether or not there is any sheet to be conveyed subsequent to the sheet (step S5 in the flowchart of FIG. 12). When there is a sheet to be conveyed subsequent to the sheet (YES in step S5 in the flowchart of FIG. 12), step S5 is repeated until it is determined that there is no subsequent sheet to be conveyed. On the other hand, when there is no sheet to be conveyed subsequent to the sheet (NO in step S5 in the flowchart of FIG. 12), the image forming operation ends.

By determining whether or not to perform the operation to expose the sheet P to the outside of the housing of the image forming apparatus 100 based on the image area rate, the sheet is exposed to the outside of the housing of the image forming apparatus 100 only when the ink on the sheet needs to be dried. Accordingly, when the amount of ink applied to the sheet is relatively large, the sheet is exposed to the outside of the housing of the image forming apparatus 100 to dry the ink on the sheet effectively. By contrast, when the amount of ink applied to the sheet is relatively small, the sheet is conveyed to the sheet ejection tray 20 without being exposed to the outside of the housing of the image forming apparatus 100, thereby enhancing the productivity of the image forming apparatus 100.

Further, the time to expose the sheet to the outside of the housing of the image forming apparatus 100 may be changed based on the amount of ink applied to the sheet. For example, the time to expose the sheet to the outside of the housing of the image forming apparatus 100 is longer when the image area rate is equal to or greater than the reference value that is previously set, than when the image area rate is smaller than the reference value. By so doing, the ink on the sheet is dried more effectively.

Next, a description is given of the image forming apparatus according to another embodiment different from the image forming apparatus according to the above-described embodiment, that is, Embodiment 1 of the present disclosure.

Note that the following description is given of the configuration of the image forming apparatus 100 according to another embodiment, that is, Embodiment 2, different from the configuration of the image forming apparatus 100 according to the above-described embodiment, that is, Embodiment 1. The description of the configuration of the image forming apparatus 100 according to Embodiment 2 that is same as the configuration of the image forming apparatus 100 according to Embodiment 1 may be omitted.

Figure 13:
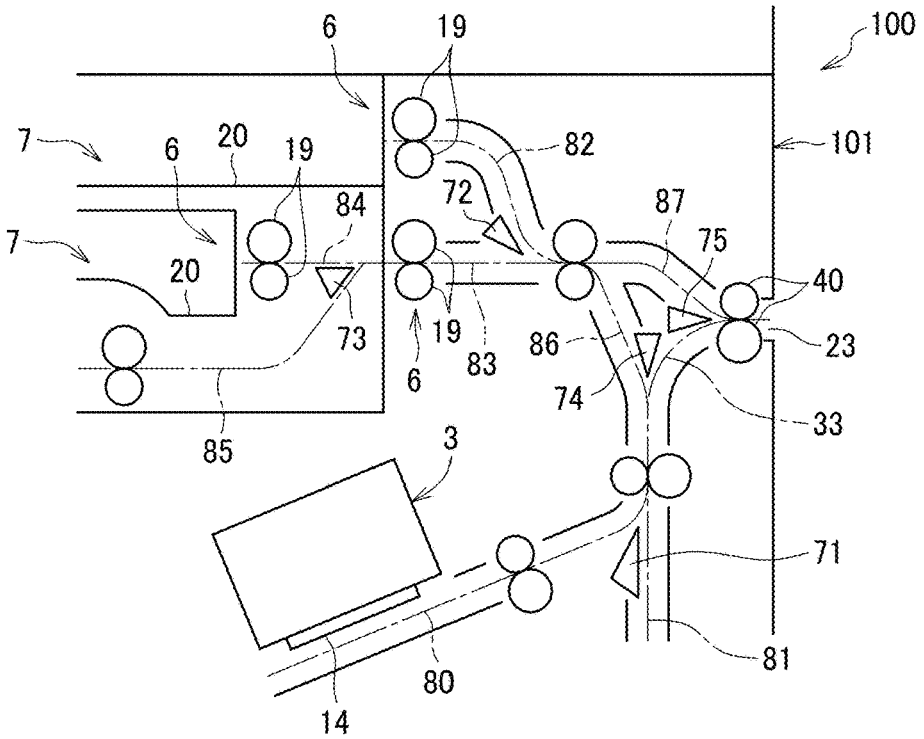
FIG. 13 is an enlarged view illustrating a part of the image forming apparatus according to Embodiment 2 of the present disclosure.

FIG. 13 is an enlarged view illustrating a part of the image forming apparatus 100 according to Embodiment 2 of the present disclosure.

The image forming apparatus 100 according to Embodiment 2 has different sheet conveyance passages to expose the sheet to the outside of the housing of the image forming apparatus 100, which is different from the image forming apparatus 100 according to Embodiment 1. To be more specific, as illustrated in FIG. 13, the image forming apparatus 100 according to Embodiment 2 includes a sheet ejection conveyance passage 86, a sheet exposure conveyance passage 33, and a merged sheet conveyance passage 87. The sheet ejection conveyance passage 86 is a passage to convey the sheet to the sheet ejecting device 6 without exposing the sheet to the outside of the image forming apparatus 100. The sheet exposure conveyance passage 33 is a passage branched from the sheet ejection conveyance passage 86. The merged sheet conveyance passage 87 is a passage branched from the sheet exposure conveyance passage 33 and merged to the sheet ejection conveyance passage 86. The merged sheet conveyance passage 87 branches from the sheet exposure conveyance passage 33 at or near the downstream end of the sheet exposure conveyance passage 33 in the sheet conveying direction and merges in the sheet ejection conveyance passage 86 at the position downstream from the branching point of the sheet exposure conveyance passage 33 in the sheet conveyance direction, at which the sheet exposure conveyance passage 33 branches from the sheet ejection conveyance passage 86, in the sheet conveying direction.

Further, a fourth passage changer 74 is disposed at a branching point of the sheet exposure conveyance passage 33, at which the sheet exposure conveyance passage 33 branches from the sheet ejection conveyance passage 86 to change the sheet conveyance passage. Similarly, a fifth passage changer 75 is disposed at a branching point of the merged sheet conveyance passage 87, at which the merged sheet conveyance passage 87 branches from the sheet exposure conveyance passage 33 to change the sheet conveyance passage. Further, a pair of sheet conveying rollers 40 is disposed at the downstream end of the sheet exposure conveyance passage 33 in the sheet conveyance direction. The pair of sheet conveying rollers 40 functions as a sheet conveyor to convey a sheet.

FIGS. 14 to 17 are diagrams illustrating a sheet conveying operation performed in the image forming apparatus 100 according to Embodiment 2.

Figure 14:
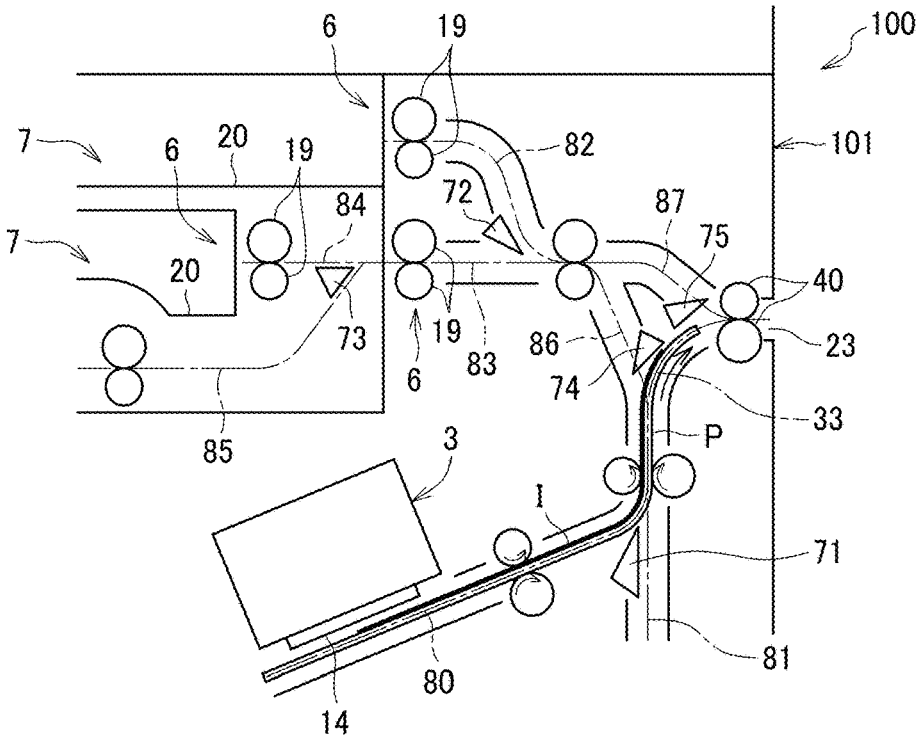
FIG. 14 is a diagram illustrating a sheet conveying operation performed in the image forming apparatus according to Embodiment 2.
Figure 15:
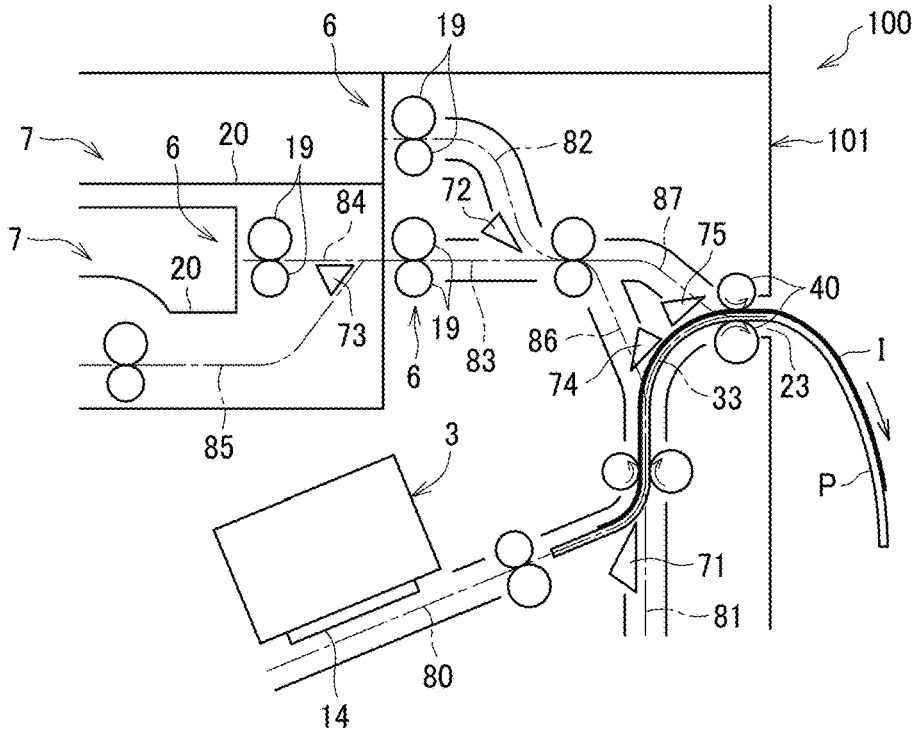
FIG. 15 is a diagram illustrating the sheet conveying operation subsequent from FIG. 14.
Figure 16:
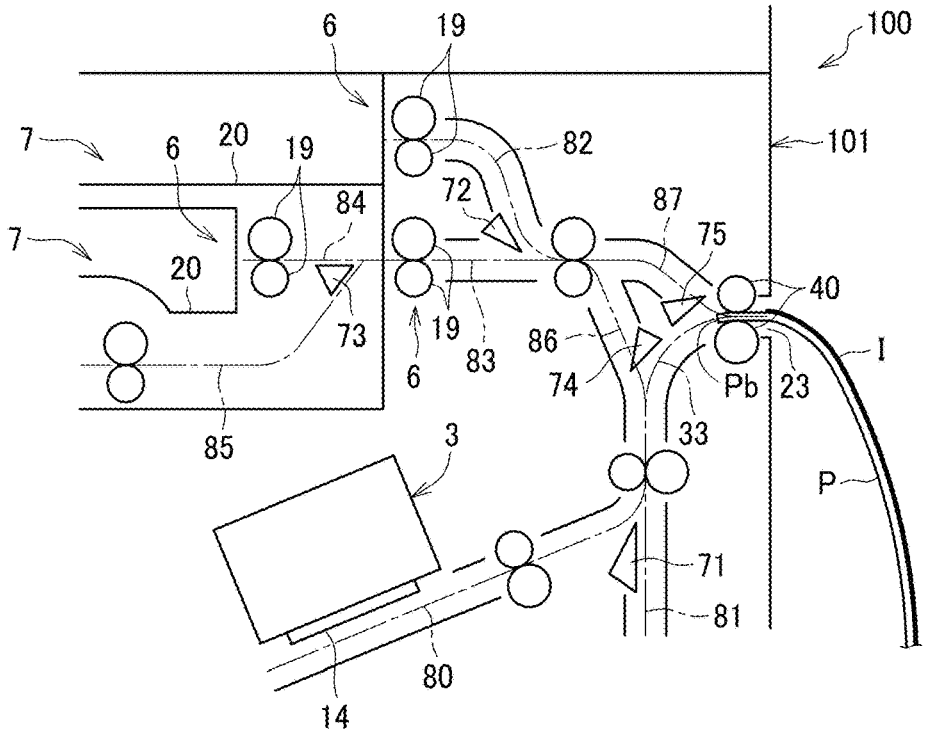
FIG. 16 is a diagram illustrating the sheet conveying operation subsequent from FIG. 15.

In the image forming apparatus 100 according to Embodiment 2, in order to expose the sheet P having an image to the outside of the housing of the image forming apparatus 100, the fourth passage changer 74 changes the sheet conveyance passage to the sheet exposure conveyance passage 33 as illustrated in FIG. 14, so that the sheet P is guided to the sheet exposure conveyance passage 33. Further, as illustrated in FIG. 15, as the pair of sheet conveying rollers 40 that is disposed at the downstream end of the sheet exposure conveyance passage 33 in the sheet conveyance direction rotates in the sheet conveyance direction (normal rotation), the sheet P is conveyed to be exposed via the opening 23 to the outside of the housing 101 of the image forming apparatus 100. Then, as illustrated in FIG. 16, rotation of the pair of sheet conveying rollers 40 is stopped before or immediately before the trailing end Pb of the sheet P passes through the nip region of the pair of sheet conveying rollers 40. Accordingly, while being exposed via the opening 23 to the outside of the image forming apparatus 100, the sheet P is held by the pair of sheet conveying rollers 40.

Figure 17:
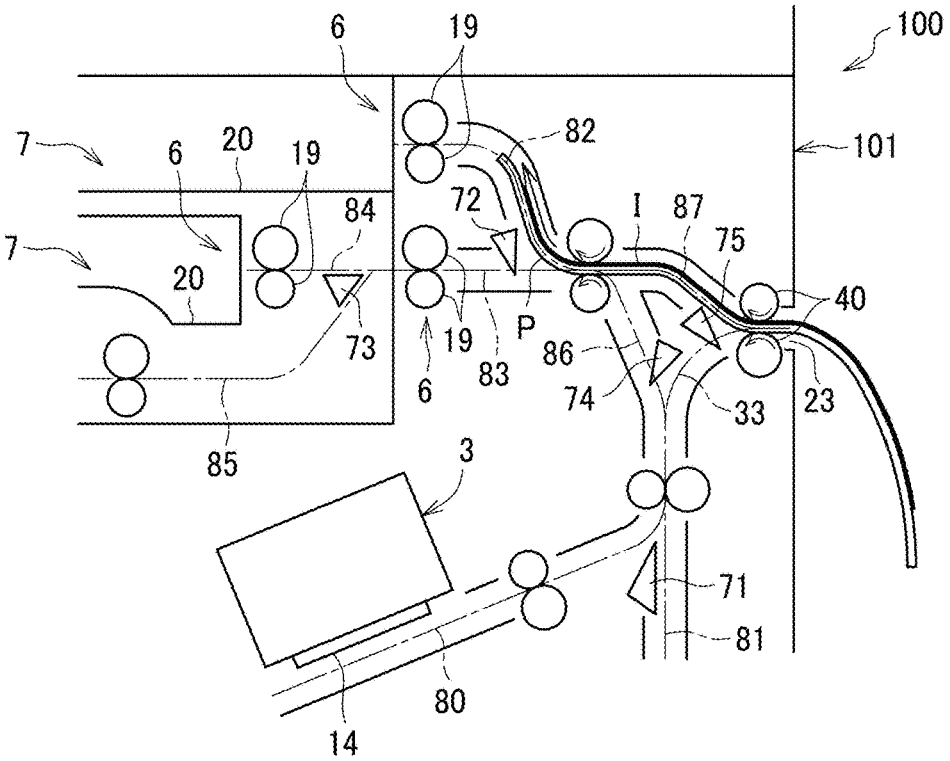
FIG. 17 is a diagram illustrating the sheet conveying operation subsequent from FIG. 16.

Thereafter, as illustrated in FIG. 17, the fifth passage changer 75 changes the sheet conveyance passage to the merged sheet conveyance passage 87, and the pair of sheet conveying rollers 40 rotates in the opposite direction (reverse rotation) in this state. By so doing, the sheet P is conveyed to the sheet ejecting device 6 via the merged sheet conveyance passage 87, the sheet ejection conveyance passage 86, and the sheet conveyance passage 82. In FIG. 17, the sheet P is conveyed to the upper sheet ejecting device 6. However, the sheet P may be conveyed to the lower sheet ejecting device 6. Thereafter, the sheet P is conveyed and ejected to the sheet ejection tray 20 by the pair of sheet ejection rollers 19.

As described above, in the image forming apparatus 100 according to Embodiment 2, the sheet P is exposed to the outside of the image forming apparatus 100 before the sheet P is ejected to the sheet ejection tray 20. By so doing, the ink I on the sheet P is dried effectively. Note that the example illustrated in FIGS. 14 to 17 describes that the sheet P having an image on one face alone is conveyed. However, the sheet P having images on both faces in the duplex printing may be conveyed in the same sheet conveyance passages. In addition, different from the image forming apparatus 100 according to Embodiment 1, the sheet P is conveyed to the sheet ejection tray 20 with the face-up method in the image forming apparatus 100 according to Embodiment 2. In other words, in Embodiment 2, the sheet P is ejected with the image forming surface (i.e., the liquid applied face on which the ink I is applied) of the sheet P in the single-side printing facing up. On the other hand, the image forming apparatus 100 according to Embodiment 1 employs the face-down method, in which the sheet P is ejected with the image forming surface of the sheet P facing down (see FIG. 9). In a case in which the sheet P is ejected to the sheet ejection tray 20 with the image forming surface facing up, as in Embodiment 2, the order of image formation may be reversed, in other words, the latter page may be printed first, so as to correctly sort the page numbers of the sheets P that are continuously printed.

Further, as in the image forming apparatus 100 according to Embodiment 1, the image forming apparatus 100 according to Embodiment 2 may be capable of selectively determining whether or not to perform the operation in which the sheet P is exposed to the outside of the housing of the image forming apparatus 100 based on the amount of ink applied to the sheet P (e.g., the image area rate) or changing the time in which the sheet P is exposed to the outside of the housing of the image forming apparatus 100.

Figure 18:
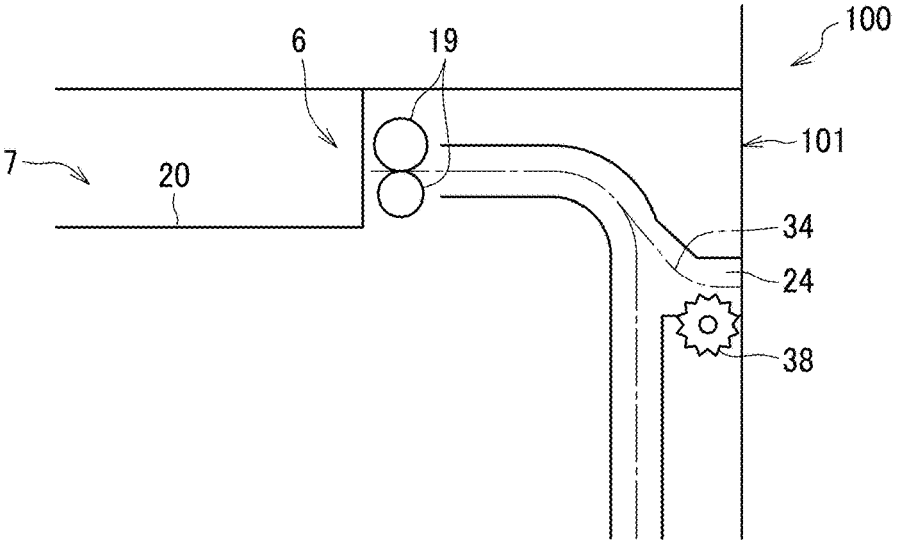
FIG. 18 is an enlarged view illustrating a part of the image forming apparatus according to Embodiment 3 of the present disclosure.

FIG. 18 is an enlarged view illustrating a part of the image forming apparatus 100 according to Embodiment 3 of the present disclosure.

In Embodiment 3 illustrated in FIG. 18, the image forming apparatus 100 further includes a spur wheel 38 at the edge of the lower side of the opening 24 via which the sheet is exposed to the outside of the housing of the image forming apparatus 100. The spur wheel 38 is a projecting rotator having a plurality of projections projecting radially outward and is rotatably provided at the edge of the lower side of the opening 24.

Figure 19:
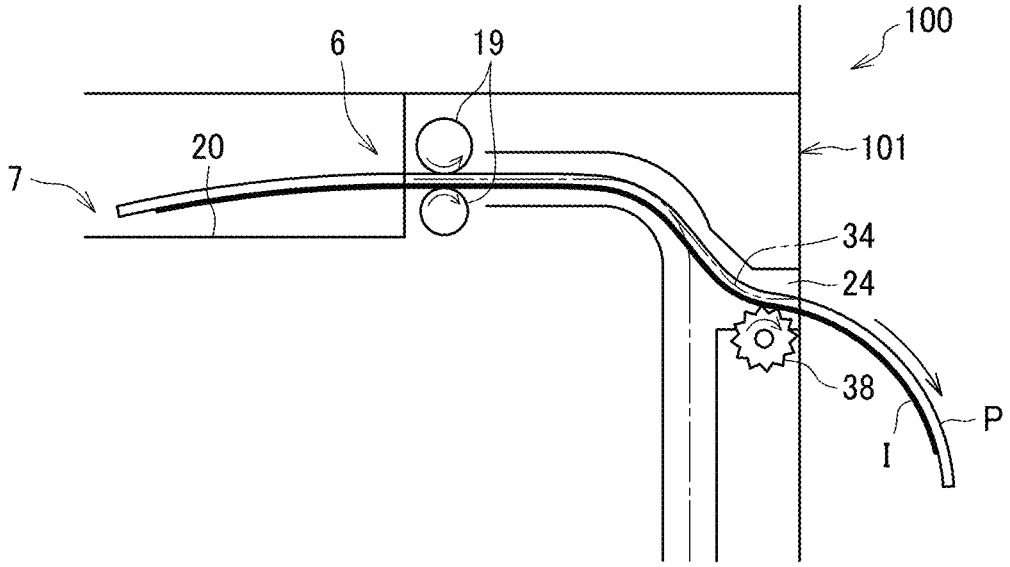
FIG. 19 is a diagram illustrating a sheet conveying operation performed in the image forming apparatus according to Embodiment 3.
Figure 20:
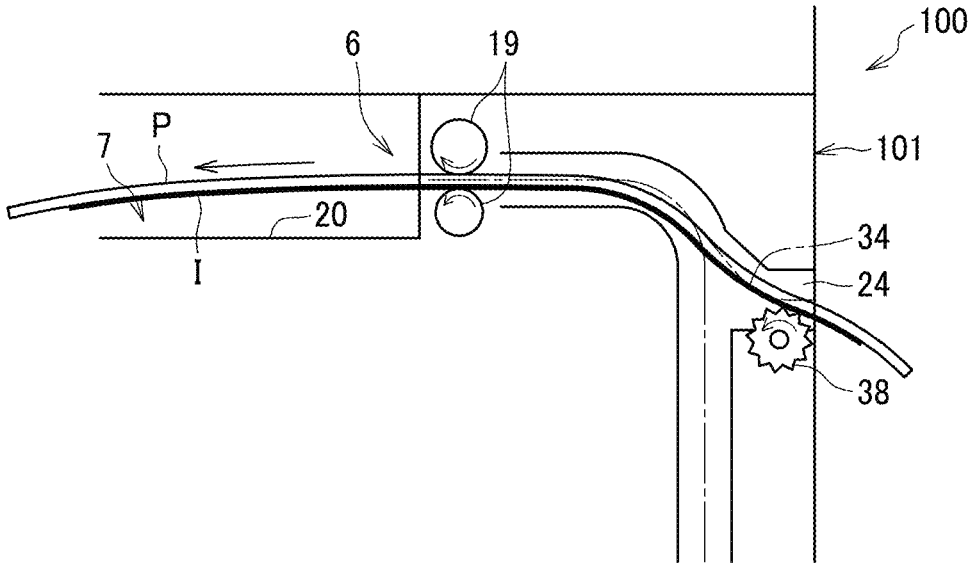
FIG. 20 is a diagram illustrating the sheet conveying operation subsequent from FIG. 19.

FIGS. 19 and 20 are diagrams each illustrating a sheet conveying operation performed in the image forming apparatus 100 according to Embodiment 3.

As described above, since the image forming apparatus according to Embodiment 3 includes the spur wheel 38 that is rotatably disposed to the opening 24, when the sheet P is conveyed to the opening 24 via the sheet exposure conveyance passage 34, as illustrated in FIG. 19, the sheet P contacts the spur wheel 38. Accordingly, the sheet P is guided to the opening 24 by the spur wheel 38 while the spur wheel 38 is rotating. At this time, even if the spur wheel 38 contacts the image forming surface (i.e., the liquid applied face on which the ink I is applied) of the sheet P, since the contact area of the spur wheel 38 with the sheet P is smaller than the contact area of a general sheet conveying roller with the sheet P, distortion of ink on the sheet P caused by contact of the spur wheel 38 to the sheet P is reduced. Further, since the sheet P contacts the spur wheel 38, the image forming surface of the sheet P is prevented from rubbing the edge of the opening 24, thereby reducing distortion of ink caused by rubbing the edge of the opening 24 and adhesion of ink to the edge of the opening 24. Thereafter, as illustrated in FIG. 20, the sheet P is also guided by the spur wheel 38 when the sheet P is conveyed to the sheet ejecting device 6, thereby reducing distortion of ink. As described above, the spur wheel 38 is rotated along movement of the sheet P by contacting the sheet P. In addition to rotation along movement of the sheet P, the spur wheel 38 may be rotated by a driving force from a drive source such as a motor.

Further, the spur wheel 38 described above may be provided to each of the openings 21 and 22 illustrated in FIG. 2 (Embodiment 1) or the opening 23 illustrated in FIG. 13 (Embodiment 2). In the configuration of FIG. 2 according to Embodiment 1, when the sheet P with an image is conveyed in a direction to be exposed to the outside of the image forming apparatus 100 (see FIG. 7) or when the sheet P is then conveyed to the sheet ejecting device 6 (see FIG. 9), the sheet P is conveyed with the image forming surface facing down. Therefore, by providing the spur wheel 38 at the edge below each of the openings 21 and 22, distortion of ink is reduced as in the configuration according to Embodiment 3. In the configuration of FIG. 13 according to Embodiment 2, when performing the duplex printing, one of the image forming surfaces of the sheet P faces down. Therefore, by providing the spur wheel 38 at the edge below the opening 23, distortion of ink is reduced as in the configuration according to Embodiment 3.

Alternatively, in order to reduce distortion of ink on the sheet P, in addition to providing the spur wheel 38 described above, ink-resistant material to which ink is not easily applied (e.g., water repellent material) may be coated on the edge of the opening, the guide surface, or any other portion that may be contacted or rubbed by the image forming surface of the sheet P.

Figure 21:
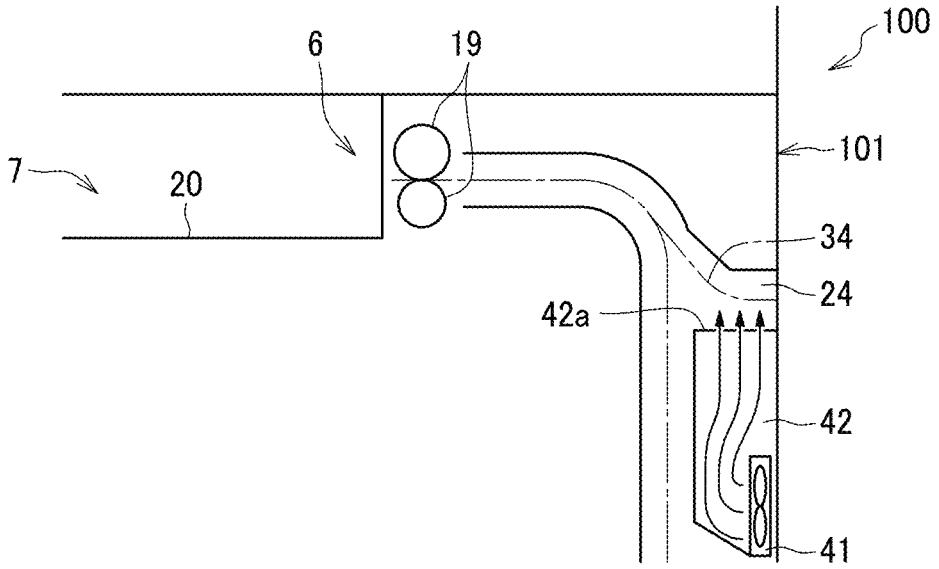
FIG. 21 is an enlarged view illustrating a part of the image forming apparatus according to Embodiment 4 of the present disclosure.

FIG. 21 is an enlarged view illustrating a part of the image forming apparatus 100 according to Embodiment 4 of the present disclosure.

The image forming apparatus 100 according to Embodiment 4 illustrated in FIG. 21 further includes an air blowing fan 41 disposed below the opening 24 via which the sheet P is exposed to the outside of the housing of the image forming apparatus 100. The air blowing fan 41 functions as an air blower. The air blowing fan 41 blows air toward the opening 24 via a duct 42 that functions as an air guide passage disposed in the housing 101 of the image forming apparatus 100.

Figure 22:
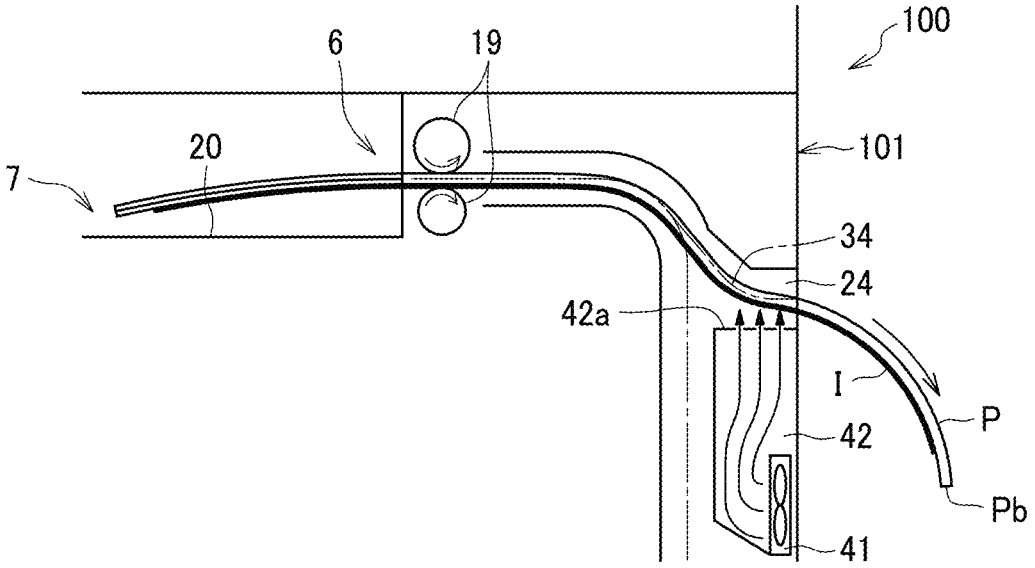
FIG. 22 is a diagram illustrating an air blowing operation performed in the image forming apparatus according to Embodiment 4.
Figure 23:
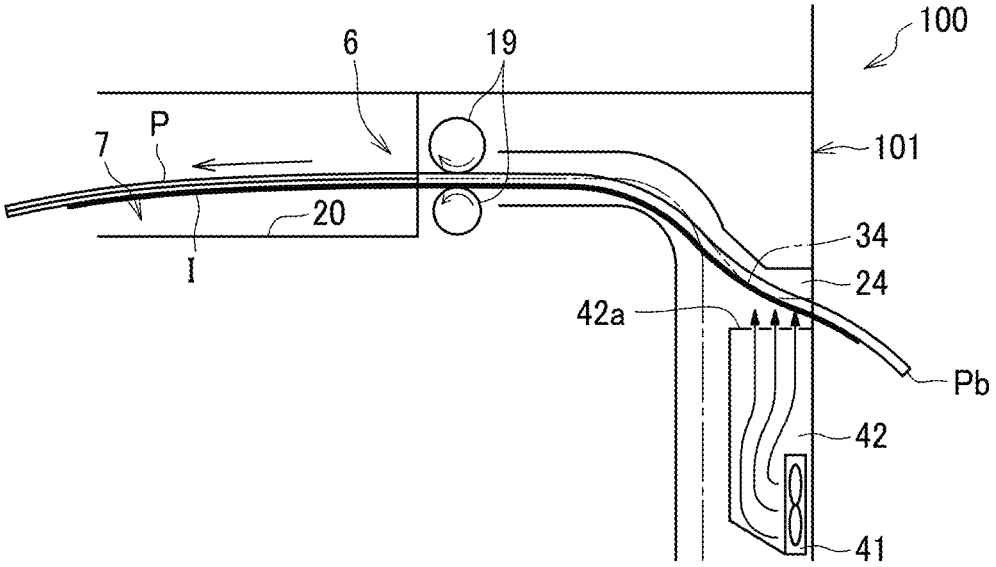
FIG. 23 is a diagram illustrating the air blowing operation subsequent from FIG. 22.

FIGS. 22 and 23 are diagrams illustrating the air blowing operation performed in the image forming apparatus 100 according to Embodiment 4.

As described above, the image forming apparatus 100 according to Embodiment 4 includes the air blowing fan 41 below the opening 24. According to this configuration, as illustrated in FIG. 22, in order to expose the sheet P to the outside of the housing of the image forming apparatus 100, the sheet P is conveyed to the opening 24 via the sheet exposure conveyance passage 34. At this time, the air blowing fan 41 blows air to the sheet P on which the ink I is applied, so that the air blown from the air blowing fan 41 to the sheet P accelerates drying the ink I on the sheet P. Further, the image forming apparatus 100 provided with the air blowing fan 41 may be provided to the image forming apparatus 100 illustrated in FIG. 2 (Embodiment 1) or the image forming apparatus 100 illustrated in FIG. 13 (Embodiment 2). In particular, in a case in which the image forming surface (that is, the liquid applied face on which the ink I is applied) of the sheet P faces the air blowing fan 41, it is effective that air is directly blown to the image forming surface of the sheet P. Further, when the sheet P stands by while being exposed to the outside of the housing of the image forming apparatus 100 or the sheet P is then conveyed to the sheet ejecting device 6 as illustrated in FIG. 23, the air blowing fan 41 blows air to the sheet P, thereby effectively drying the ink I on the sheet P.

The air blowing time of the air blowing fan 41 is preferably as short as possible in consideration of quietness. To be more specific, as illustrated in FIG. 22, when the sheet P is conveyed to the opening 24, the air blowing fan 41 starts blowing air at the timing at which the trailing end Pb of the sheet P reaches an air blowing port 42*a* of the duct 42. Then, as illustrated in FIG. 23, when the sheet P is conveyed to the sheet ejecting device 6, the air blowing fan 41 stops blowing air at the timing at which the trailing end Pb of the sheet P has passed through the air blowing port 42*a* of the duct 42. Note that there is a time lag between the timing at which the motor turns on and off to drive the air blowing fan 41 and the timing at which the air blowing fan 41 blows air to the sheet P at the desired airflow intensity. Therefore, this time lag may be considered to set the timing at which the motor turns on and off to drive the air blowing fan 41.

Further, the operation of the air blowing fan 41 may be controlled based on the amount of ink applied to the sheet P.

Figure 24:
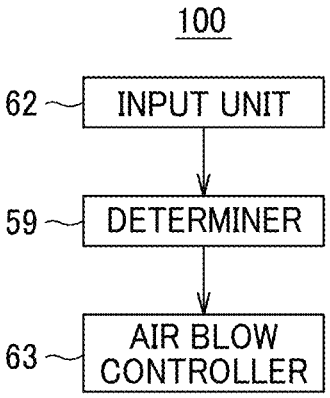
FIG. 24 is a block diagram illustrating a control system that controls the air blowing operation based on the amount of ink.

FIG. 24 is a block diagram illustrating a control system that controls the air blowing operation based on the amount of ink.

As illustrated in FIG. 24, the image forming apparatus 100 further includes a determiner 59 and an air blowing operation controller 63. The determiner 59 functions as a controller (circuitry) to control driving of the air blowing fan 41 and determines whether or not to drive the air blowing fan 41. The air blowing operation controller 63 functions as a controller (circuitry) to control the operation of the air blowing fan 41. The determiner 59 determines whether or not to drive the air blowing fan 41 based on image information that is input via the image reading device 2 or the input unit 62 or another terminal device different from the image forming apparatus 100. In this case, as in the above-described embodiments, the amount of ink applied to the sheet is also substituted by the image area rate. The determiner 59 calculates the image area rate of the image formed on the sheet based on the image information and determines whether or not to drive the air blowing fan 41 based on the image area rate obtained by the calculation. Further, the information input via the input unit 62 may include not only image information but also mode information selected from image formation modes having different resolutions from each other. Further, in addition to the image information, the amount of ink applied to a sheet may be specified based on the total amount of ink discharged from the liquid discharge head 14 of the image forming device 3. The air blowing operation controller 63 controls the turning on and off of a motor that drives the air blowing fan 41 based on the determination result of the determiner 59.

Figure 25:
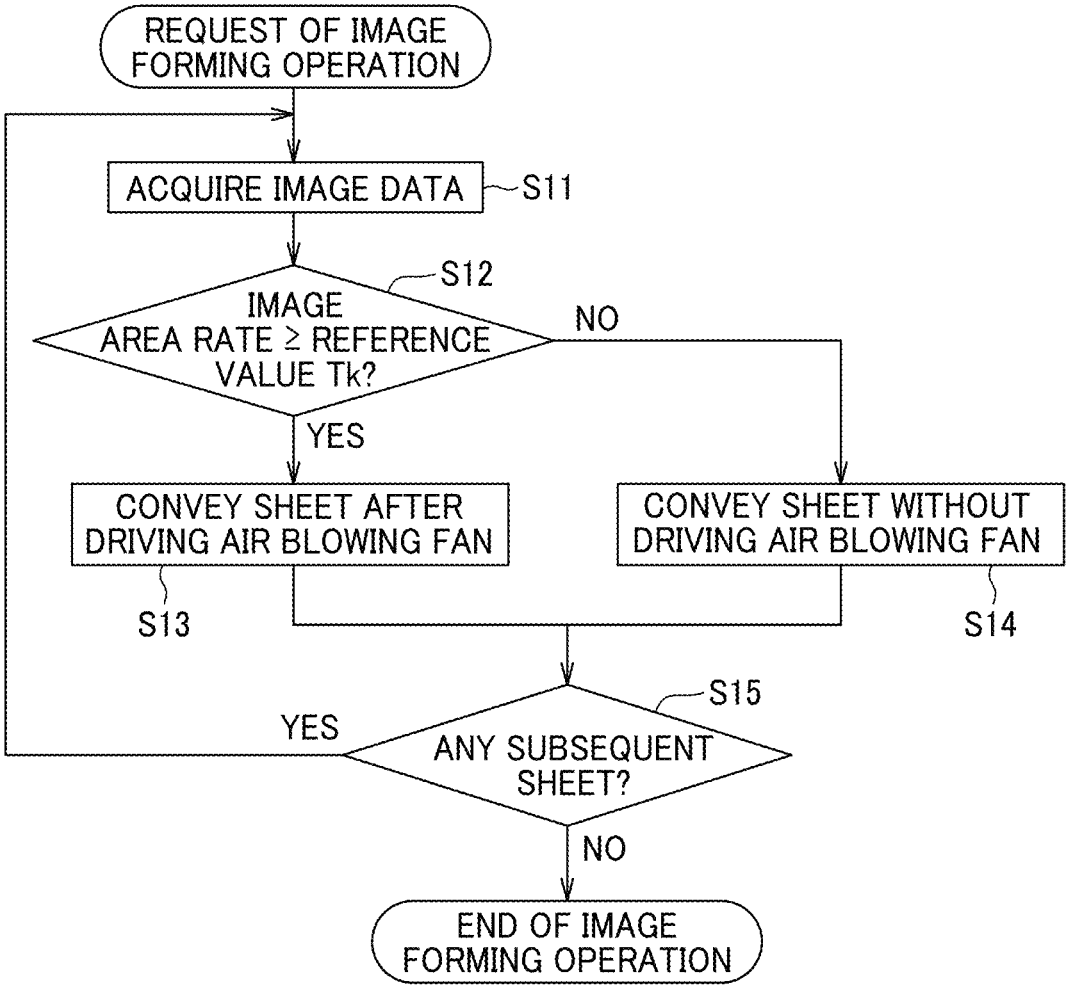
FIG. 25 is a flowchart illustrating a control flow of the air blowing operation.

Next, a description is given of a control flow of the air blowing operation with reference to FIG. 25.

FIG. 25 is a flowchart illustrating a control flow of the air blowing operation.

As illustrated in FIG. 25, as an image formation command is issued to start the image forming operation, the determiner 59 acquires image information from the input unit 62 or the image reading device 2 (step S11 in the flowchart of FIG. 25). Then, the determiner 59 determines whether or not to drive the air blowing fan 41 based on the image area rate acquired by the image information. That is, the determiner 59 calculates the image area rate based on the acquired image information, and determines whether or not the image area rate of the image acquired from the image information is equal to or greater than a reference value Tk previously set (e.g., 20%) (step S12 in the flowchart of FIG. 25).

As a result, when the image area rate is equal to or greater than the reference value Tk (YES in step S12 in the flowchart of FIG. 25), it is determined that the amount of ink to be applied to the sheet is relatively large, and the air blowing fan 41 is drive in order to accelerate the drying of ink (step S13 in the flowchart of FIG. 25). By so doing, when the sheet is exposed to the outside of the image forming apparatus 100 and is then conveyed to the sheet ejection tray 20, the air blowing fan 41 blows air, thereby accelerating the drying of the ink on the sheet.

By contrast, when the image area rate is smaller than the reference value Tk (NO in Step 12 in the flowchart of FIG. 25), it is determined that the amount of ink applied to the sheet is relatively small and that the ink on the sheet does not need to be dried. Therefore, the air blowing operation controller 63 controls not to drive the air blowing fan 41 (step S14 in the flowchart of FIG. 25). Therefore, in this case, while the driving of the air blowing fan 41 is stopped, the sheet is conveyed to the outside of the image forming apparatus 100 and the sheet ejection tray 20.

Then, after the sheet is ejected to the sheet ejection tray 20, it is determined whether or not there is any sheet to be conveyed subsequent to the sheet (step S15 in the flowchart of FIG. 25). When there is a sheet to be conveyed subsequent to the sheet (YES in step S15 in the flowchart of FIG. 25), step S15 is repeated until it is determined that there is no subsequent sheet to be conveyed. On the other hand, when there is no sheet to be conveyed subsequent to the sheet (NO in step S15 in the flowchart of FIG. 25), the image forming operation ends.

By determining whether or not to drive the air blowing fan 41 based on the image area rate, the air blowing fan 41 is driven only when the ink on the sheet needs to be dried. Accordingly, when the amount of ink applied to the sheet is relatively large, the air blowing fan 41 is driven to effectively dry the sheet. By contrast, when the amount of ink applied to the sheet is relatively small, the sheet is ejected to the sheet ejection tray 20 without driving the air blowing fan 41. By so doing, the unnecessary driving of the air blowing fan 41 is restrained, thereby enhancing quietness of the image forming apparatus 100.

Further, the airflow intensity of the air blowing fan 41 (at least one of the amount of air and the speed of airflow) may be changeable based on the amount of ink applied to the sheet. For example, when the image area rate is equal to or greater than the reference value that is previously set, by increasing the airflow intensity of the air blowing fan 41, the ink is dried more effectively, when compared with the case in which the image area rate is smaller than the reference value.

Further, the airflow intensity of the air blowing fan 41 may be changeable according to the printing productivity of the image forming apparatus 100. The high printing productivity provides the relatively high conveying speed of the sheet and the low printing productivity provides the low conveying speed of the sheet. As the airflow intensity of the air blowing fan 41 increases, the ink on the sheet is dried more effectively.

Further, the above-described control of the air blowing operation may be executed along with the control of the above-described sheet conveying operation, in other words, the determination of whether or not the sheet is exposed to the outside of the image forming apparatus 100.

Figure 26:
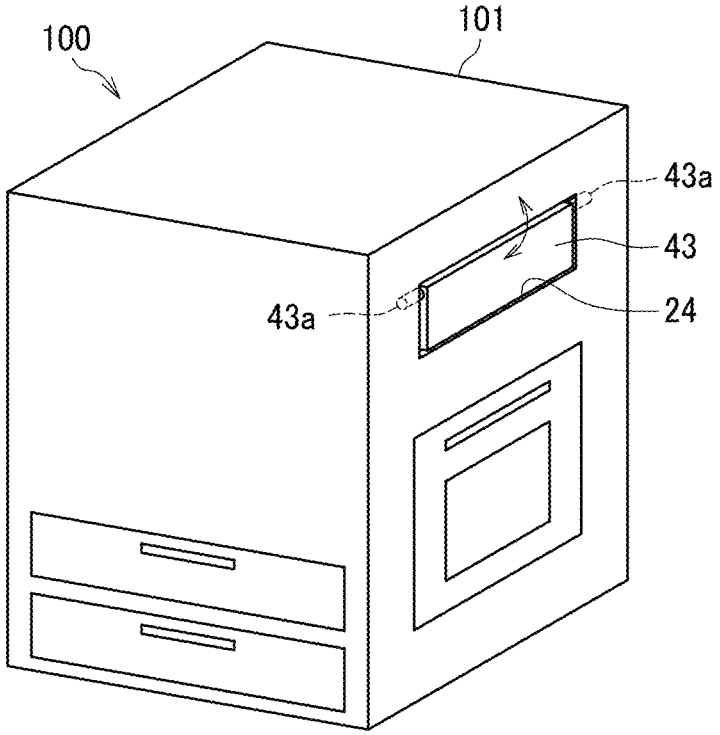
FIG. 26 is an external view illustrating the image forming apparatus according to Embodiment 5 of the present disclosure.

FIG. 26 is an external view illustrating the image forming apparatus according to Embodiment 5 of the present disclosure.

As illustrated in FIG. 26, the image forming apparatus 100 according to Embodiment 5 further includes a lid-like rotatable cover 43 that is attached to the housing 101 of the image forming apparatus 100. The rotatable cover 43 is provided to the opening 24 via which a sheet is exposed to the outside of the image forming apparatus 100. In the present embodiment, that is, in Embodiment 5, the rotatable cover 43 is rotatable about a shaft 43*a* that is provided to the upper part of the rotatable cover 43.

Figure 27:
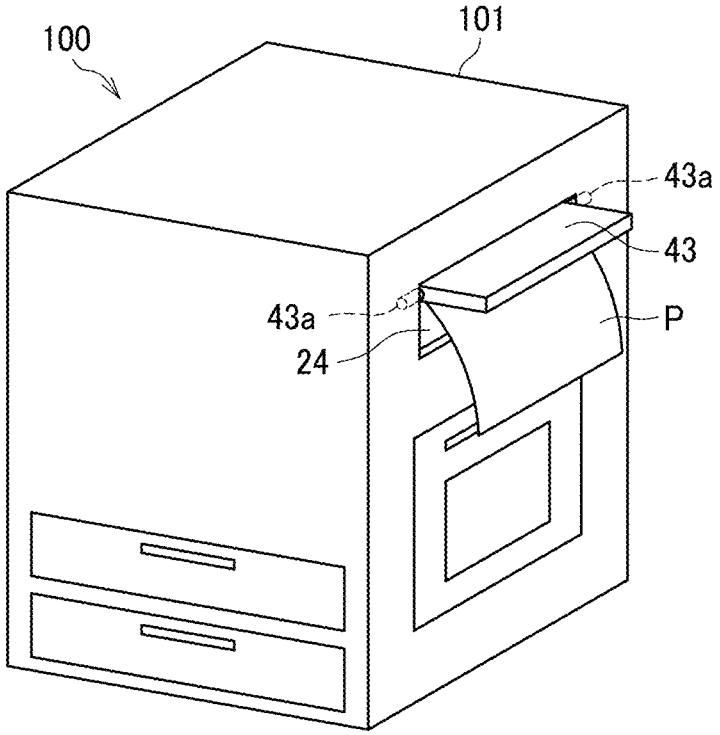
FIG. 27 is a diagram illustrating a state in which a rotatable cover opens to expose the sheet to the outside of the image forming apparatus.

FIG. 27 is a diagram illustrating a state in which the rotatable cover opens to expose the sheet to the outside of the image forming apparatus 100.

Figure 28:
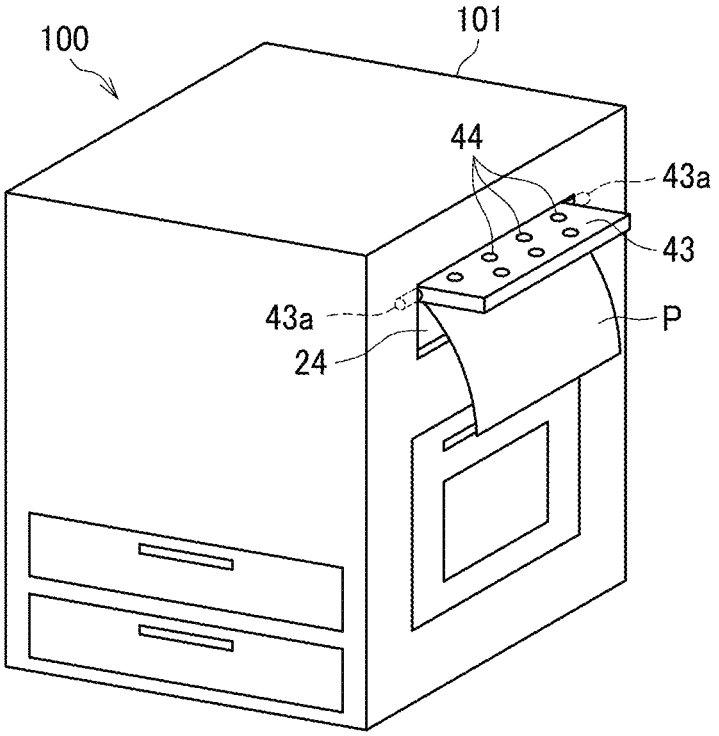
FIG. 28 is a diagram illustrating an example in which a cover is provided with air holes in the cover.

FIG. 28 is a diagram illustrating an example in which a cover is provided with air holes in the cover.

As illustrated in FIG. 27, the rotatable cover 43 is rotated upward and, for example, a stopper mechanism holds the rotatable cover 43 in this state, so that the opening 24 may be in an open state. In this state, the sheet P is exposed to the outside of the image forming apparatus 100 through the opening 24. Further, in a state in which the sheet P is exposed to the outside of the image forming apparatus 100, the rotatable cover 43 covers the sheet P over the upper portion that is exposed from the image forming apparatus 100. Therefore, the rotatable cover 43 also functions as a cover that prevents a user from contacting the exposed sheet P.

Further, as in the example illustrated in FIG. 28, in a case in which the rotatable cover 43 has a plurality of air passage holes 44, water (moisture) evaporated from the sheet P may pass through the plurality of air passage holes 44 upward. Accordingly, this configuration accelerates drying the ink on the sheet P. Further, at least a part of the rotatable cover 43 may be made by a transparent material, so that a user may visually confirm the sheet P from above the rotatable cover 43.

Figure 29:
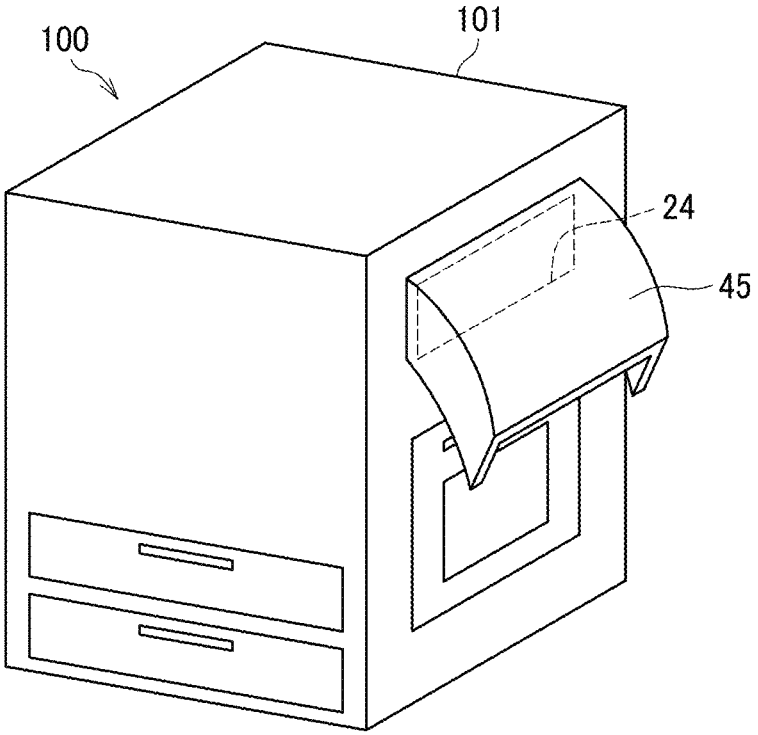
FIG. 29 is an external view illustrating the image forming apparatus according to Embodiment 6 of the present disclosure.

FIG. 29 is an external view illustrating the image forming apparatus according to Embodiment 6 of the present disclosure.

As illustrated in FIG. 29, the image forming apparatus 100 according to Embodiment 6 further includes a cover 45 that is a separate member detachably attachable to the housing 101. The cover 45 has a box shape having an opening at the bottom and is attached to or near the opening 24 through which the sheet is exposed to the outside of the image forming apparatus 100.

Figure 30:
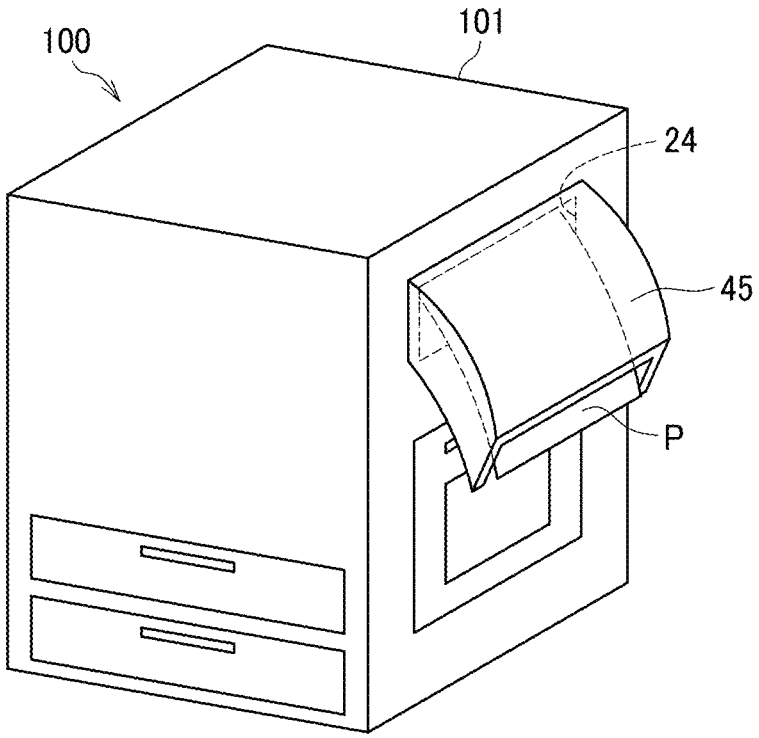
FIG. 30 is a diagram illustrating a state in which a sheet is exposed out.

FIG. 30 is a diagram illustrating a state in which the sheet is exposed to the outside of the image forming apparatus 100.

As illustrated in FIG. 30, as the sheet P is exposed via the opening 24, the exposed sheet P enters into space surrounded by the cover 45, so that the sheet P is covered by the cover 45. This configuration prevents a user from contacting the exposed sheet P, in other words, the exposed sheet P is prevented from being contacted by a user. Further, it is preferable that the cover 45 has the size and shape that can avoid contacting the sheet P.

Figure 31:
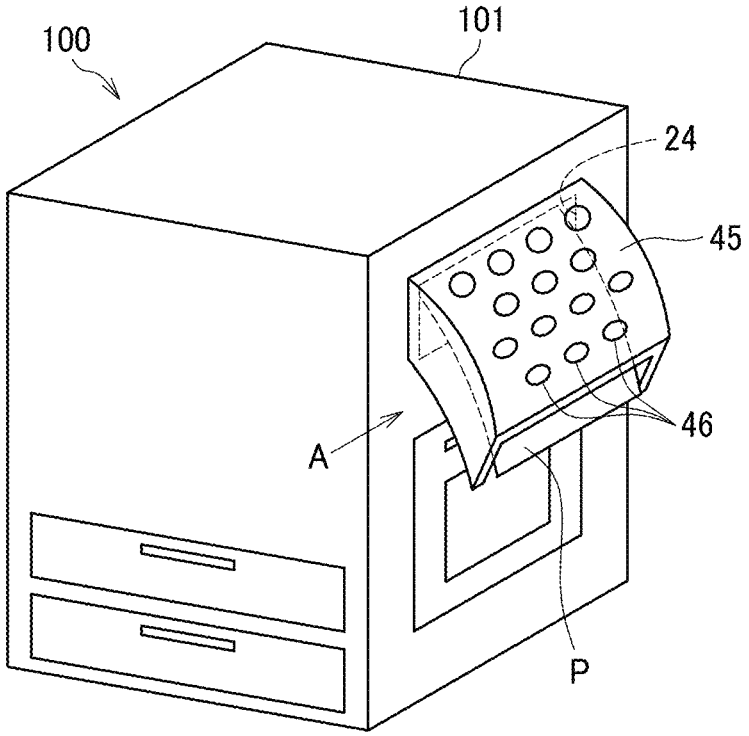
FIG. 31 is a diagram illustrating an example in which the cover is provided with air holes in a cover.

Further, FIG. 31 is a diagram illustrating an example in which a cover is provided with air passage holes in the cover.

As in the example illustrated in FIG. 31, by providing a plurality of air passage holes 46 in the cover 45, water (moisture) evaporated from the sheet P may pass through the plurality of air passage holes 46 upward. Further, to prevent a user from contacting the sheet P, in particular, from the front side of the image forming apparatus 100, in other words, in a direction indicated by arrow Ain FIG. 31, the cover 45 may be disposed mainly on the front side of the image forming apparatus 100. In that case, since the sheet P is not covered by the cover 45 except for the front side, water (moisture) evaporated from the sheet P spreads around easily, thereby accelerating the drying of the ink on the sheet P. Further, at least a part of the cover 45 may be made by a transparent material, so that a user may visually confirm the sheet P from the outside of the cover 45. Further, the cover 45 may entirely cover the sheet P and the periphery of the sheet P including the lower part of the sheet P exposed from the opening 24. In this case, by providing the plurality of air passage holes 46 in the upper face of the cover 45, water (moisture) evaporated from the sheet P may pass through the plurality of air passage holes 46 upward.

Figure 32:
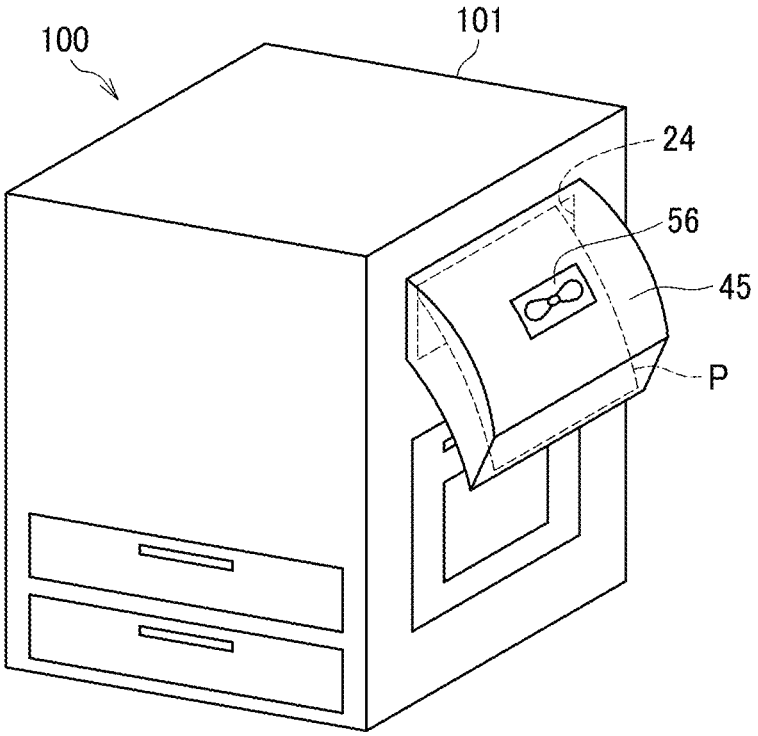
FIG. 32 is a diagram illustrating an example of an air exhaust fan on the cover.

FIG. 32 is a diagram illustrating an example of an air exhaust fan on the cover.

As in the example illustrated in FIG. 32, an air exhaust fan 56 may be provided on the upper face of the cover 45. In this case, even when the cover 45 entirely covers the sheet P and the periphery of the sheet P, the air exhaust fan 56 discharges water (moisture) evaporated from the sheet P to the outside of the image forming apparatus 100. Note that the example in FIG. 32 is also assumed that the sheet P is exposed via the opening 24.

As described above, various types of configurations of the image forming apparatus 100 applicable to respective embodiments of the present disclosure have been described. However, the image forming apparatus according to the present disclosure is not limited to the image forming apparatus having the configuration as illustrated in FIG. 1 but may be applied to the image forming apparatus having the configuration according to each variation to Embodiment 1, as illustrated in each of FIGS. 33, 34, 35, and 36.

FIGS. 33 to 36 are diagrams illustrating image forming apparatuses according to respective variations.

Figure 33:
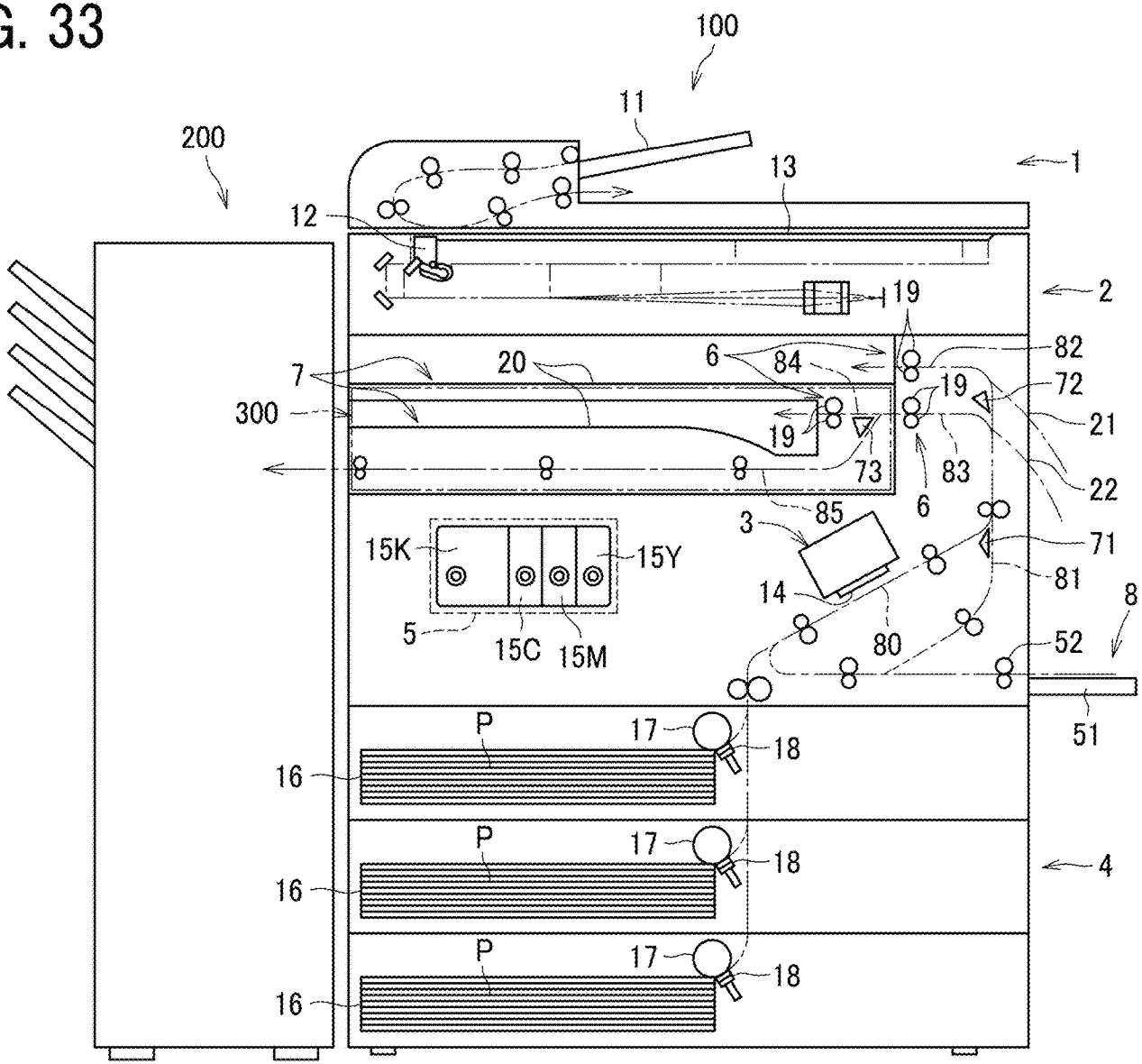
FIG. 33 is a diagram illustrating the image forming apparatus according to a variation.

The image forming apparatus 100 illustrated in FIG. 33 includes a sheet conveying device 300 that is detachably attached to the housing 101 of the image forming apparatus 100. The sheet conveying device 300 integrally includes the lower sheet stacker 7 (lower sheet ejection tray 20), the lower pair of sheet ejecting rollers 19, and the sheet conveyance passage 85 through which the sheet is conveyed to the sheet alignment apparatus 200 (post-processing apparatus), which are illustrated in FIG. 1. As in the above-described embodiments, the image forming apparatus 100 illustrated in FIG. 33 includes the openings 21 and 22 to expose the sheet to the outside of the image forming apparatus 100. By providing the openings 21 and 22, after the sheet P is exposed via the openings 21 and 22 to the outside of the image forming apparatus 100, the sheet P is conveyed to the sheet alignment apparatus 200 via the upper sheet stacker 7, the (lower) sheet stacker 7 included in the sheet conveying device 300, or the sheet conveyance passage 85 included in the sheet conveying device 300.

In other words, the lower pair of sheet ejecting rollers 19 changes the direction of conveyance of the sheet P to the opposite direction opposite the sheet conveyance direction to expose the sheet P via the opening 22 to the outside of the housing 101 of the image forming apparatus 100. Then, the lower pair of sheet ejecting rollers 19 changes the direction of conveyance of the sheet P to the sheet conveyance direction to convey the sheet P to the lower sheet stacker 7 (lower sheet ejection tray 20) or to the sheet conveyance passage 85 to further convey to the sheet alignment apparatus 200.

Figure 34:
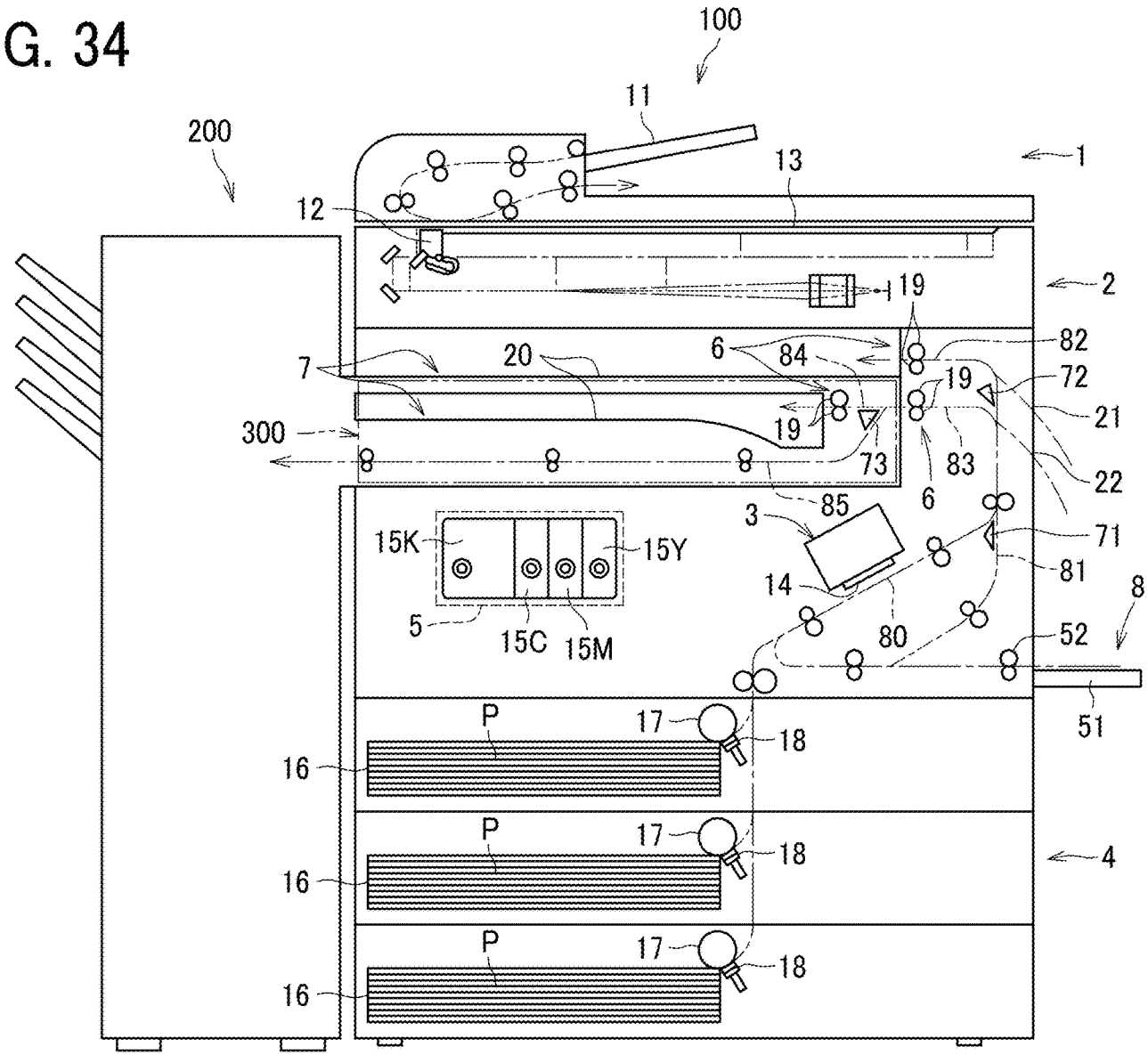
FIG. 34 is a diagram illustrating the image forming apparatus according to another variation.

Further, as in the example illustrated in FIG. 34, the sheet conveying device 300 may be integrally provided with the sheet alignment apparatus 200 as a single unit as described above.

Figure 35:
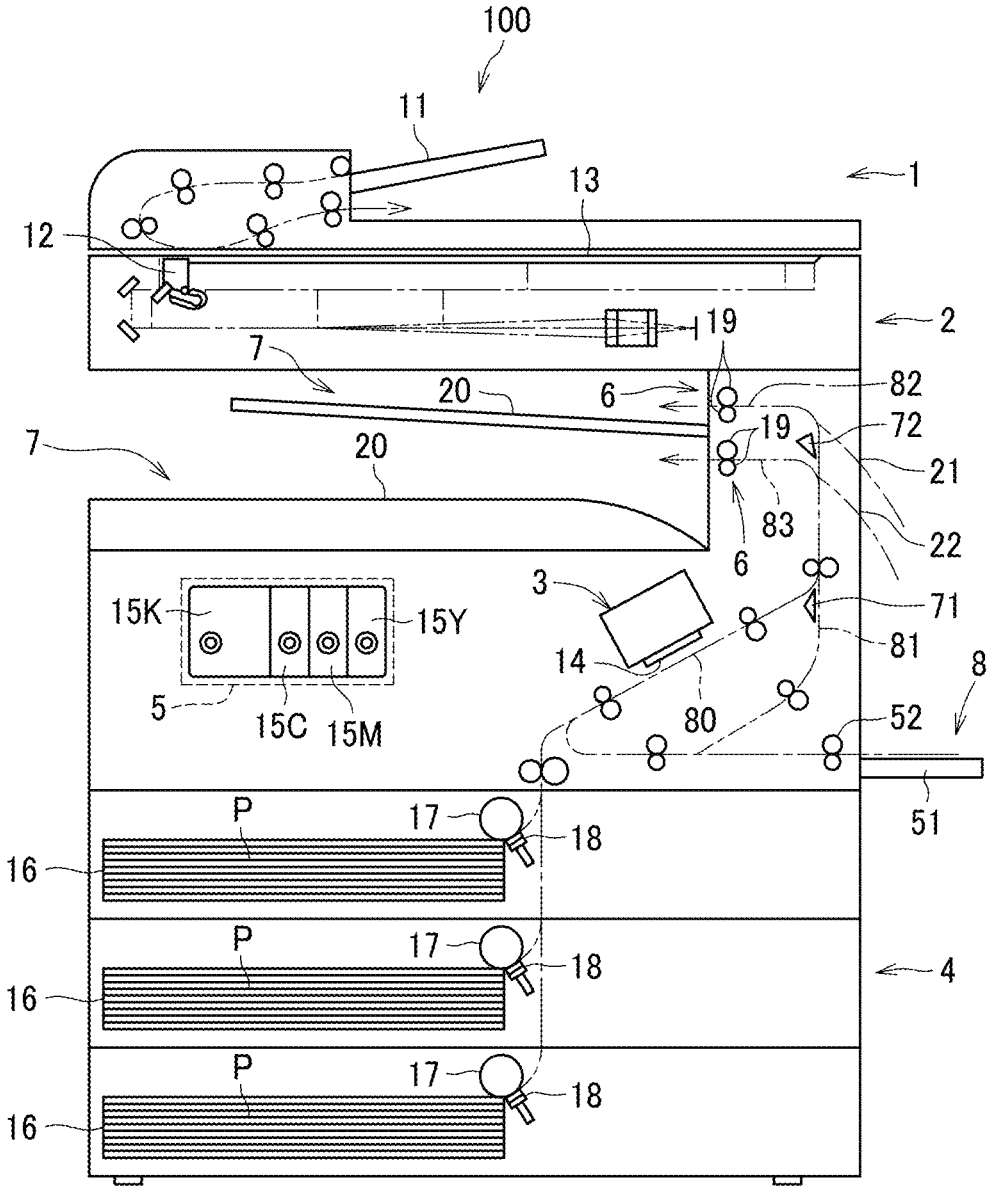
FIG. 35 is a diagram illustrating the image forming apparatus according to yet another variation.

Further, as illustrated in FIG. 35, the image forming apparatus 100 may not include the sheet alignment apparatus 200 and the sheet conveyance passage 85 through which the sheet P is conveyed to the sheet alignment apparatus 200. In this case, the sheet P is ejected to the lower sheet stacker 7 via the sheet conveyance passage 83 or to the upper sheet stacker 7 via the sheet conveyance passage 82.

Figure 36:
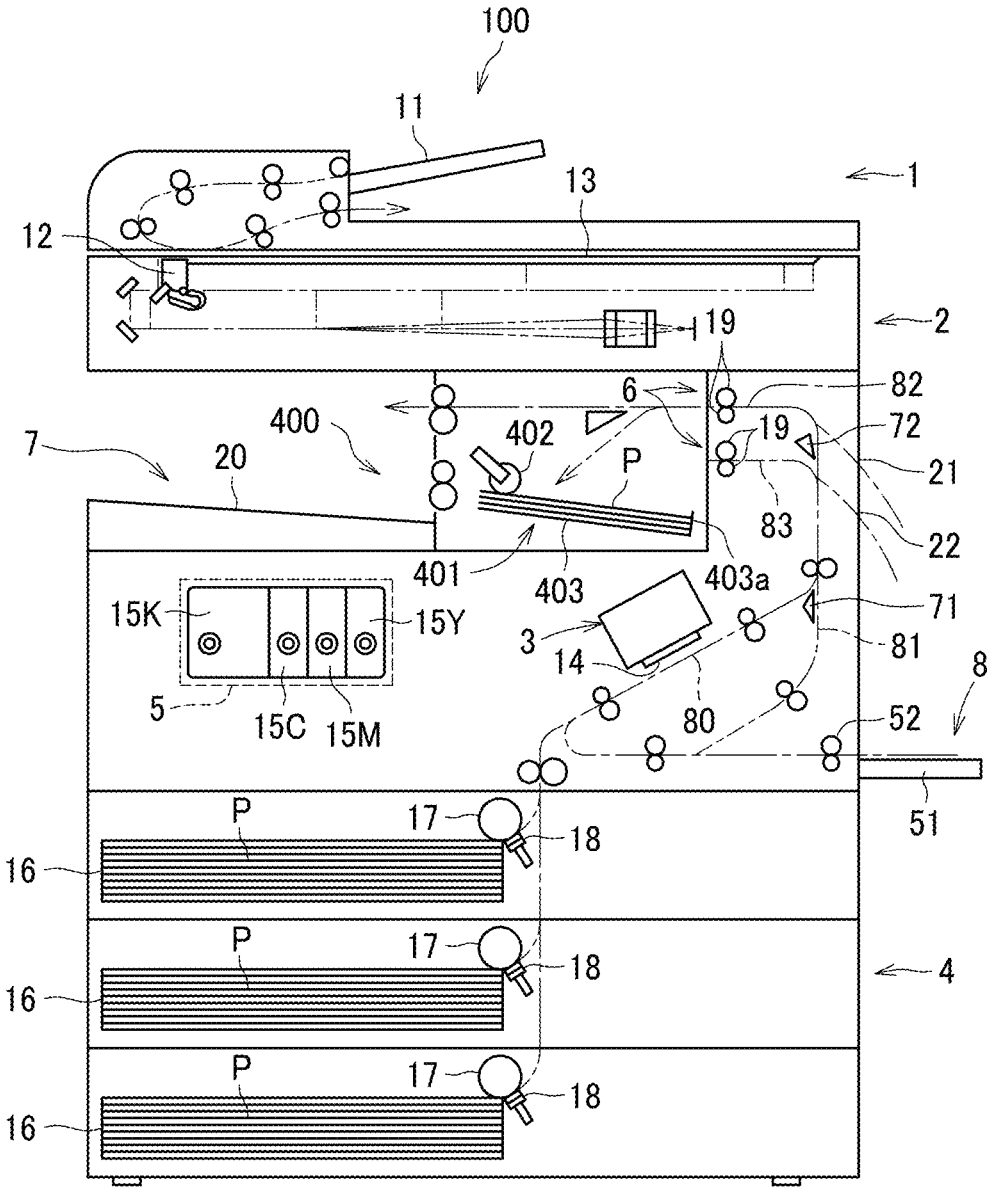
FIG. 36 is a diagram illustrating the image forming apparatus according to yet another variation.

Further, as illustrated in FIG. 36, the image forming apparatus 100 may include a post-processing apparatus 400 (post-processing device) between the image reading device 2 and the image forming device 3. In this case, when the post-processing apparatus 400 is attached to the image forming apparatus 100, the sheet ejection port of the sheet conveyance passage 83 is closed, and therefore the sheet P is ejected only from the sheet ejection port of the sheet conveyance passage 82 above the sheet conveyance passage 83. When the post-processing operation is performed to the sheet P, the sheet P ejected from the sheet ejection port of the sheet conveyance passage 82 is stacked with the image forming surface facing down on the sheet stacking tray 403 of the post-processing device 401. Further, the sheet P stacked on the sheet stacking tray 403 is conveyed by a sheet conveying roller 402 provided in the post-processing device 401 in the reverse direction with the trailing end of the sheet P to the leading end of the sheet P. Then, the trailing end of the sheet P contacts (abuts) a trailing end regulator 403*a* of the sheet stacking tray 403 to align the position of the trailing end of the sheet P. In the state in which the position of the trailing end of the sheet P is aligned, the stapling process and the punching process are performed to the sheet P. Then, the sheet conveying roller 402 is rotated in the reverse direction, so that the sheet P on the sheet stacking tray 403 is ejected to the sheet stacker 7 (sheet ejection tray 20). By contrast, when the post-processing operation is not performed to the sheet P, the sheet P is ejected to the sheet stacker 7 (sheet ejection tray 20) without being conveyed to the post-processing device 401.

Further, the image forming apparatus according to the present disclosure may not include the original document conveying device 1 and the image reading device 2 and may include the sheet stacker 7 having the top being open. In this case, the sheet P from which the predetermined amount of water (moisture) is evaporated is stacked in the sheet stacker 7, thereby reducing an adverse effect to an image due to friction between sheets or contact of sheets.

Further, the present disclosure is also applicable to the following image forming apparatus.

Figure 37:
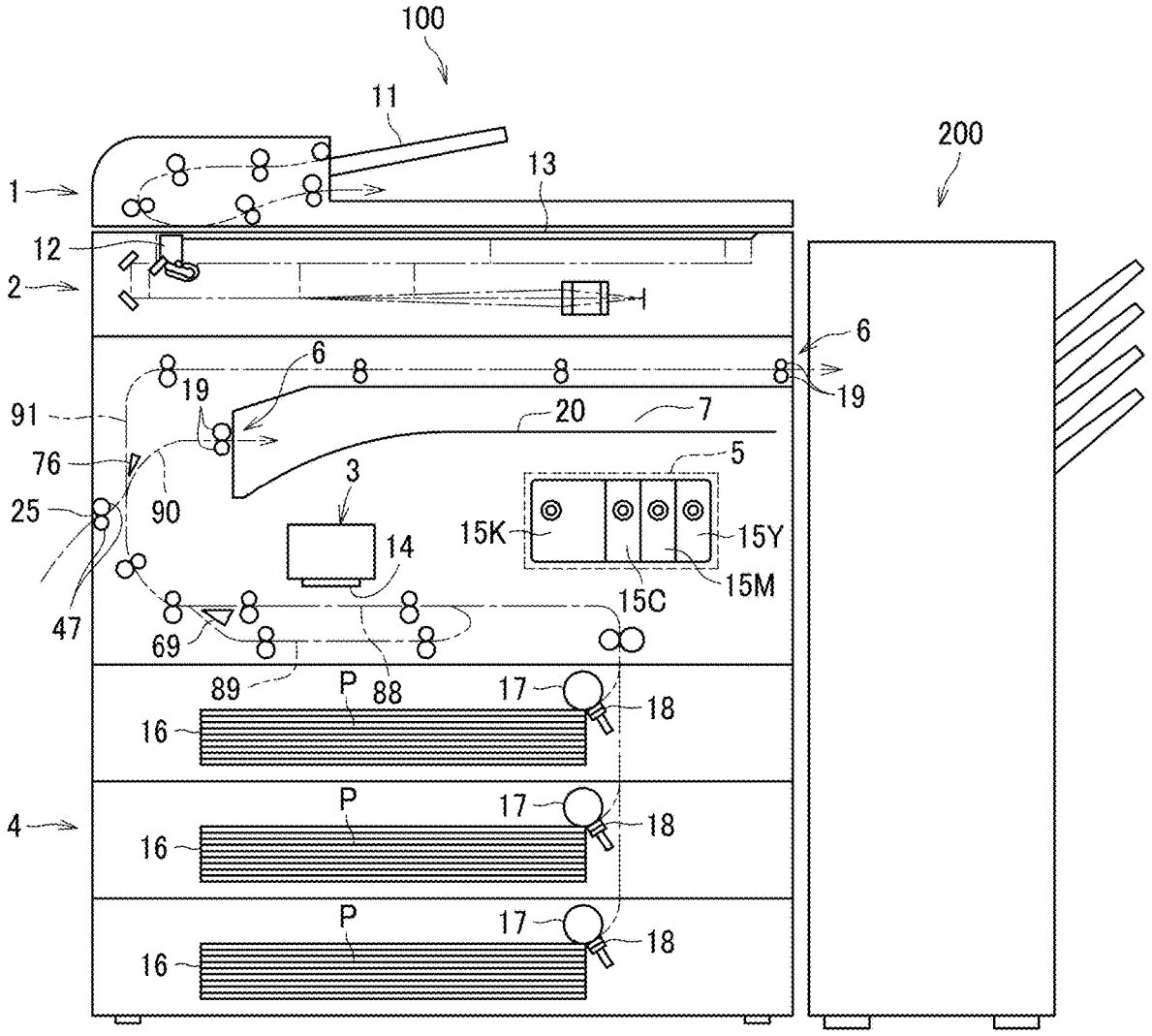
FIG. 37 is a diagram illustrating the configuration of another image forming apparatus.

FIG. 37 is a diagram illustrating the configuration of another image forming apparatus.

As in the above-described embodiments, the image forming apparatus 100 illustrated in FIG. 37 includes the original document conveying device 1, the image reading device 2, the image forming device 3, the sheet feeding device 4, the cartridge container 5, the sheet ejecting device 6, and the sheet stacker 7. Note that, different from the image forming apparatus 100 in FIG. 1, the image forming apparatus 100 in FIG. 37 includes a sheet conveyance passage 88 that is disposed facing the image forming device 3 in the horizontal direction. In the image forming apparatus 100 illustrated in FIG. 1, the sheet conveyance passage 80 that faces the image forming device 3 is disposed at an angle to the horizontal direction. As in the above-described embodiments, the image forming apparatus 100 according to the present embodiment includes an opening 25 via which the sheet P is exposed to the outside of the image forming apparatus 100.

In the image forming apparatus 100 illustrated in FIG. 37, as a print job start instruction is issued, the sheet P is supplied from the sheet feeding device 4 and then is conveyed to the image forming device 3. Then, when the sheet P is conveyed to the image forming device 3, ink is discharged from the liquid discharge head 14 onto the sheet P to form an image on the sheet P.

When performing the duplex printing, after the sheet P has passed the image forming device 3, the sheet P is then conveyed in the opposite direction opposite the sheet conveyance direction. Then, a first passage changer 69 guides the sheet P to a sheet reverse passage 89. Then, as the sheet P passes the sheet reverse passage 89, the sheet P is reversed from the front face to the back face and is conveyed to the image forming device 3 again, so that an image is formed on the back face of the sheet P.

Thereafter, the sheet P is guided by a second passage changer 76 disposed downstream from the first passage changer 69 in the sheet conveyance direction, selectively to a sheet conveyance passage 90 toward the sheet stacker 7 or to a sheet conveyance passage 91 toward the sheet alignment apparatus 200. In a case in which the sheet P is guided to the sheet conveyance passage 90 toward the sheet stacker 7, it is selectable whether the sheet P is ejected directly to the sheet ejection tray 20 or the sheet P is exposed to the outside of the housing of the image forming apparatus 100 via the opening 25 and then is ejected to the sheet ejection tray 20.

FIGS. 38 to 41 are diagrams illustrating the sheet conveying operation performed in the image forming apparatus.

Figure 38:
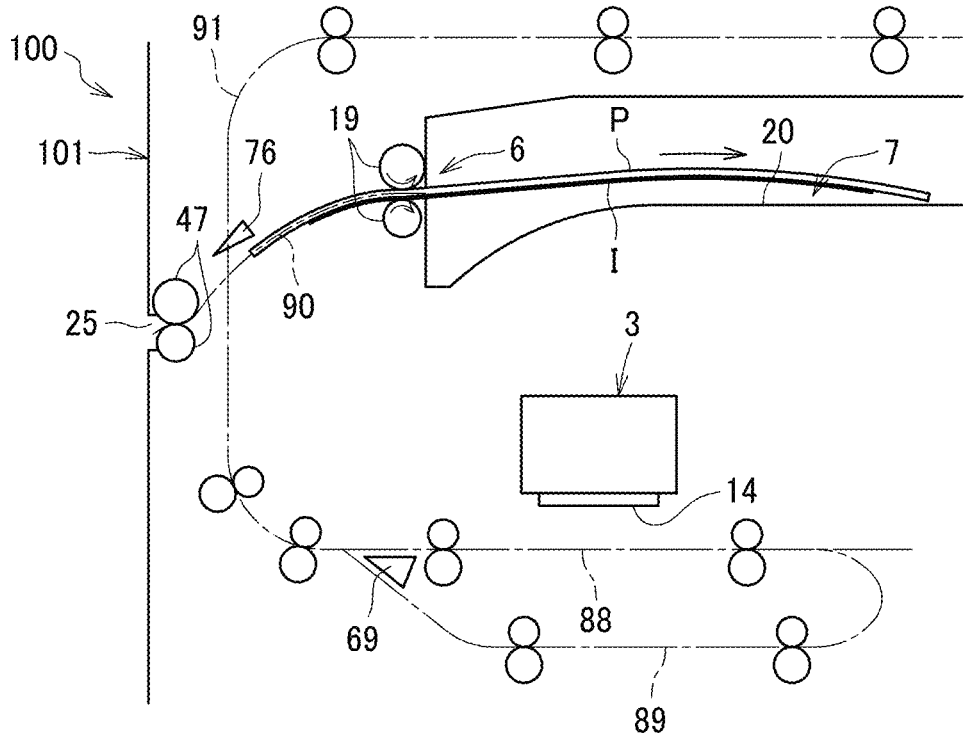
FIG. 38 is a diagram illustrating a sheet conveying operation performed in the image forming apparatus of FIG. 37.
Figure 39:
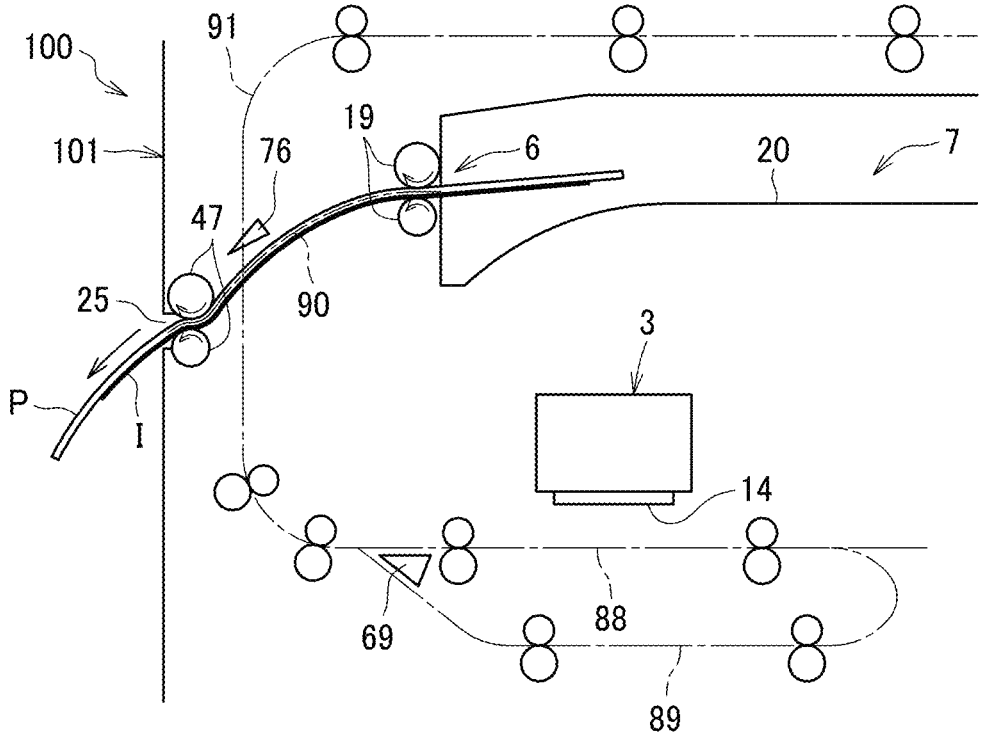
FIG. 39 is a diagram illustrating the sheet conveying operation subsequent from FIG. 38.
Figure 40:
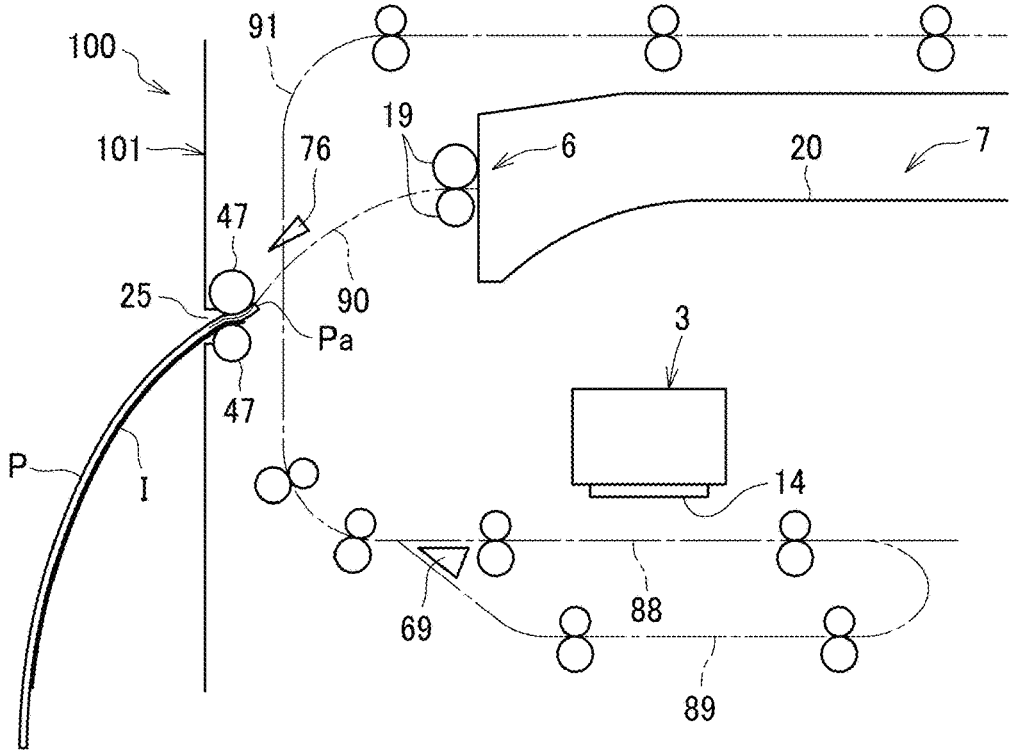
FIG. 40 is a diagram illustrating the sheet conveying operation subsequent from FIG. 39.

In a case in which the sheet P is exposed to the outside of the housing of the image forming apparatus 100, the sheet P is temporarily conveyed to the sheet ejection tray 20 as illustrated in FIG. 38, and then the pair of sheet ejection rollers 19 of the sheet ejecting device 6 is rotated in the reverse direction to convey the sheet P toward the opening 25 as illustrated in FIG. 39. Further, a pair of sheet conveying rollers 47 that functions as a sheet conveyor is provided to the opening 25 and rotates in the same direction as the rotational direction of the pair of sheet ejection rollers 19. By so doing, the sheet P is conveyed so as to be exposed to the outside of the image forming apparatus 100 via the opening 25. Then, as illustrated in FIG. 40, rotation of the pair of sheet conveying rollers 47 is stopped before or immediately before the leading end Pa of the sheet P passes through the nip region of the pair of sheet conveying rollers 47. Accordingly, while being exposed via the opening 25 to the outside of the image forming apparatus 100, the sheet P is held by the pair of sheet conveying rollers 47. Note that, in this case, the image forming surface (that is, the liquid applied face on which the ink I is applied) of the sheet P is disposed facing down.

Figure 41:
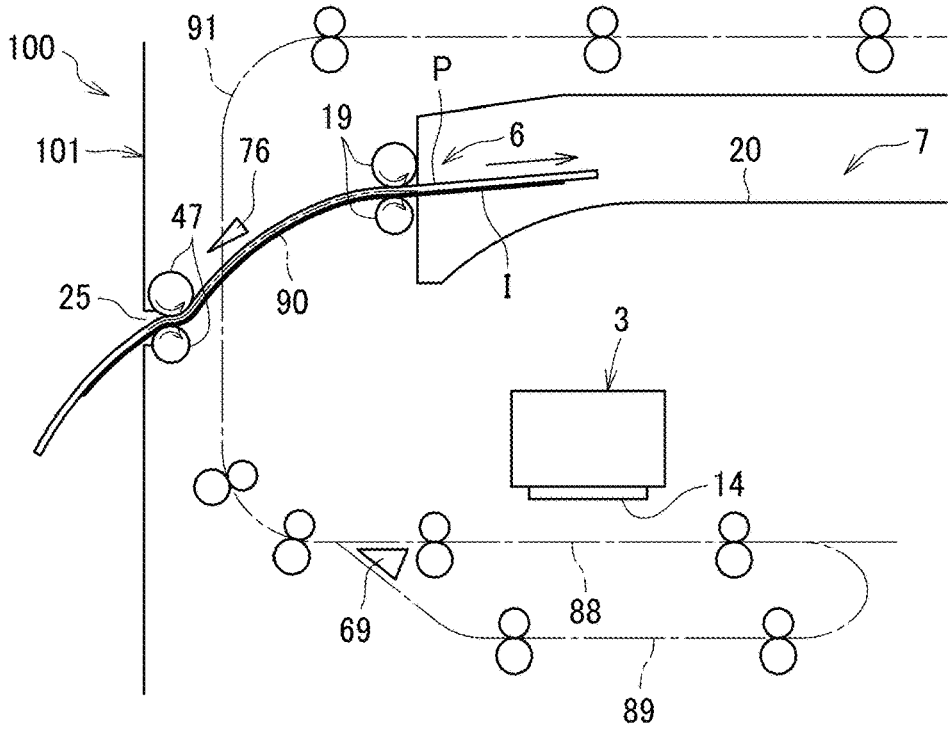
FIG. 41 is a diagram illustrating the sheet conveying operation subsequent from FIG. 40.

Thereafter, as illustrated in FIG. 41, the pair of sheet ejection rollers 19 and the pair of sheet conveying rollers 47 are rotated in the reverse direction, so that the sheet P is ejected to the sheet ejection tray 20. Alternatively, while the sheet P is exposed to the outside of the image forming apparatus 100, the second passage changer 76 may change the sheet conveyance passage, so that the sheet P passes through the upper pair of sheet ejection rollers 19 via the sheet conveyance passage 91 to guide the sheet P to the sheet alignment apparatus 200 (sheet conveyance passage 91). Note that, when the sheet P is guided to the sheet conveyance passage 91, it may be selectable whether the sheet P is ejected to the sheet alignment apparatus 200 or the sheet P is exposed to the outside of the image forming apparatus 100 via the opening 25 and then is ejected to the sheet alignment apparatus 200. In this case, the sheet P first enters the sheet conveyance passage 91, then the direction of conveyance of the sheet P is reversed, and the sheet P is conveyed toward the opening 25. Then, after the sheet P is exposed to the outside of the image forming apparatus 100, the direction of conveyance of the sheet P is reversed, then the sheet P passes the pair of sheet ejection rollers 19 via the sheet conveyance passage 91, and is guided to the sheet alignment apparatus 200 (sheet conveyance passage 91).

As described above, by applying the present disclosure to the image forming apparatus 100 illustrated in FIG. 37, the sheet P is exposed to the outside of the image forming apparatus 100 via the opening 25 provided to the housing 101 of the image forming apparatus 100. Accordingly, the ink on the sheet P is dried effectively.

Figure 42:
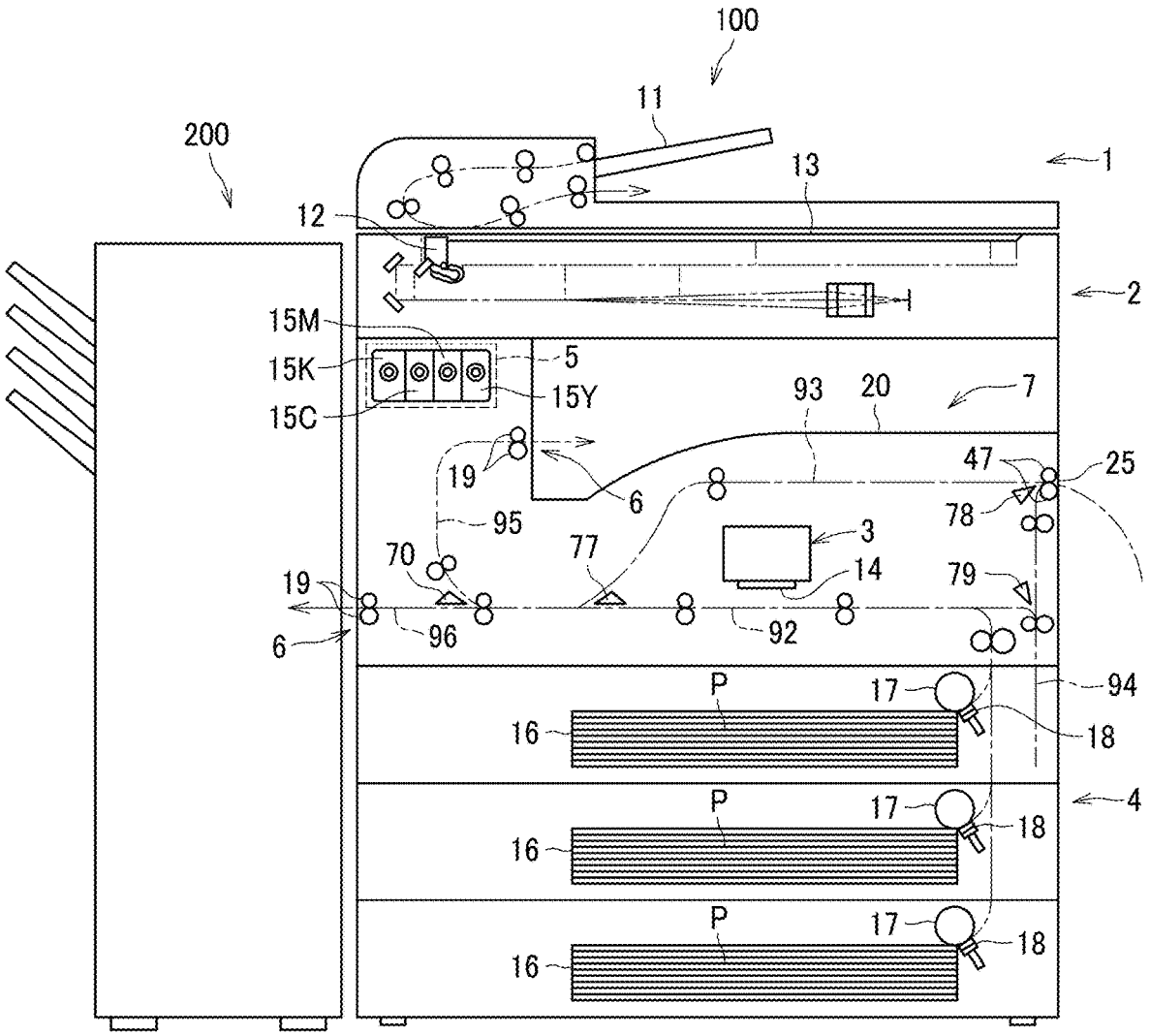
FIG. 42 is a diagram illustrating the configuration of yet another image forming apparatus.

Further, FIG. 42 is a diagram illustrating the configuration of yet another image forming apparatus.

As the image forming apparatus 100 illustrated in FIG. 37, the image forming apparatus 100 illustrated in FIG. 42 includes the original document conveying device 1, the image reading device 2, the image forming device 3, the sheet feeding device 4, the cartridge container 5, the sheet ejecting device 6, and the sheet stacker 7. Note that, in this case, similar to the image forming device 3 included in the image forming apparatus 100 in FIG. 37, the image forming device 3 included in the image forming apparatus 100 illustrated in FIG. 42 is disposed facing a sheet conveyance passage 92 in which the sheet P is conveyed in the horizontal direction. Further, as the image forming apparatus 100 illustrated in FIG. 37, the image forming apparatus 100 illustrated in FIG. 42 according to the present embodiment includes the opening 25 via which the sheet P is exposed to the outside of the image forming apparatus 100.

In the image forming apparatus 100 illustrated in FIG. 42, as a print job start instruction is issued, the sheet P is supplied from the sheet feeding device 4 and then is conveyed to the image forming device 3. Then, when the sheet P is conveyed to the image forming device 3, ink is discharged from the liquid discharge head 14 onto the sheet P to form an image on the sheet P.

FIGS. 43 to 50E are diagrams illustrating the sheet conveying operation performed in the image forming apparatus 100 illustrated in FIG. 42.

Figure 43:
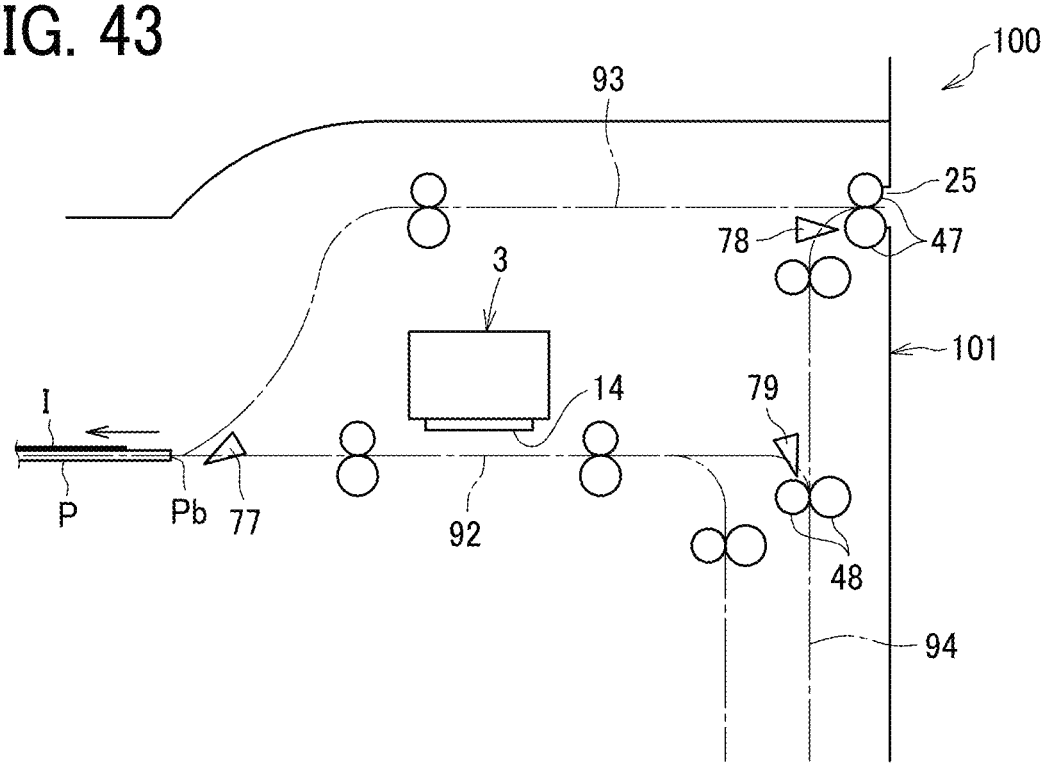
FIG. 43 is a diagram illustrating a sheet conveying operation performed in the image forming apparatus of FIG. 42.
Figure 44:
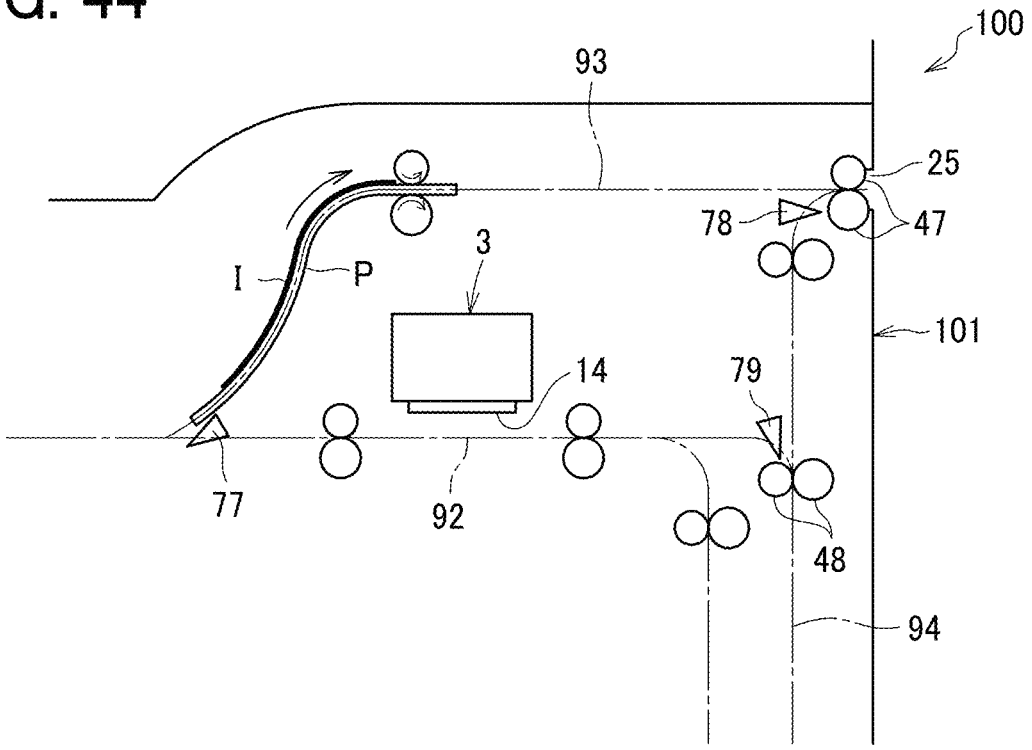
FIG. 44 is a diagram illustrating the sheet conveying operation subsequent from FIG. 43.
Figure 45:
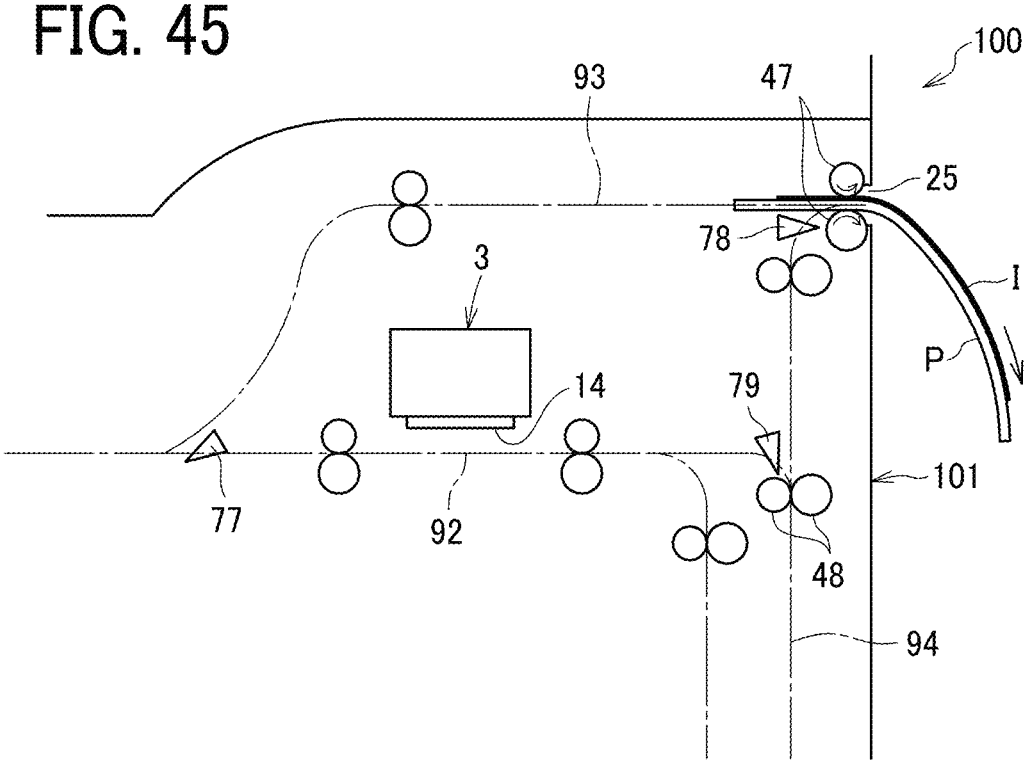
FIG. 45 is a diagram illustrating the sheet conveying operation subsequent from FIG. 44.
Figure 46:
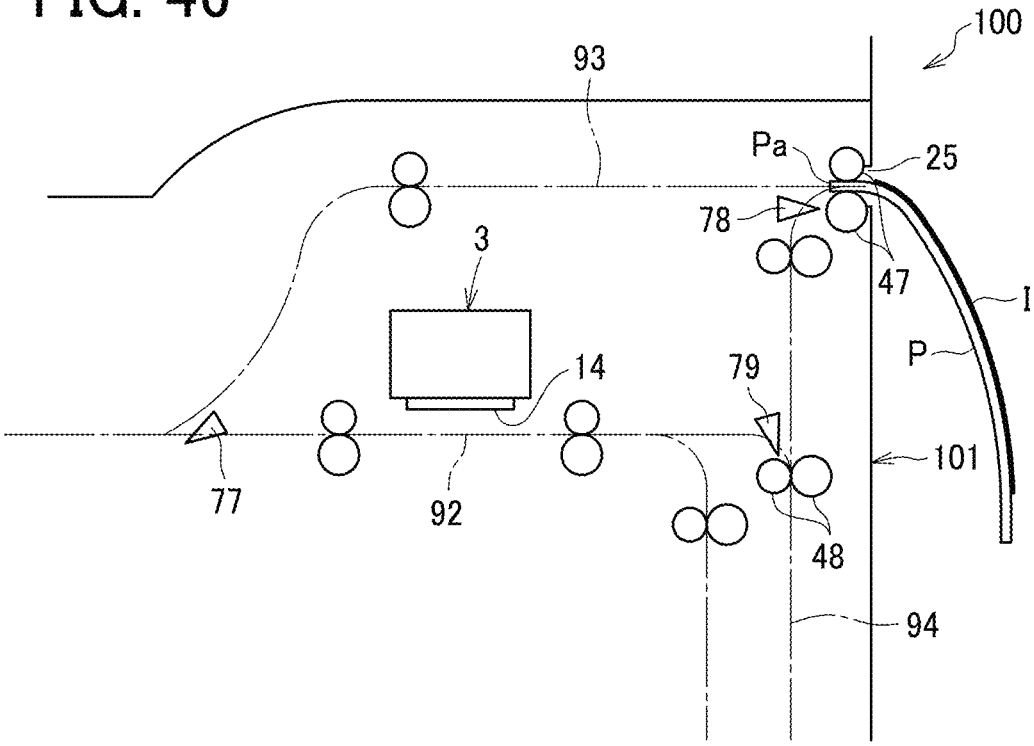
FIG. 46 is a diagram illustrating the sheet conveying operation subsequent from FIG. 45.

In a case in which the sheet P is exposed to the outside of the image forming apparatus 100 after an image is formed on the sheet P, after the trailing end Pb of the sheet P has passed a first passage changer 77 that is disposed downstream from the image forming device 3 in the sheet conveyance direction, the first passage changer 77 changes the sheet conveyance passage in which the sheet P is conveyed, in other words, the first passage changer 77 changes the direction of conveyance of the sheet P, as illustrated in FIG. 43. In this state, the sheet P is conveyed in the opposite direction opposite the sheet conveyance direction. By so doing, as illustrated in FIG. 44, the sheet P is guided to a sheet exposure conveyance passage 93. Then, as illustrated in FIG. 45, the pair of sheet conveying rollers 47 that functions as a sheet conveyor disposed at the opening 25 is rotated to expose the sheet P to the outside of the image forming apparatus 100 via the opening 25. Then, as illustrated in FIG. 46, rotation of the pair of sheet conveying rollers 47 is stopped before or immediately before the leading end Pa of the sheet P passes through the nip region of the pair of sheet conveying rollers 47. Accordingly, while being exposed via the opening 25 to the outside of the image forming apparatus 100, the sheet P is held by the pair of sheet conveying rollers 47. Note that, in this case, the image forming surface (that is, the liquid applied face on which the ink I is applied) of the sheet P is disposed facing up.

Figure 47:
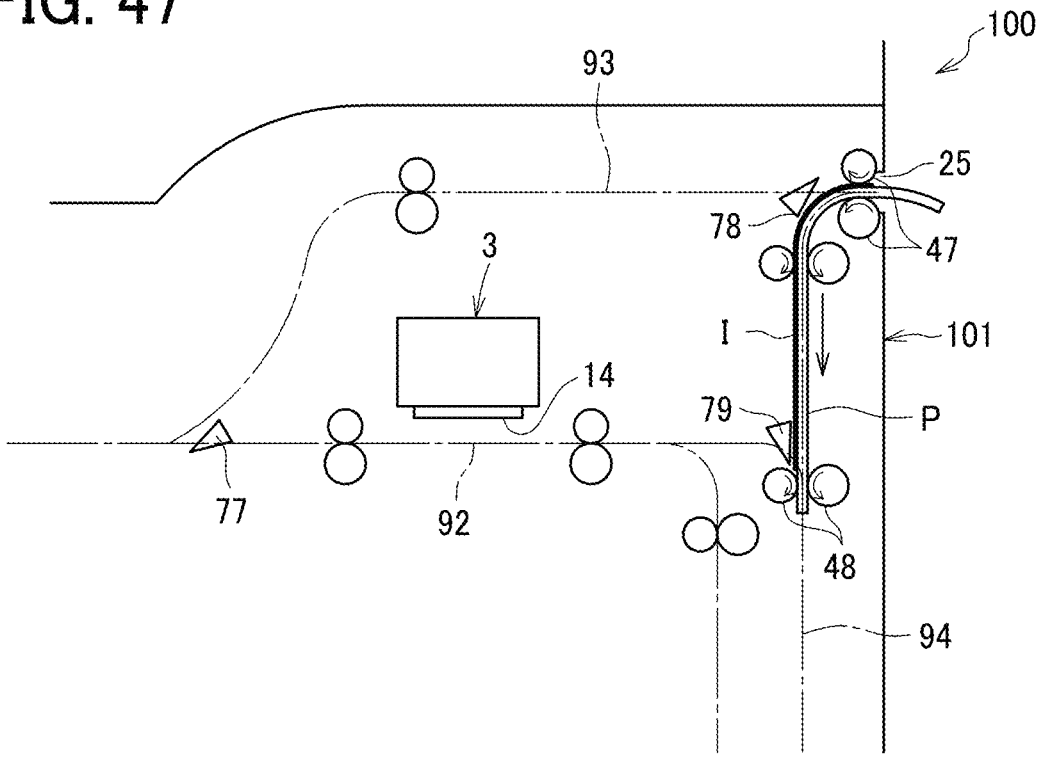
FIG. 47 is a diagram illustrating the sheet conveying operation subsequent from FIG. 46.
Figure 48:
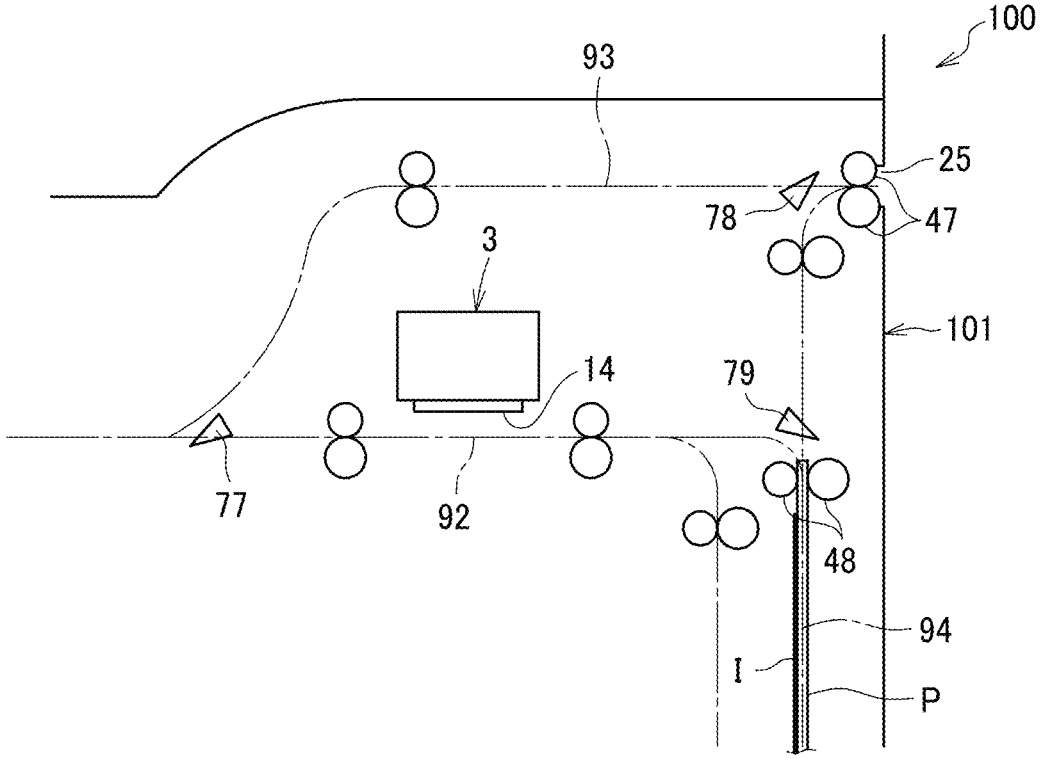
FIG. 48 is a diagram illustrating the sheet conveying operation subsequent from FIG. 47.
Figure 49:
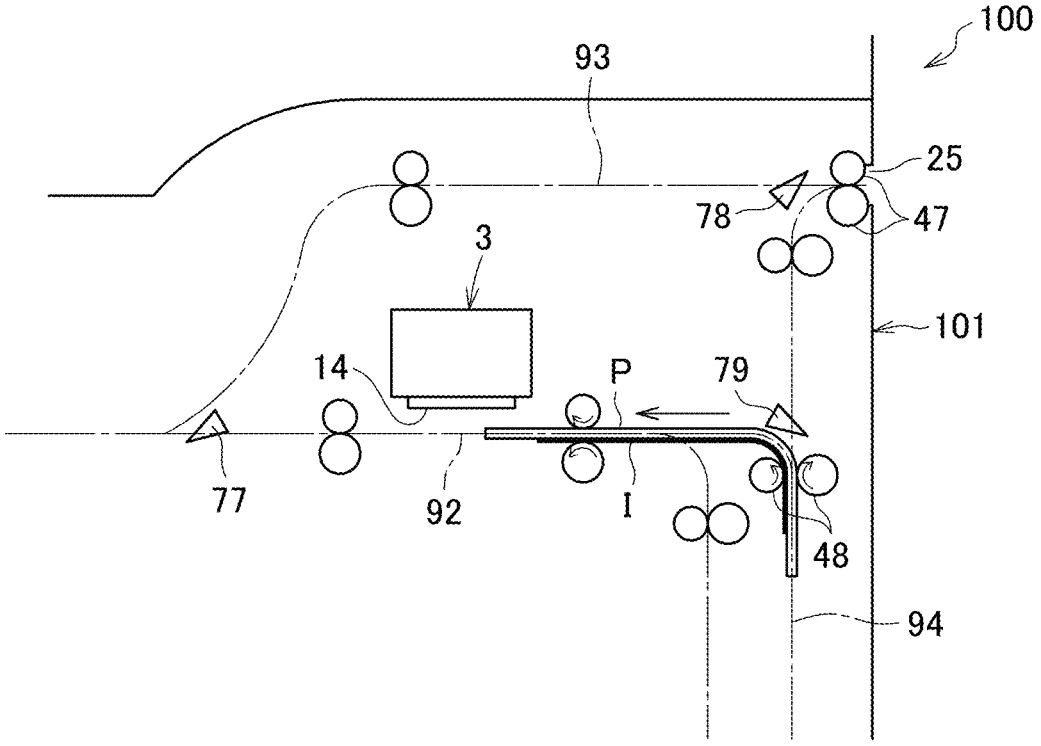
FIG. 49 is a diagram illustrating the sheet conveying operation subsequent from FIG. 48.

Thereafter, as illustrated in FIG. 47, a second passage changer 78 changes the sheet conveyance passage, in other words, the second passage changer 78 changes the direction of conveyance of the sheet P, and the pair of sheet conveying rollers 47 is rotated in the reverse direction opposite the normal direction to guide the sheet P to a sheet reverse passage 94. Consequently, as illustrated in FIG. 48, at the timing at which the trailing end Pb of the sheet P passes a third passage changer 79, conveyance of the sheet P is stopped so that the third passage changer 79 changes the sheet conveyance passage to the sheet conveyance passage 92 toward the image forming device 3. Thereafter, as illustrated in FIG. 49, a pair of sheet conveying rollers 48 disposed in the sheet reverse passage 94 is rotated in the reverse direction opposite the normal direction, so as to convey the sheet P toward the image forming device 3. By so doing, the sheet P is conveyed to the image forming device 3 while the sheet P is reversed upside down. Then, as an image formation in the duplex printing is requested, another image is formed on the other face (back face) of the sheet P. Thereafter, the sheet P is selectively guided by a fourth passage changer 70 (see FIG. 42) to a sheet conveyance passage 95 toward the sheet ejection tray 20 or to a sheet conveyance passage 96 toward the sheet alignment apparatus 200.

As described above, by applying the present disclosure to the image forming apparatus 100 illustrated in FIG. 42, the sheet P is exposed to the outside of the image forming apparatus 100 via the opening 25 provided to the housing 101 of the image forming apparatus 100. Accordingly, the ink on the sheet P is dried effectively.

Figure 50A:
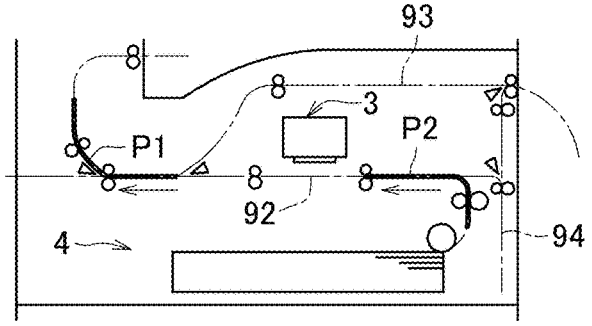
FIGS. 50A, 50B, 50C, 50D and 50E are diagrams each illustrating the sheet conveying operation subsequent from FIG. 49.
Figure 50B:
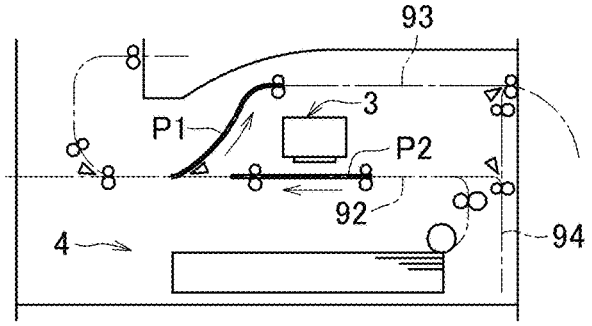
Figure 50C:
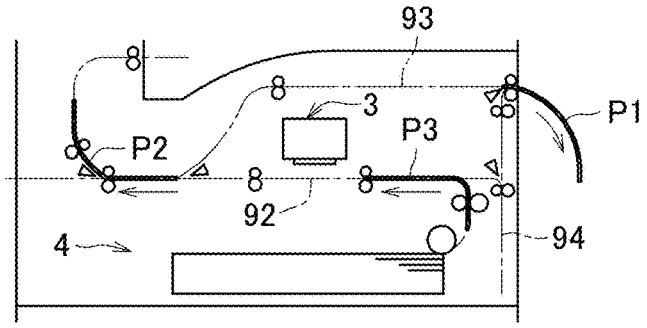
Figure 50D:
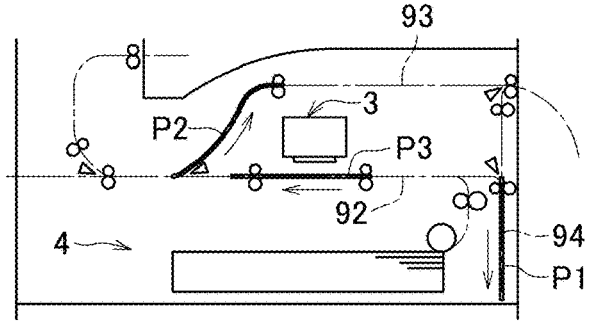
Figure 50E:
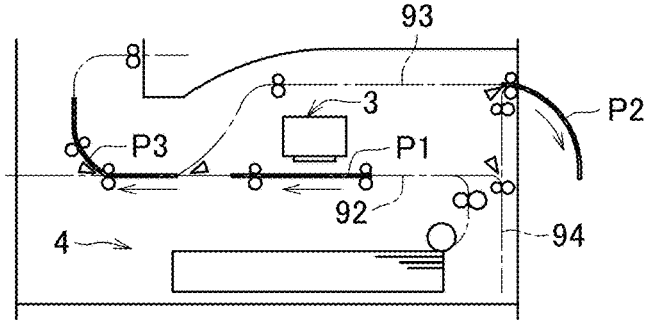

Further, FIGS. 50A to 50E illustrate respective states in which three sheets, which are a first sheet P1, a second sheet P2, and a third sheet P3, are serially conveyed in the image forming apparatus 100 illustrated in FIG. 42. The three sheets, i.e., the first sheet P1, the second sheet P2, and the third sheet P3 are conveyed in the order of FIGS. 50A, 50B, 50C, 50D, and 50E. In particular, the sheet exposure conveyance passage 93 to guide the sheet p to the opening 25 and the sheet reverse passage 94 to reverse the exposed sheet P upside down are disposed not to overlap the sheet conveyance passage 92 to feed the sheet P from the sheet feeding device 4 to the image forming device 3. This configuration enhances the productivity of the image forming apparatus 100. That is, as illustrated in FIGS. 50C and 50D, when the third sheet P3 is fed to the image forming device 3, the third sheet P3 does not interfere with the first sheet P1 that is conveyed to the sheet exposure conveyance passage 93 or the sheet reverse passage 94. Therefore, the third sheet P3 is fed without standing by until the first sheet P1 passes through the image forming device 3 again.

Figure 51:
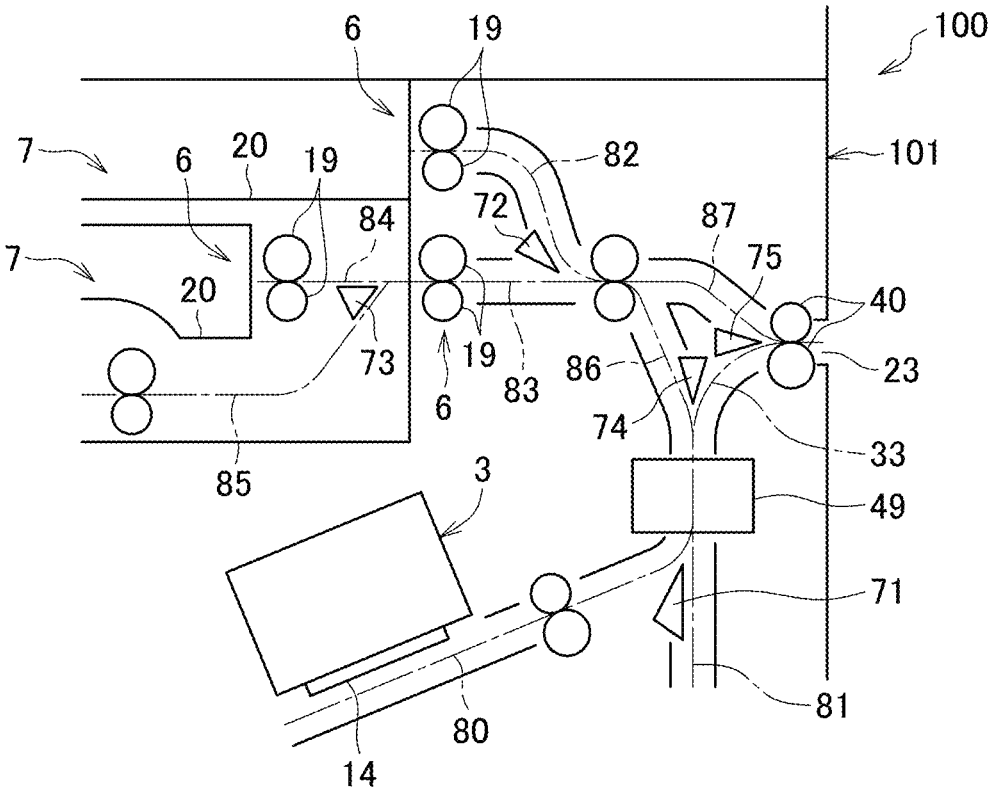
FIG. 51 is a diagram illustrating the image forming apparatus provided with a drying device.

Further, FIG. 51 is a diagram illustrating the image forming apparatus provided with a drying device.

The present disclosure may be applied to the image forming apparatus 100 including a drying device 49 as illustrated in FIG. 51. The image forming apparatus 100 illustrated in FIG. 51 basically has the identical configuration to the configuration of the image forming apparatus 100 illustrated in FIG. 13. Different from the image forming apparatus 100 illustrated in FIG. 13, the image forming apparatus 100 illustrated in FIG. 51 further includes the drying device 49 in the middle of the sheet conveyance passage via which the sheet P is conveyed from the image forming device 3 to the opening 23 or the sheet ejecting device 6. Various types of drying device are applicable to the drying device 49. For example, the drying device 49 may be a drying device having a configuration in which a heat roller heated by a heater comes to contact with a sheet or a warm air generating device that blows warm air is blown to a sheet.

In the image forming apparatus 100 including the drying device 49, the sheet is heated by the drying device 49 to easily dry water (moisture) in the ink on the sheet. Therefore, since the image forming apparatus 100 according to the present embodiment includes the opening 23 provided in the housing 101 to expose the sheet P heated by the drying device 49 to the outside of the image forming apparatus 100 via the opening 23, water (moisture) evaporated from the ink on the sheet P is effectively ejected to the outside of the image forming apparatus 100. Accordingly, the image forming apparatus 100 reduces evaporated water (moisture) floating in the housing 101, and therefore the drying of ink on the sheet P is further accelerated. Further, while the sheet P is exposed to the outside of the image forming apparatus 100 via the opening 23, heat in the sheet P goes to the outside of the housing 101 of the image forming apparatus 100, thereby lowering the temperature of sheet P. Note that the image forming apparatus 100 according to the present embodiment performs the sheet conveying operation in which the sheet P is exposed to the outside of the image forming apparatus 100 and the sheet conveying operation is same as sheet conveying operation performed in the image forming apparatus 100 illustrated in FIGS. 14 to 17. Accordingly, the description of the sheet conveying operation performed in the image forming apparatus 100 according to the present embodiment is omitted here.

Figure 52:
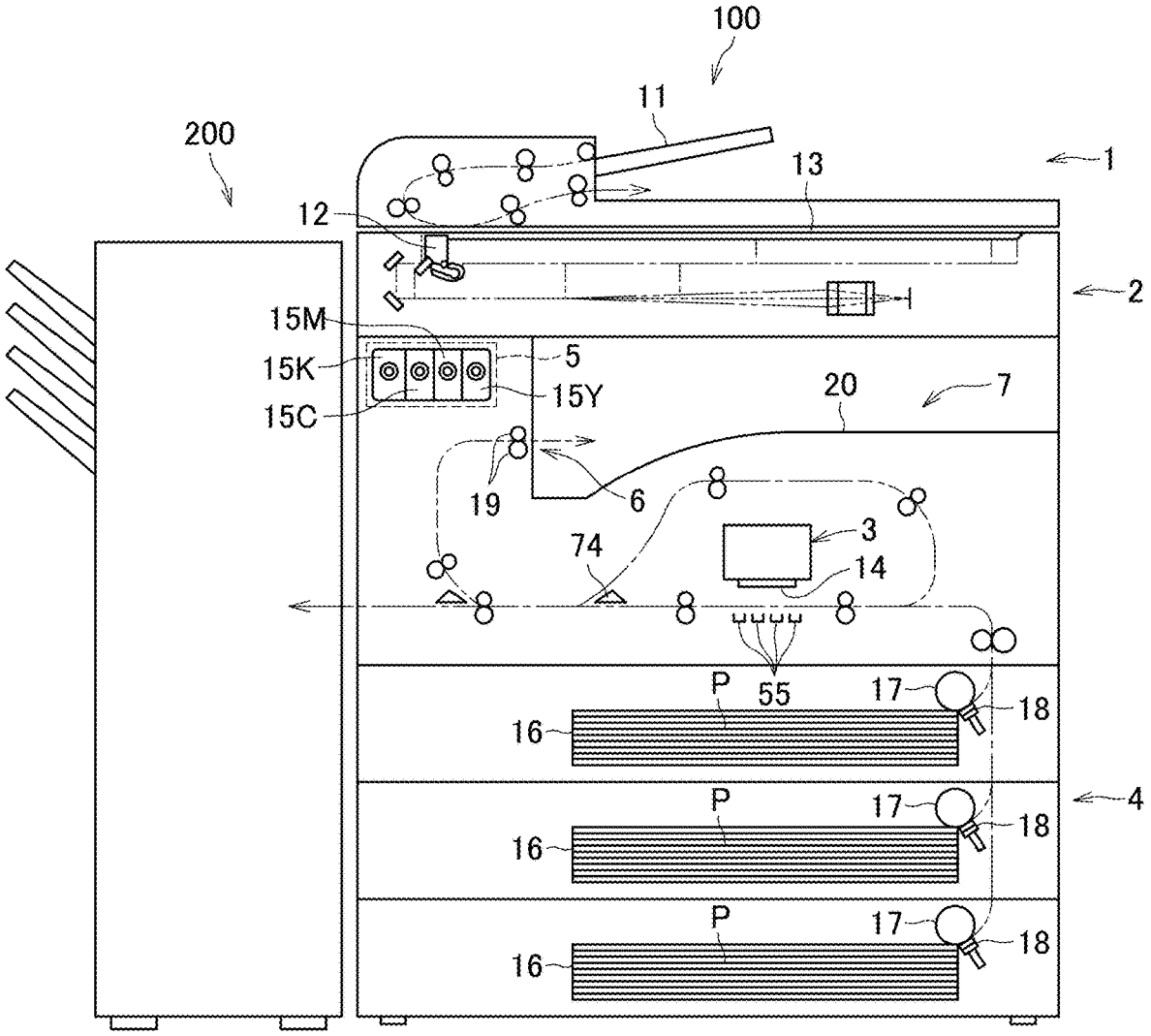
FIG. 52 is a diagram illustrating the configuration of yet another image forming apparatus.

FIG. 52 is a diagram illustrating the configuration of yet another image forming apparatus different from the image forming apparatuses according to the above-described embodiments.

As in the above-described embodiments, the image forming apparatus 100 illustrated in FIG. 52 includes the original document conveying device 1, the image reading device 2, the image forming device 3, the sheet feeding device 4, the cartridge container 5, the sheet ejecting device 6, and the sheet stacker 7. Different from the above-described embodiments, the image forming apparatus 100 illustrated in FIG. 52 further includes caps 55 that cover liquid discharge ports of respective liquid discharge heads 14.

Figure 53:
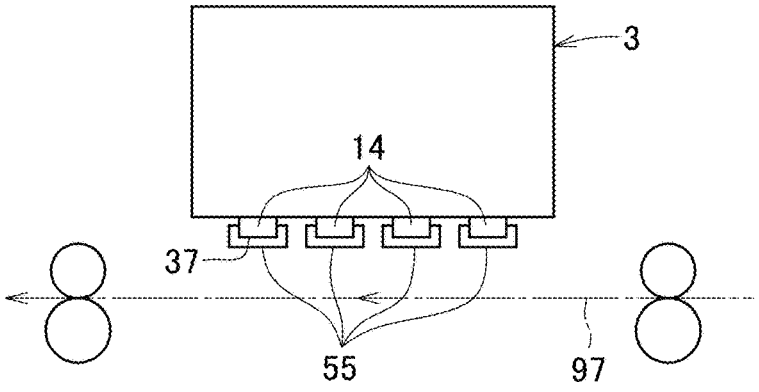
FIG. 53 is a diagram illustrating caps each of which covering respective discharging ports of liquid discharge heads.

FIG. 53 is a diagram illustrating caps each of which covering respective discharging ports of liquid discharge heads.

Figure 54:
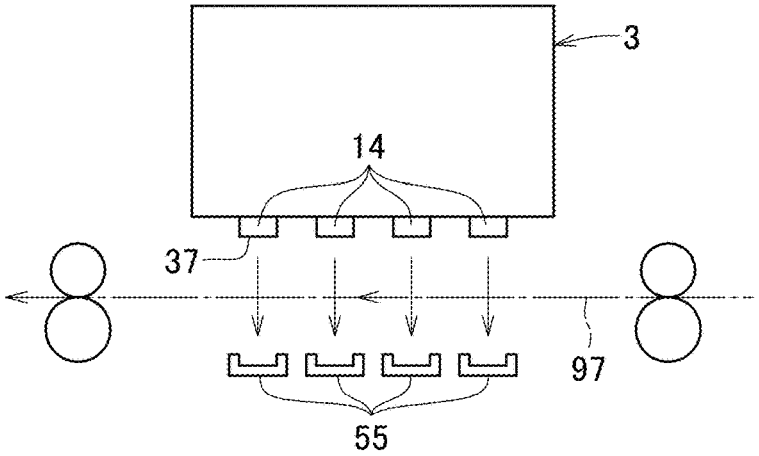
FIG. 54 is a diagram illustrating a state in which the caps are separated from the liquid discharge heads.

FIG. 54 is a diagram illustrating a state in which the caps are separated from the liquid discharge heads.

Figure 55:
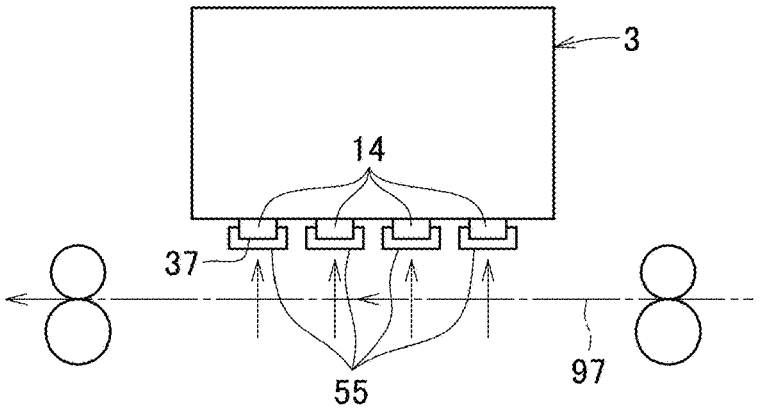
FIG. 55 is a diagram illustrating a state in which the caps approach the liquid discharge heads to close the respective discharging ports.

FIG. 55 is a diagram illustrating a state in which the caps approach the liquid discharge heads to close the respective discharging ports.

As illustrated in FIG. 53, the liquid discharge heads 14 have respective (four) liquid discharge ports 37 from which inks of different colors, e.g., yellow, magenta, cyan, and black, are discharged. The four caps 55 are provided to the respective liquid discharge ports 37 to cover the respective liquid discharge ports 37. Note that the caps 55 may be a single cap that is capable of covering the whole liquid discharge ports 37.

As an image formation instruction is issued, as illustrated in FIG. 54, the caps 55 are separated from the respective liquid discharge ports 37 to be disposed on the opposite side opposite the liquid discharge heads 14 across a sheet conveyance passage 97 that faces the liquid discharge heads 14. In this state, the liquid discharge heads 14 enters the open state in which the liquid discharge heads 14 discharge inks of different colors from the respective liquid discharge ports 37, so that an image is formed on a sheet conveyed from upstream in the sheet conveyance direction.

By contrast, when the printing operation is finished, as illustrated in FIG. 55, the caps 55 approach the liquid discharge heads 14 to cover the liquid discharge ports 37. Accordingly, the liquid discharge ports 37 are closed (in a closed state). Further, since the liquid discharge ports 37 are covered by the caps 55, drying of the liquid discharge ports 37 is restrained, thereby reducing occurrence of an ink discharge failure that might be caused due to the drying of the liquid discharge ports 37. Further, in the present embodiment, each cap 55 is movable to approach and separate from each liquid discharge port 37 in a direction orthogonal to the sheet conveyance direction (i.e., the direction of the sheet conveyance passage 97). According to this configuration, the amount of movement of each cap 55 is reduced to the minimum amount, so that each cap 55 is easily positioned to each liquid discharge port 37.

Figure 56:
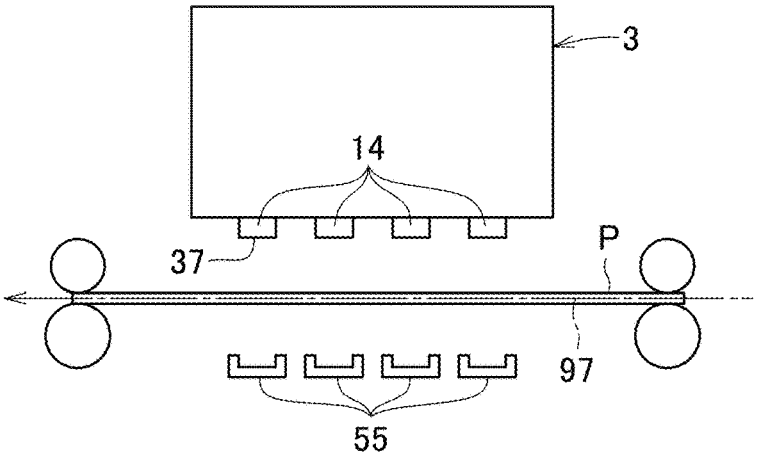
FIG. 56 is a diagram illustrating a state in which the sheet is interposed between the caps and the liquid discharge heads.

Further, FIG. 56 is a diagram illustrating a state in which the sheet is interposed between the caps and the liquid discharge heads.

In a case in which a sheet conveyance failure, paper jam, or any other failure occurs in the middle of the printing operation, the printing operation may be interrupted. In such a case, the sheet conveyance is also interrupted temporarily, and therefore the sheet P may be interposed between the caps 55 and the liquid discharge heads 14, as illustrated in FIG. 56. In this case, the caps 55 cannot approach the liquid discharge heads 14, and therefore cannot cover the liquid discharge ports 37. If the caps 55 and the liquid discharge ports 37 are left in this state, the liquid discharge ports 37 may be dried. Therefore, when the printing operation starts again, the ink discharge failure is likely to occur.

Therefore, in order to prevent occurrence of the ink discharge failure caused by not covering the liquid discharge ports 37, the image forming apparatus 100 according to the present embodiment takes the following measures.

Figure 57:
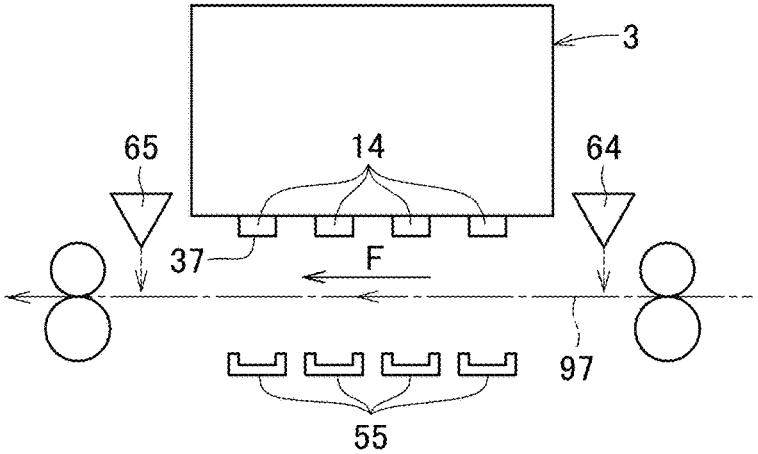
FIG. 57 is a diagram illustrating sheet sensors provided to detect the sheet.

FIG. 57 is a diagram illustrating sheet sensors provided to detect the sheet.

Figure 58:
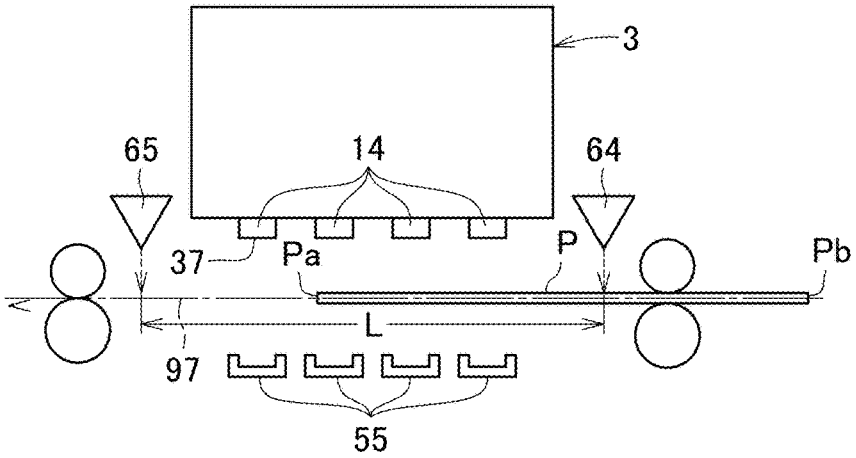
FIG. 58 is a diagram illustrating a state in which at least the leading end of the sheet is interposed between the caps and the liquid discharge heads.

FIG. 58 is a diagram illustrating a state in which at least the leading end of the sheet interposes between the caps and the liquid discharge heads.

Figure 59:
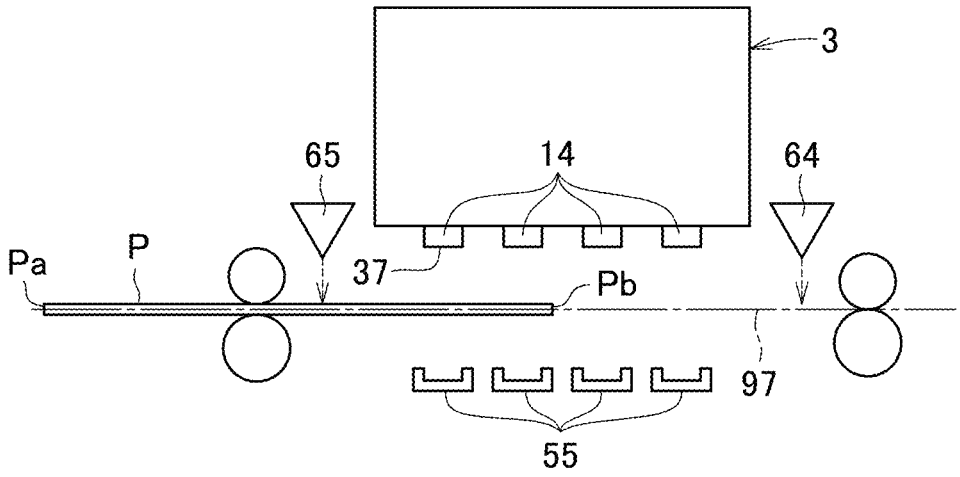
FIG. 59 is a diagram illustrating a state in which at least the trailing end of the sheet is interposed between the caps and the liquid discharge heads.

FIG. 59 is a diagram illustrating a state in which at least the trailing end of the sheet is interposed between the caps and the liquid discharge heads.

First, the image forming apparatus 100 according to the present embodiment includes two sheet sensors, which are sheet sensors 64 and 65 each functioning as a detector to detect the sheet, in order to grasp whether there is a sheet between the caps 55 and the liquid discharge heads 14, as illustrated in FIG. 57. Of the two sheet sensors, the sheet sensor 64 is disposed upstream from the liquid discharge heads 14 (or the caps 55) in a sheet conveyance direction F and the sheet sensor 65 is disposed downstream from the liquid discharge heads 14 (or the caps 55) in the sheet conveyance direction F. Note that the "sheet conveyance direction" here indicates a sheet conveyance direction in which the sheet is conveyed in the regular image forming operation. Similarly, the "sheet conveyance direction" and the "conveyance direction" described below also indicate the sheet conveyance direction in which the sheet is conveyed in the regular image forming operation. Each of the sheet sensors 64 and 65 is, for example, a reflection type optical sensor or a transmission type optical sensor and detects passage of the leading end of the sheet or the trailing end of the sheet, so as to grasp whether there is a sheet between the caps 55 and the liquid discharge heads 14.

For example, as illustrated in FIG. 58, in a case in which the leading end Pa of the sheet P does not pass the sheet sensor 65 on the downstream side within the regular sheet conveyance time after the leading end Pa of the sheet P has passed the sheet sensor 64 on the upstream side, it is determined that at least the leading end Pa of the sheet P is interposed between the caps 55 and the liquid discharge heads 14. Hereinafter, the sheet sensor 64 on the upstream side is referred to as a first sheet sensor 64 and the sheet sensor 65 on the downstream side is referred to as a second sheet sensor 65. Here, whether or not the sheet P has passed between the first sheet sensor 64 and the second sheet sensor 65 within the regular sheet conveyance time is calculated based on a distance L between (the detection position of) the first sheet sensor 64 and (the detection position of) the second sheet sensor 65 and the conveying speed of the sheet P.

Further, as illustrated in FIG. 59, in a case in which the leading end Pa of the sheet P has passed the second sheet sensor 65 and the trailing end Pb of the sheet P has not passed the second sheet sensor 65 within the regular sheet conveyance time, it is determined that at least the trailing end Pb of the sheet P is interposed between the caps 55 and the liquid discharge heads 14.

As described above, when it is determined that there is the sheet P between the caps 55 and the liquid discharge heads 14, in the present embodiment, the sheet P that is interposed between the caps 55 and the liquid discharge ports 37 is moved upstream or downstream in the sheet conveyance direction F so that the caps 55 are attached to the liquid discharge ports 37 of the liquid discharge heads 14. Hereinafter, a description is given of a control flow to move the sheet, with reference to FIG. 60.

Figure 60:
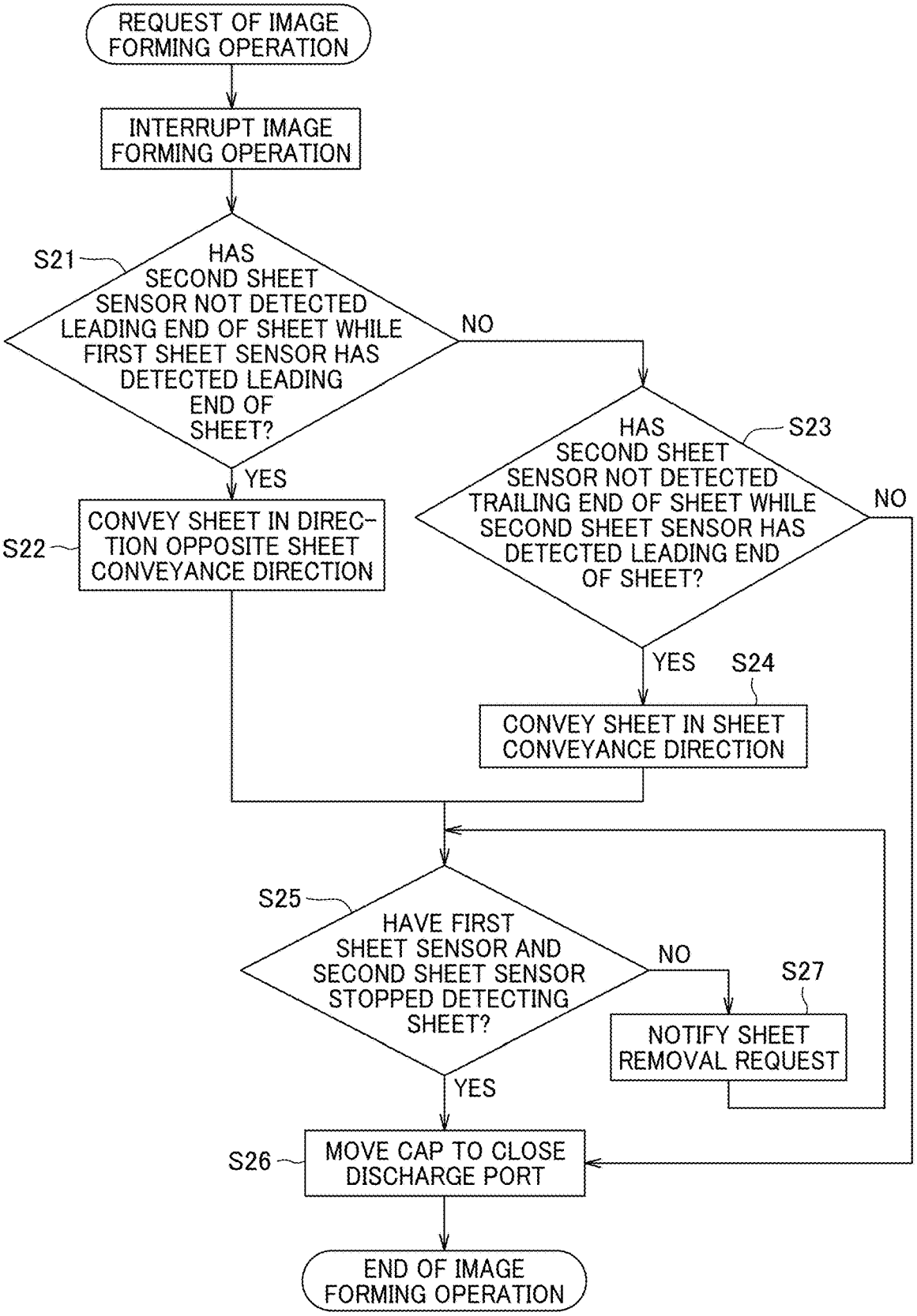
FIG. 60 is a flowchart illustrating the control flow to move the sheet from the portion between the caps and the liquid discharge heads.

FIG. 60 is a flowchart illustrating the control flow to move the sheet from the portion between the caps and the liquid discharge heads.

Figure 61:
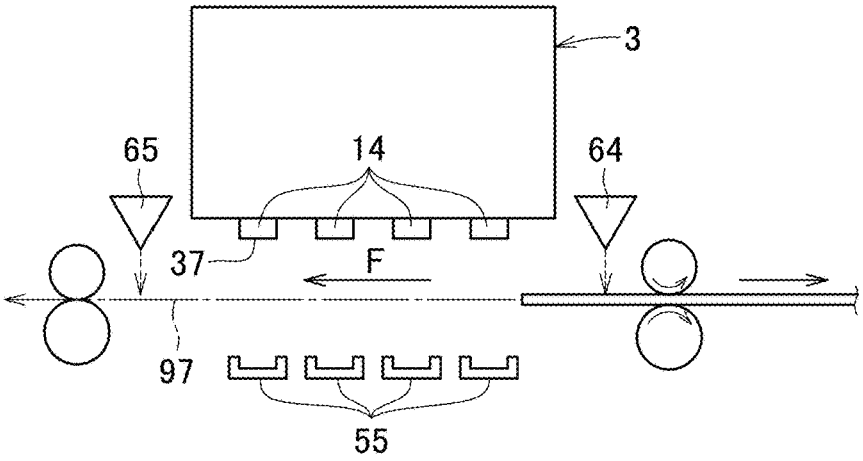
FIG. 61 is a diagram illustrating a state in which the sheet is conveyed toward upstream in the sheet conveyance direction.

FIG. 61 is a diagram illustrating a state in which the sheet is conveyed toward upstream in the sheet conveyance direction.

Figure 62:
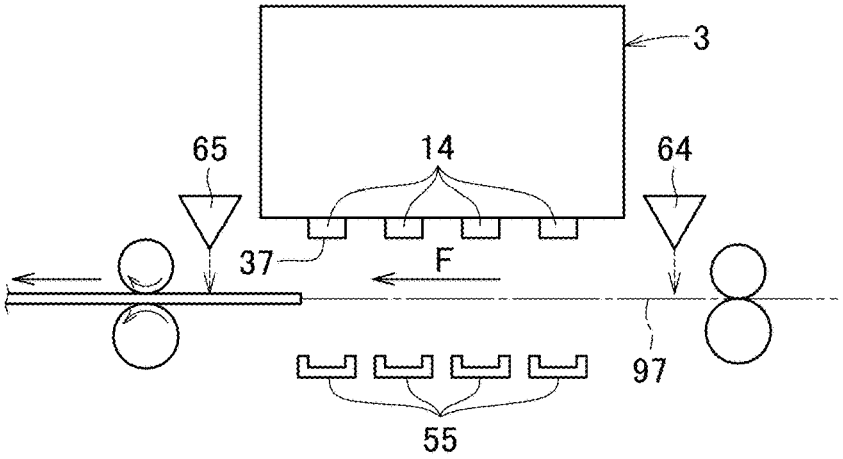
FIG. 62 is a diagram illustrating a state in which the sheet is conveyed toward downstream in the sheet conveyance direction.

FIG. 62 is a diagram illustrating a state in which the sheet is conveyed toward downstream in the sheet conveyance direction.

As illustrated in FIG. 60, in the present embodiment, in a case in which an image formation command is issued and then the printing operation is interrupted due to a failure such as paper jam, it is first checked whether the sheet P is interposed between the caps 55 and the liquid discharge heads 14. To be more specific, it is first checked whether or not the position of the sheet P is in the state illustrated in FIG. 58, based on the detection signal of the first sheet sensor 64 and the detection signal of the second sheet sensor 65. That is, after the first sheet sensor 64 has detected the leading end of the sheet P, it is determined whether or not the second sheet sensor 65 has not detected the leading end of the sheet P within the regular sheet conveyance time (step S21 in the flowchart of FIG. 60).

As a result, when the first sheet sensor 64 has detected the leading end of the sheet P and the second sheet sensor 65 has not detected the leading end of the sheet P (YES in step S21 in the flowchart of FIG. 60), it is determined that at least the leading end of the sheet P is interposed between the caps 55 and the liquid discharge heads 14, and the sheet P is moved in the opposite direction opposite the sheet conveyance direction F, as illustrated in FIG. 61, so as to retract the sheet P from the position between the caps 55 and the liquid discharge heads 14 (step S22 in the flowchart of FIG. 60). Here, the sheet P is moved not to the sheet conveyance direction F but to the opposite direction opposite the sheet conveyance direction F, which is likely that the distance to retract the sheet P is relatively short. Note that the direction to move the sheet is not limited to the opposite direction to the sheet conveyance direction F. That is, the sheet P may be moved in the sheet conveyance direction F regardless of the above-described reason.

On the other hand, when the first sheet sensor 64 has detected the leading end of the sheet P and the second sheet sensor 65 has also detected the leading end of the sheet P (NO in step S21 in the flowchart of FIG. 60), it is further determined whether or not the second sheet sensor 65 has detected the trailing end of the sheet P within the regular sheet conveyance time (step S23 in the flowchart of FIG. 60). To be more specific, it is determined whether or not the position of the sheet P is in the state illustrated in FIG. 59.

As a result, when the second sheet sensor 65 has detected the leading end of the sheet P and has not detected the trailing end of the sheet P (YES in step S23 in the flowchart of FIG. 60), it is determined that at least the trailing end of the sheet P is interposed between the caps 55 and the liquid discharge heads 14, and the sheet P is moved in the sheet conveyance direction F, as illustrated in FIG. 62, so as to retract the sheet P from the position between the caps 55 and the liquid discharge heads 14 (step S24 in the flowchart of FIG. 60). Here, the sheet P is moved to the sheet conveyance direction F, which is likely that the distance to retract the sheet P is relatively short. Note that the direction to move the sheet is not limited to the sheet conveyance direction F regardless of the above-described reason. For example, in a case in which the leading end of the sheet P is caught in the sheet conveyance passage, the sheet P may be moved in the opposite direction opposite the sheet conveyance direction F.

On the other hand, when the second sheet sensor 65 has detected the leading end of the sheet P and the trailing end of the sheet P (NO in step S23 in the flowchart of FIG. 60), it is determined that there is no sheet between the caps 55 and the liquid discharge heads 14. Then, the caps 55 are moved to the liquid discharge heads 14 to cover and close the liquid discharge ports 37 by the caps 55 (step S26 in the flowchart of FIG. 60).

Further, as described above, when the sheet P interposed between the caps 55 and the liquid discharge heads 14 is moved in the sheet conveyance direction F or the opposite direction opposite the sheet conveyance direction F, the first sheet sensor 64 and the second sheet sensor 65 detect passage of the sheet P in order to check whether the sheet P is retracted from the position between the caps 55 and the liquid discharge heads 14. That is, it is determined whether or not both the first sheet sensor 64 and the second sheet sensor 65 have no longer detected the sheet P (step S25 in the flowchart of FIG. 60).

Then, when both the first sheet sensor 64 and the second sheet sensor 65 have no longer detected the sheet P (YES in step S25 in FIG. 60), it is determined that the sheet P is retracted from the position between the caps 55 and the liquid discharge heads 14. Then, the caps 55 are moved toward the liquid discharge heads 14 to cover and close the liquid discharge ports 37 by the caps 55 (step S26 in the flowchart of FIG. 60).

Then, when at least one of the first sheet sensor 64 and the second sheet sensor 65 has detected the sheet P (NO in step S25 in FIG. 60), it is determined that the sheet P is not retracted from the position between the caps 55 and the liquid discharge heads 14, and the request removal of the sheet P is notified to a user (step S27 in the flowchart of FIG. 60). Then, when both the first sheet sensor 64 and the second sheet sensor 65 have no longer detected the sheet P after the sheet P is removed by the user, the caps 55 are moved toward the liquid discharge heads 14 to cover and close the liquid discharge ports 37 by the caps 55 (step S26 in the flowchart of FIG. 60).

As described above, even if the image forming operation is interrupted while the sheet P is stopped between the caps 55 and the liquid discharge heads 14, the image forming apparatus 100 according to the present embodiment causes the sheet P to move and retract from the position between the caps 55 and the liquid discharge heads 14, so that the caps 55 close the liquid discharge ports 37. By so doing, even if the image forming operation is interrupted, the drying of the liquid discharge ports 37 is restrained and occurrence of an ink discharge failure that might be caused by the drying of the liquid discharge ports 37 is reduced.

Further, when the sheet P between the caps 55 and the liquid discharge heads 14 (hereinafter, the sheet P is referred to as an "interposed sheet") is moved, it is likely that there is another sheet (hereinafter, a "second sheet") in the direction in which the sheet P is moved. In this case, in order to move the interposed sheet reliably, it is preferable that the second sheet is moved in the direction in which the interposed sheet is moved, so as to avoid interference of the interposed sheet with the second sheet. Further, in a case in which the second sheet cannot be moved, in order to move the caps 55 to the liquid discharge heads 14, the interposed sheet may be forcibly moved toward the second sheet. In this case, the interposed sheet interposes with the second sheet, which might result in deformation of at least one of the interposed sheet and the second sheet folded in a bellows-like shape. Therefore, in order to contain a sheet folded in a bellows-like shape, the sheet conveyance passage into which the sheet is moved preferably has an interval (space in the sheet thickness direction) greater than the interval (space in the sheet thickness direction) of the regular sheet conveyance passage.

Figure 63:
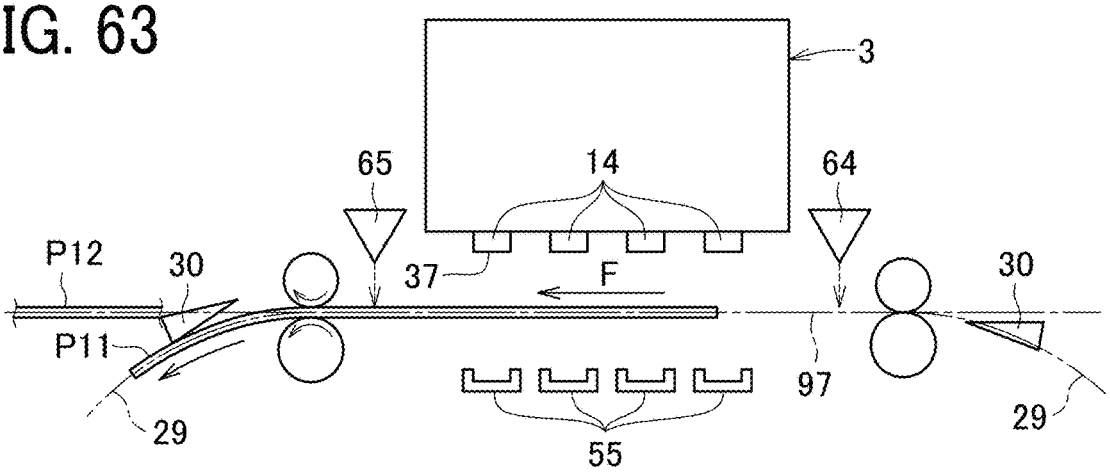
FIG. 63 is a diagram illustrating a state in which the sheet is conveyed to a sheet retraction passage.

Further, FIG. 63 is a diagram illustrating a state in which the sheet is conveyed to a sheet retraction passage.

As in the example illustrated in FIG. 63, the image forming apparatus 100 may include sheet retraction passages (retraction spaces) 29 that branches from the regular sheet conveyance passage 97 so that an interposed sheet P11 is moved without interfering with a second sheet P12. In this example, the sheet retraction passages 29 are provided upstream and downstream from the liquid discharge heads 14 in the sheet conveyance direction F. However, a single sheet retraction passage 29 may be provided either upstream or downstream from the liquid discharge heads 14 in the sheet conveyance direction F.

As illustrated in FIG. 63, in a case in which the interposed sheet P11 is moved to one of the sheet retraction passages 29, a corresponding one of passage changers 30 changes the sheet conveyance passage to move the interposed sheet P11 to the sheet retraction passages 29. The passage changers 30 are provided at the positions from which the sheet retraction passages 29 branch. Accordingly, the interposed sheet P11 is retracted from the position between the caps 55 and the liquid discharge heads 14 reliably without interfering the interposed sheet P11 with the second sheet P12. Each of the sheet retraction passages 29 may have the same interval (space in the sheet thickness) as the interval of the regular sheet conveyance passage 97. However, it is more preferable that each of the sheet retraction passages 29 has the interval greater than the interval of the regular sheet conveyance passage 97 so that each of the sheet retraction passage 29 is capable of containing the interposed sheet P11 folded in a bellows-like shape.

Figure 64:
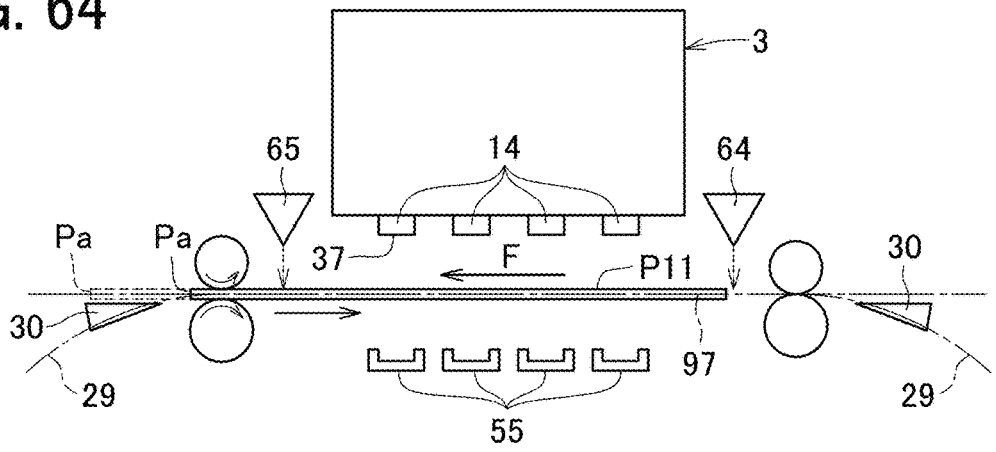
FIG. 64 is a diagram illustrating a state in which the sheet is moved backward temporarily and then to the sheet retraction passage.

Further, FIG. 64 is a diagram illustrating a state in which the sheet is moved backward temporarily and then to the sheet retraction passages.

As illustrated by a broken line in FIG. 64, in a case in which conveyance of the sheet P is interrupted while the leading end Pa of the interposed sheet P11 has passed the branching point of the downstream sheet retraction passage 29 (the downstream passage changer 30), the interposed sheet P11 may be temporarily moved in the opposite direction opposite the sheet conveyance direction F, then the leading end Pa of the interposed sheet P11 may be moved upstream from the branching point of the downstream sheet retraction passage 29 (the downstream passage changer 30), and the interposed sheet P11 may be moved and guided in the sheet conveyance direction F to the sheet retraction passage 29.

Figure 65:
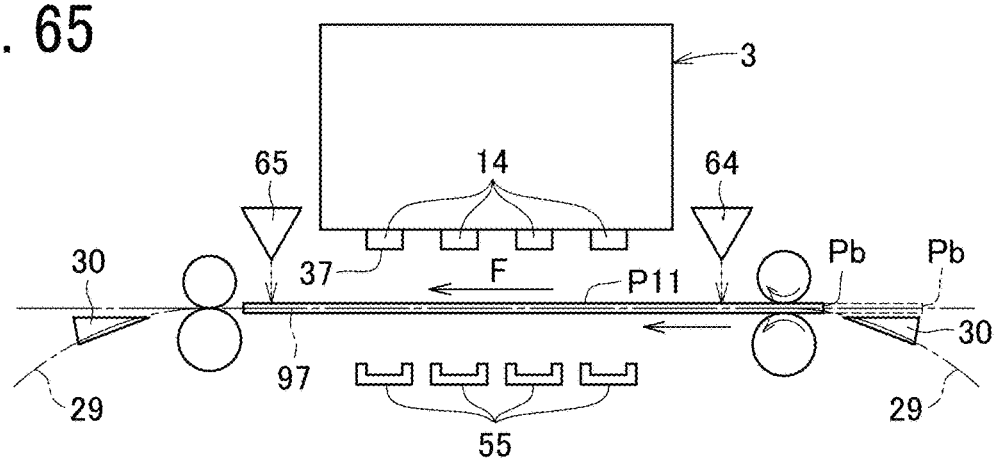
FIG. 65 is a diagram illustrating a state in which the sheet is moved forward temporarily and then to the sheet retraction passage.

Further, FIG. 65 is a diagram illustrating a state in which the sheet is moved forward temporarily and then to the sheet retraction passages.

As illustrated by a broken line in FIG. 65, in a case in which conveyance of the sheet P is interrupted before the leading end Pa of the interposed sheet P11 passes the branching point of the upstream sheet retraction passage 29 (the upstream passage changer 30), the interposed sheet P11 may be moved in the sheet conveyance direction F, then the trailing end Pb of the interposed sheet P11 may be moved downstream from the branching point of the upstream sheet retraction passage 29 (the upstream passage changer 30), and the interposed sheet P11 may be moved and guided in the opposite direction opposite the sheet conveyance direction F.

Figure 66:
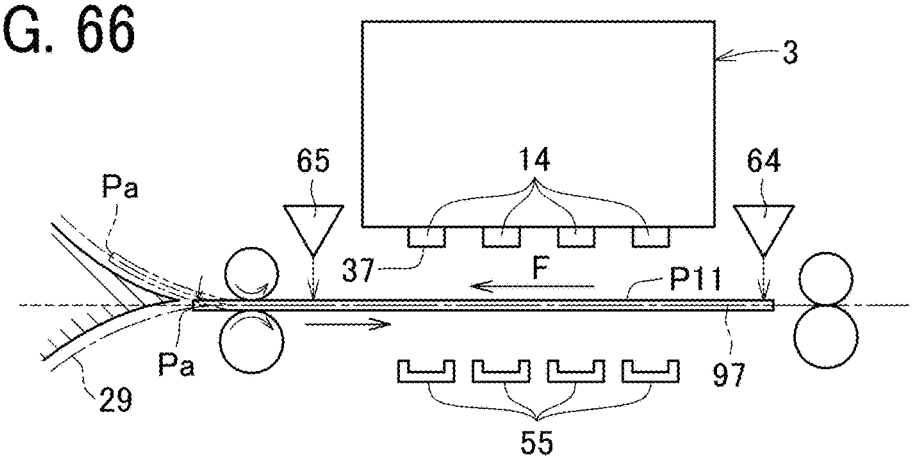
FIG. 66 is a diagram illustrating a state in which the sheet is guided to the retraction path using the resilience of a warped sheet.

FIG. 66 is a diagram illustrating a state in which the sheet is guided to the sheet retraction passage using the resilience of a warped sheet.

As in the example illustrated in FIG. 66, in a case in which the interposed sheet P11 is moved in the opposite direction opposite the sheet conveyance direction F, when the leading end of the interposed sheet P11 passes the branching point of the downstream sheet retraction passage 29, the leading end Pa of the interposed sheet P11 may face the downstream sheet retraction passage 29 due to the resilience of the warped interposed sheet P11 to return to the flat shape. That is, since the branching point of the downstream sheet retraction passage 29 is on the upper side from the extended line (indicated by a broken line) of the sheet conveyance passage 97 illustrated in FIG. 66, when the interposed sheet P11 is moved in the opposite direction opposite the sheet conveyance direction F, the leading end Pa of the interposed sheet P11 naturally comes to face the downstream sheet retraction passage 29. In this case, the image forming apparatus 100 having the configuration illustrated in FIG. 66 may not need to include the movable passage changer 30. Similarly, when the leading end of the interposed sheet P11 passes the branching point of the upstream sheet retraction passage 29, the leading end Pa of the interposed sheet P11 may be guided to the upstream sheet retraction passage 29 due to the resilience of the warped interposed sheet P11 to return to the flat shape.

Figure 67:
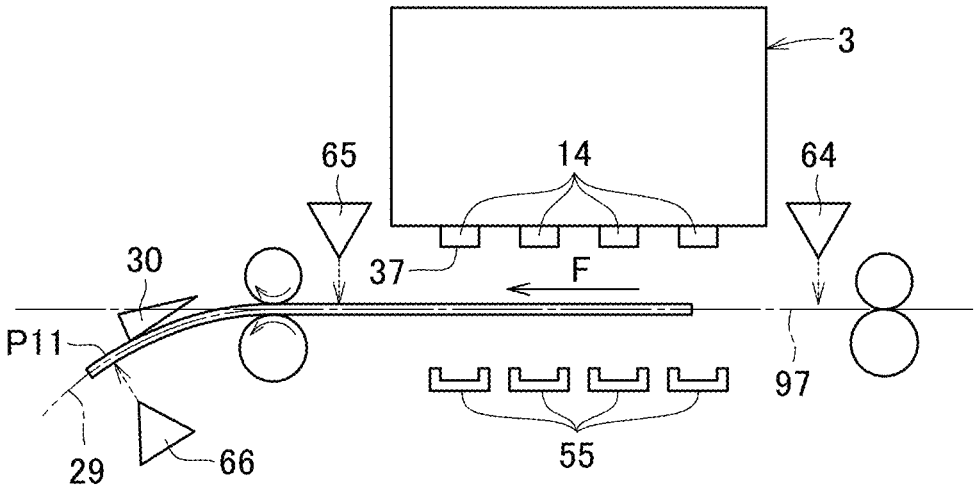
FIG. 67 is a diagram illustrating an example that the sheet sensor is disposed in the sheet retraction passage.

Further, FIG. 67 is a diagram illustrating an example that the sheet sensor is disposed in the sheet retraction passages.

As in the example illustrated in FIG. 67, a sheet sensor 66 may be disposed in the sheet retraction passage 29 (the downstream sheet retraction passage 29 in FIG. 67) to detect the sheet P. Accordingly, the sheet sensor 66 detects that the interposed sheet P11 is contained in the sheet retraction passage 29, and the caps 55 are moved to the liquid discharge heads 14 based on the detection signal of the sheet sensor 66. Further, when the sheet sensor 66 detects the interposed sheet P11, the detection of the sheet may be notified to a user to encourage removal of the interposed sheet P11 contained in the sheet retraction passage 29.

Figure 68:
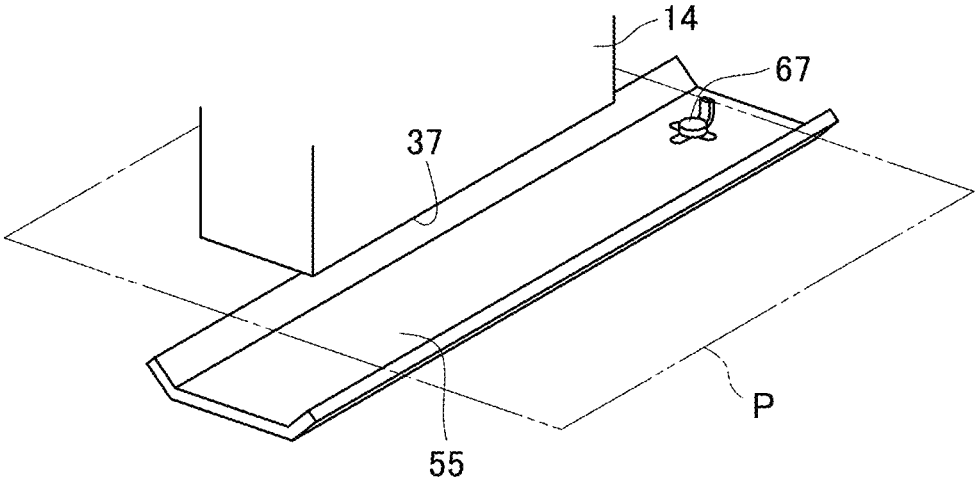
FIG. 68 is a diagram illustrating an example that the sheet sensor is disposed on the cap.

FIG. 68 is a diagram illustrating an example that the sheet sensor is disposed on the cap.

As in the example illustrated in FIG. 68, a sheet sensor 67 may be mounted on each cap 55 to detect the sheet P. In this case, since the sheet sensor 67 detects whether there is a sheet between each cap 55 and a corresponding liquid discharge head 14 more reliably, it is prevented that the cap 55 moves and comes to contact the interposed sheet P11. The sheet sensor 67 may be a contact type sensor that contacts a sheet when detecting the sheet or a non-contact type sensor that contacts a sheet without contacting the sheet. Further, when the sheet sensor 67 detects a sheet, movement of each cap 55 to the corresponding liquid discharge head 14 may be stopped and removal of the interposed sheet to a user may be notified.

Further, for the purpose of safety, the image forming apparatus may be provided with a lock mechanism so that a user cannot freely open a door provided to the housing of the image forming apparatus. Such a lock mechanism locks the door not to generally open except for a specified situation, e.g., replacement of a toner bottle and maintenance of the image forming apparatus. However, even if the caps 55 is movable to the liquid discharge head 14 again, such a lock mechanism prevents a user from removing the sheet jammed in the housing of the image forming apparatus, and therefore the image forming operation may not be restarted.

Therefore, after the cap 55 is movable to the liquid discharge head 14 again, the lock mechanism may be unlocked so that the user opens the door on the housing and removes the jammed sheet. Accordingly, the user removes the jammed sheet, restarting the printing operation. Further, unlocking the lock mechanism may be performed automatically based on the detection signals of the first sheet sensor 64 and the second sheet sensor 65 both detecting that the interposed sheet is retracted from the position of the caps 55 and the liquid discharge heads 14 or may be performed manually by the user who receives the notification based on the detection signals.

As described above, the embodiments of the image forming apparatus 100 having the configuration in which the sheet is retracted from the position between the caps 55 and the liquid discharge heads 14 have been described with reference to FIGS. 52 to 68. However, the image forming apparatus according to the present embodiment is not limited to the configuration illustrated in FIG. 52 but may be applied to the image forming apparatus illustrated in FIG. 1 or the image forming apparatus illustrated in FIG. 37.

Further, the configuration of the image forming apparatus 100 according to the present embodiment may be applied to the configuration in which the sheet is exposed to the outside of the image forming apparatus (the embodiments illustrated in FIGS. 1 to 51). In this case, the sheet interposed between the caps 55 and the liquid discharge heads 14 may be exposed to the outside of the image forming apparatus via the opening and then is ejected to the sheet ejection tray. Further, in this case, it may be selectively determined whether or not the sheet is exposed to the outside of the image forming apparatus according to the image area rate of the interposed sheet. For example, when the image area rate of the interposed sheet is equal to or greater than 50%, the interposed sheet may be exposed to the outside of the image forming apparatus and then ejected to the sheet ejection tray. On the other hand, when the image area rate of the interposed sheet is smaller than 50%, the interposed sheet may be ejected to the sheet ejection tray without being exposed to the outside of the image forming apparatus.

Further, note that the image forming apparatus according to the present disclosure is not limited to an apparatus to form an image on a sheet-like paper material but an apparatus to form an image on a sheet made of material other than a sheet-like paper material. Further, the sheet may be paper sheet, resin, metal, cloth, or leather. Further, the sheet may be a cut paper that is previously cut in the predetermined size in the sheet conveyance direction or a sheet roll that is a longitudinal-length sheet wound in a roll shape. In a case in which a roll sheet is employed, the above-described embodiments may be applicable to have a configuration in which the roll sheet is unrolled and then is cut in the predetermined size.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure and are included in the scope of the invention recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. An image forming apparatus comprising:

a housing;

a liquid applicator to apply liquid on a sheet;

a sheet conveyor configured to convey the sheet on which the liquid has been applied;

a sheet stacker configured to stack the sheet conveyed by the sheet conveyor; and circuitry configured to control conveyance of the sheet, the circuitry being configured to cause the sheet conveyor to:

move the sheet on which the liquid is applied in a first direction which is a same direction the sheet is moving when the sheet passes the liquid applicator;

move the sheet on which the liquid is applied in a second direction, which is opposite to the first direction, after the sheet is moved in the first direction to expose the sheet on which the liquid is applied, to an outside of the housing; and convey the sheet on which the liquid is applied in the first direction to the sheet stacker, after the sheet is moved in the second direction.

2. The image forming apparatus according to claim 1, further comprising:

circuitry configured to detect an amount of liquid applied to the sheet; and circuitry configured to, based on the determined amount of the liquid applied to the sheet, cause the sheet conveyor to perform one of:

exposing the sheet on which the liquid is applied, to the outside of the housing and conveying the sheet back into the housing; and conveying the sheet on which the liquid is applied, in the housing without exposing the sheet to the outside of the housing.

3. The image forming apparatus according to claim 1, wherein the housing comprises:

an opening configured to expose the sheet on which the liquid is applied, to the outside of the housing; and a cover configured to open and substantially close the opening.

4. The image forming apparatus according to claim 1, further comprising a cover configured to cover the sheet in all directions in a state in which the sheet is exposed to the outside of the housing.

5. The image forming apparatus according to claim 4, wherein the cover includes an air hole through which air passes.

6. The image forming apparatus according to claim 1, further comprising an air blower configured to blow air to the sheet on which the liquid is applied.

7. The image forming apparatus according to claim 6, further comprising:

circuitry configured to detect an amount of liquid applied to the sheet; and circuitry configured to determine whether to drive the air blower based on the detected amount of the liquid applied to the sheet.

8. The image forming apparatus according to claim 1, further comprising a projecting rotator configured to contact a liquid applied face of the sheet.

9. An image forming apparatus comprising:

a housing;

a liquid applicator to apply liquid on a sheet;

a sheet conveyor configured to convey the sheet on which the liquid has been applied;

a post-processor configured to perform a post-processing operation to the sheet conveyed by the sheet conveyor; and circuitry configured to control conveyance of the sheet, the circuitry being configured to cause the sheet conveyor to:

move the sheet on which the liquid is applied in a first direction which is a same direction the sheet is moving when the sheet passes the liquid applicator;

move the sheet on which the liquid is applied in a second direction, which is opposite to the first direction, after the sheet is moved in the first direction to expose the sheet on which the liquid is applied, to an outside of the housing; and convey the sheet on which the liquid is applied in the first direction to the post-processor, after the sheet is moved in the second direction.

10. The image forming apparatus according to claim 9, further comprising:

circuitry configured to detect an amount of liquid applied to the sheet; and circuitry configured to, based on the determined amount of the liquid applied to the sheet, cause the sheet conveyor to perform one of:

exposing the sheet on which the liquid is applied, to the outside of the housing and conveying the sheet back into the housing; and conveying the sheet on which the liquid is applied, in the housing without exposing the sheet to the outside of the housing.

11. The image forming apparatus according to claim 9, wherein the housing comprises:

an opening configured to expose the sheet on which the liquid is applied, to the outside of the housing; and a cover configured to open and substantially close the opening.

12. The image forming apparatus according to claim 9, further comprising a cover configured to cover the sheet in all directions in a state in which the sheet is exposed to the outside of the housing.

13. The image forming apparatus according to claim 12, wherein the cover includes an air hole through which air passes.

14. The image forming apparatus according to claim 9, further comprising an air blower configured to blow air to the sheet on which the liquid is applied.

15. The image forming apparatus according to claim 14, further comprising:

circuitry configured to detect an amount of liquid applied to the sheet; and circuitry configured to determine whether to drive the air blower based on the detected amount of the liquid applied to the sheet.

16. The image forming apparatus according to claim 9, further comprising a projecting rotator configured to contact a liquid applied face of the sheet.

17. An image forming apparatus comprising:

a housing;

a cover configured to cover a sheet in a state in which the sheet is exposed to an outside of the housing, the cover including an air hole through which air passes;

a first sheet conveyor configured to convey the sheet on which liquid is applied;

a second sheet conveyor configured to convey the sheet to a post-processor configured to perform a post-processing operation to the sheet conveyed by the first sheet conveyor; and circuitry configured to control conveyance of the sheet, the circuitry being configured to cause the first sheet conveyor to:

expose the sheet on which the liquid is applied, to the outside of the housing; and convey the sheet to the second sheet conveyor.

18. The image forming apparatus according to claim 17, wherein the circuitry is configured to cause the first sheet conveyor to:

rotate in one direction to perform the expose the sheet on which the liquid is applied, to an outside of the housing; and rotate in another direction opposite the one direction to convey the sheet.

19. The image forming apparatus according to claim 17, wherein the second sheet conveyor includes:

a sheet conveyance passage configured to convey the sheet to the post-processor; and a sheet stacker configured to stack the sheet, and wherein the circuitry is configured to cause the first sheet conveyor to:

convey the sheet on which the liquid is applied, to the sheet stacker;

change a sheet conveyance direction in which the sheet is conveyed, to a first direction to expose the sheet to the outside of the housing; and change the sheet conveyance direction to a second direction opposite the first direction, to convey the sheet to the sheet stacker.

20. The image forming apparatus according to claim 17, wherein the second sheet conveyor includes a sheet conveyance passage configured to convey the sheet to the post-processor, and wherein the circuitry is configured to cause the first sheet conveyor to:

convey the sheet on which the liquid is applied, to the sheet conveyance passage;

change a sheet conveyance direction in which the sheet is conveyed, to a first direction to expose the sheet to the outside of the housing; and change the sheet conveyance direction to a second direction opposite the first direction, to convey the sheet to the sheet conveyance passage.

21. The image forming apparatus according to claim 17, further comprising:

circuitry configured to detect an amount of liquid applied to the sheet; and circuitry configured to, based on the determined amount of the liquid applied to the sheet, cause the first sheet conveyor to perform one of:

exposing the sheet on which the liquid is applied, to the outside of the housing and conveying the sheet back into the housing; and conveying the sheet on which the liquid is applied, in the housing without exposing the sheet to the outside of the housing.

22. The image forming apparatus according to claim 17, wherein the housing comprises:

an opening configured to expose the sheet on which the liquid is applied, to the outside of the housing; and another cover configured to open and substantially close the opening.

23. The image forming apparatus according to claim 17, further comprising an air blower configured to blow air to the sheet on which the liquid is applied.

24. The image forming apparatus according to claim 23, further comprising:

circuitry configured to detect an amount of liquid applied to the sheet; and circuitry configured to determine whether to drive the air blower based on the detected amount of the liquid applied to the sheet.

25. The image forming apparatus according to claim 17, further comprising a projecting rotator configured to contact a liquid applied face of the sheet.

* * * * *